US006494991B1

(12) United States Patent
Palmer et al.

(10) Patent No.: US 6,494,991 B1
(45) Date of Patent: Dec. 17, 2002

(54) PAPER PRODUCTS COMPRISING FILLER MATERIALS PREFLOCCULATED USING STARCH GRANULES AND/OR POLYMERIZED MINERAL NETWORKS

(75) Inventors: Richard F. Palmer, Camas, WA (US); Mike S. D. Juang, Vancouver, WA (US); James S. Johnson, Portland, OR (US); Barbara R. Atha, Vancouver, WA (US); David T. Lee, Vancouver, WA (US); Larry L. Malcom, Washougal, WA (US)

(73) Assignee: Boise Cascade Corporation, Boise, ID (US)

( * ) Notice: Subject to any disclaimer, the term of this patent is extended or adjusted under 35 U.S.C. 154(b) by 0 days.

(21) Appl. No.: 09/899,368

(22) Filed: Jul. 2, 2001

Related U.S. Application Data

(62) Division of application No. 09/118,515, filed on Jul. 17, 1998, now Pat. No. 6,406,594.

(51) Int. Cl.[7] ..... D21H 17/68; D21H 17/67

(52) U.S. Cl. ..... 162/181.6; 162/181.7; 162/175; 162/158; 162/181.1; 162/181.5; 428/331

(58) Field of Search ..... 162/183, 158, 162/181.1–181.7, 147, 75, 9, 157.6; 428/195, 211, 221, 323, 331

(56) References Cited

U.S. PATENT DOCUMENTS 52,545 A * 2/1866 Dixon ..... 162/42
228,328 A * 6/1880 Ehrhardt ..... 162/181.2
2,757,085 A * 7/1956 Paquin ..... 162/181.7
2,935,437 A * 5/1960 Taylor ..... 162/181.6
3,034,913 A * 5/1962 Lagerstrom ..... 106/466
3,227,607 A * 1/1966 Mays et al. ..... 162/181.6
3,549,486 A * 12/1970 Pitt ..... 162/156
3,783,096 A * 1/1974 Perdue et al. ..... 162/181.3

OTHER PUBLICATIONS

Kirk–Othmer "Encyclopedia of Chemical Technology" Third Edition, Vol. 20, pp. 748–775, Jan. 1982.*

Casey, James P. "Pulp and Paper: Chemistry and Chemical Technology," Third Edition, Vol. III, pp. 1602–1603.*

* cited by examiner

*Primary Examiner*—Jose Fortuna
(74) *Attorney, Agent, or Firm*—Klarquist Sparkman, LLP

(57) ABSTRACT

Composite products having mineral networks polymerized about cellulosic material and a method for making such products are described. One embodiment of the composite product comprises a paper product having a polymerized mineral network, such as a silica/silicate network around, throughout and/or about the cellulosic material instead of having isolated particles of filler material deposited onto, or purposefully bonded to, the cellulosic material. One embodiment of the method comprises providing a mixture comprising cellulosic material, a Group I metal silicate and a Group II metal base or salt. The mixture is then carbonated to produce a product comprising precipitated carbonate filler material and a polymerized mineral network about the cellulosic material. This product is then formed into paper products wherein the ash content can be substantially greater than conventional paper products while maintaining suitable strength properties.

15 Claims, 39 Drawing Sheets

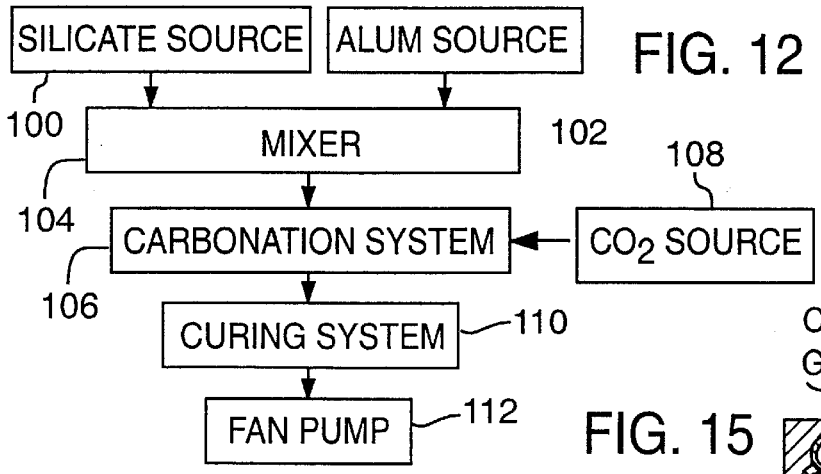
FIG. 12
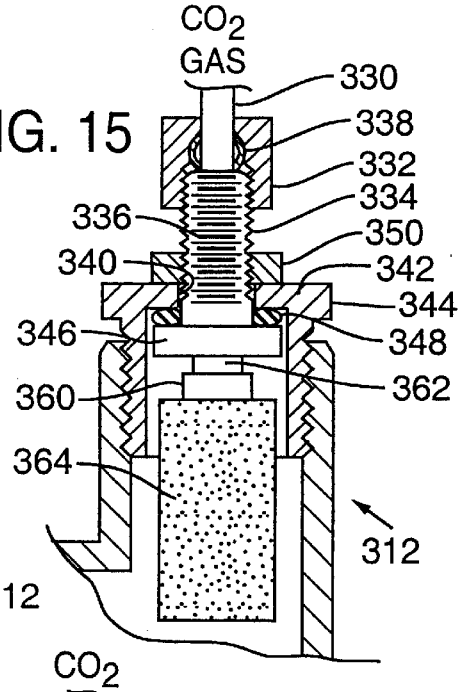
FIG. 15
FIG. 14
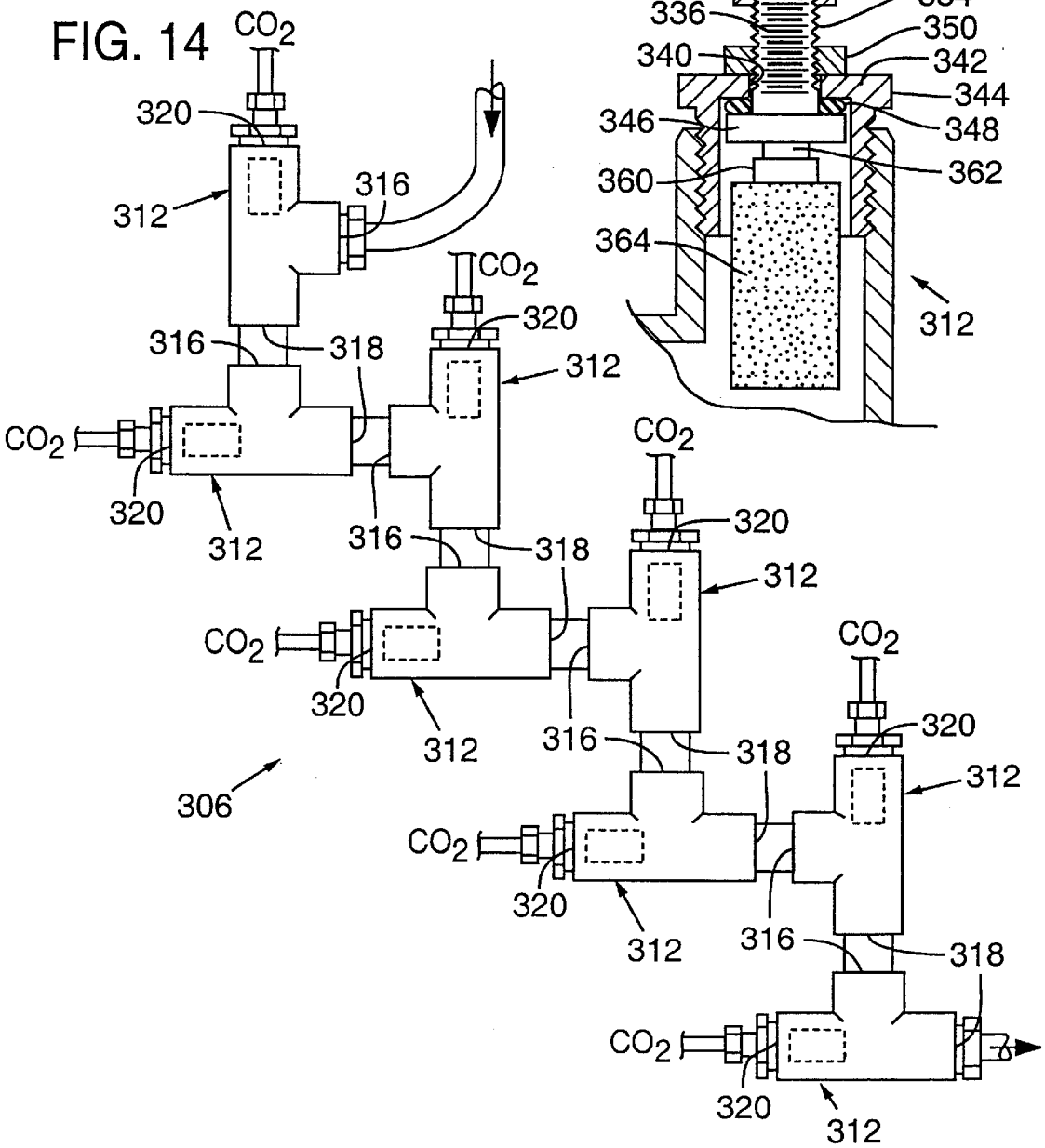

FIG. 36 MD Rewet Breaking Length - SiFLOCC vs Control- No Size Press

FIG. 45 EFFECT OF ASH ON MULLEN - HANDSHEET STUDY

PAPER PRODUCTS COMPRISING FILLER MATERIALS PREFLOCCULATED USING STARCH GRANULES AND/OR POLYMERIZED MINERAL NETWORKS

This application is a division of U.S. Ser. No. 09/118,515 filed on Jul. 17, 1998, now U.S. Pat. No. 6,406,594.

FIELD OF THE INVENTION

The present invention concerns composite products, particularly paper products, comprising fillers flocculated with starch granules prior to combining the flocculated filler particles with cellulosic material and/or polymerized mineral networks and methods for their manufacture.

BACKGROUND OF THE INVENTION

Paper products are composite products in which cellulosic fibers, particularly wood fiber, are the primary component. In addition to fiber, many other materials and chemicals are added to form the desired product. Paper products often include mineral additives, referred to as fillers, such as clay, calcium carbonate, talc, kaolin, calcium sulphate and titanium dioxide. Paper primarily comprises a web of cellulosic fibers and minor amounts of mineral and/or organic fillers. Fillers are used, as the name implies, to fill spaces bounded by the cellulosic fibers of the web. Fillers also improve certain paper properties including opacity, brightness and printability. Other additives also can be used to form paper having desirable end-product properties, such as pigments, dyes, starch, sizing agents and strength-enhancing polymers.

Cellulosic products can be made using conventional fillers more economically than products made without such fillers, primarily because of the cost of cellulosic material. Traditionally, minerals like Kaolin clay (hydrous aluminum silicate), chalk, ground limestone or marble, (calcium carbonate), talc (hydrous magnesium silicate), gypsum (calcium sulfate) and diatomaceous earth (silicon dioxide) have been used as fillers. Most other fillers are inorganic materials produced synthetically from minerals (e.g., titanium dioxide, synthetic silica, barium sulfate), or by regeneration after purification (e.g., limestone-to-lime-to-precipitated calcium carbonate).

Fillers used to form paper products using methods developed prior to the present invention reduce the strength properties, such as breaking length in kilometers of the product (tensile strength divided by the basis weight times 102 by TAPPI Method T494), as the percent of filler used to make such products increases. FIG. 1 illustrates this effect and shows that as the filler content is raised above about 20 % the strength of the paper decreases considerably. Experience also has shown that other undesirable changes occur as the amount of filler used with conventional paper-making processes increases.

Numerous approaches have been proposed and investigated for raising the amount of fillers that can be used to make paper products. A common approach involves bonding filler particles to the fibrous materials. This approach has met with limited success, primarily because (1) the fibrous materials and the fillers are chemically dissimilar, and (2) the cost of the materials used to make the products using this approach.

Chemicals, chemical compositions, and methods directed to solving problems associated with increasing filler and reducing cellulosic material in paper products are known. For example, retention chemicals and compositions are commercially available. These materials have proved satisfactory in solving the problems associated with flocculating and retaining filler particles in the sheet. These prior inventions, however, do not improve the paper strength and therefore do not solve the problems associated with decreasing paper strength with increasing filler content. One possible explanation for this is that while the retention chemicals and compositions are good at flocculating filler particles, they also flocculate filler particles onto the fibers themselves. Paper strength is considered to arise primarily as a result of fiber-to-fiber bonding between adjacent fibers. This fiber-to-fiber bonding occurs at overlapping fiber surfaces. Filler particles flocculated onto the fibers reduce the surface area of the fibers available for this interfiber bonding, and perhaps intrafiber bonding as well, thereby reducing the strength of the paper product.

I. Silica and Silicates as Fillers

Silica and silicates are common materials, and have been used previously as fillers, retention aids, buffers, chelating agents, and coating components for making paper products. In fact, World Minerals Inc. manufactures a line of products, including calcium silicates, to increase bulk, control stickies, increase printability, etc. Thus, when silica or silicate materials are used to make filler or pigment materials, the particle size of the materials is reduced to the classical range (0.1 to 10 micron) for filler particles even if initially the particles are produced in larger sizes. For example, U.S. Pat. No. 4,790,486 describes a process for preparing paper that involves making hydrous silicic acid fillers by wet pulverizing a slurry to 1–30 microns from large particles. U.S. Pat. No. 5,030,284 discloses a spray drying technique of gelled alumina-silica-sulfate compositions to generate 1–10 micron particles.

Silica and silicate have been used as retention/drainage aids for the production of paper. For example, U.S. Pat. No. 5,127,994 describes using silica-based colloids. The colloidal particles have a particle size of 4 to 7 nanometers. U.S. Pat. No. 4,643,801 describes an improved binder system containing three ingredients, a cationic starch, anionic polymer, and dispersed silica having a particle size of 1–50 nanometers (0.001 to 0.05 microns). This system requires the three components and utilizes small dispersed silica. This seems to be a variation of U.S. Pat. Nos. 4,385,961 and 4,388,150, which have a binder system of colloidal silicic acid and cationic starch.

Other variations of these retention/drainage aids include the formation of microgels, which are three-dimensional chain networks formed of particles having a diameter of 1–2 nanometers. These small colloidal particles are stabilized to prevent further growth or gellation. See, for example, U.S. Pat. Nos. 4,954,220, 5,279,807 and 5,312,595. Neutralization of alkali silicate solutions forms polysilicic acid (from polymeric anions), which polymerizes to form microgels comprising three dimensional aggregates of very small particles of polysilicic acid. The formation of polysilicate microgels is initiated by the addition of an acidic material (aluminum sulfate, sodium stannate, sodium orthoborate decahydrate, acid ion exchange resins, sodium aluminate, etc.). The "initiator" starts the gelation (polymerization) process, which is stopped before total gelation of the solution. This process is done independent of the papermaking process. It is then added to the system as any other retention/drainage additive. See, FIG. 2, which shows the polymerization behavior of silica. Polysilicate microgel has been found to constitute a good retention and drainage aid when combined with a water-soluble cationic polymer.

Kaliski's U.S. Pat. No. 5,240,561 discloses the use of microgels formed similarly from alkali silicate solutions and a second aqueous solution of sodium aluminate or sodium zincate. Kaliski's patent concerns a process for making paper and teaches the formation of microgels in situ (in the furnish). But his microgels, described as transient, chemically reactive, subcolloidal sodium-silico-aluminate or similar microgels, must be crosslinked with bivalent and/or multivalent inorganic salts (like calcium chloride) prior to the formation of colloidal particles (Tyndall effect). This crosslinking immediately stops the gelation process (polymerization) and precipitates the calcium crosslinked microgel. Kaliski demonstrates the use of this procedure for papermaking as a new flocculation mechanism where precipitation of the microgel coagulates and flocculates all particulates present in the papermaking furnish. Thus, Kaliski's patent is a variation of the previous patents for retention and drainage aid but is done in situ. Kaliski's patent requires a specific order of addition (1st-sodium silicate, 2nd-sodium aluminate, 3rd-calcium chloride) with a termination of the polymerization at the subcolloidal stage of growth. Kaliski's U.S. Pat. Nos. 5,116,418 and 5,279,663 discusses using this flocculation technology to generate pigments. Kaliski's U.S. Pat. No. 5,378,399 discusses the formation of functional complex microgels.

The patents discussed above concerning colloidal particle and/or microgels, demonstrate no evidence of formation of large three-dimensional mineral networks about the fiber. The initial particles or microgels are very small (usually 1–50 nanometers and less than 100 nanometers or 0.1 micron) and larger particles are actually detrimental to the properties of the silica/silicate. The concentration of the silica/silicate and the subsequent dilution of the materials in the papermaking process would preclude the formation of large mineral networks.

Several publications teach that the formation of large networks of mineral products are not desired for the formation of paper products. For example, U.S. Pat. No. 3,720,531 states that "as is well known, the product obtained by simply neutralizing alkali silicates is useful as adsorbents and catalysts, but this cannot be used as pigment." Emphasis added. A similar statement is made in an article titled "Preparation of an Artificial Silicate Filler," by S. N. Ivanov and V. V. Kuznetski. "It is well known that during processing of water glass (sodium silicate) with acid or solutions of transition metal salts under ordinary conditions gels are formed, which as a result of their structure and properties, cannot serve as fillers." Emphasis added.

Japanese patent Kokai 239795/93 discusses the use of calcium silicate to make an ignition resistant paper, and U.S. Pat. No. 5,372,678 discloses making a calcium hydrosilicate-bound fiberboard by a molding/pressing operation without using conventional fourdrinier.

II. Preflocculating Filler Particles

Methods also have been developed to improve paper strength while increasing filler loading. One such technique involves preflocculating filler particles before the filler particles are added to the cellulosic fiber material. The preflocculated filler agglomerates are better retained by the web created by the fibrous material and are not flocculated onto the fiber. This leaves more fiber surface area available for interfiber bonding, which also increases the strength of the paper product. The methods used to preflocculate filler particles generally are based on the same chemistry as retention materials that are applied in the wet end of the paper making process. These include charge neutralization and using retention chemicals to bridge between filler particles. Similarly charged filler particles repel each other. Charge neutralization involves neutralizing the charges of the particles to alleviate this repulsive force, thereby allowing the particles to flocculate. The chemicals used for these processes include cationic starch, high-molecular-weight cationic or nonionic polymers, or combinations of cationic starch and polymers. Because cationic starch contains positive charges which can flocculate negatively charged pigment particles, it is commonly used in the wet end of the paper making process to flocculate fiber fines.

While preflocculating filler particles has advantages, it also has disadvantages. One disadvantage is that it has proved difficult to control the size of the agglomerates produced by the flocculation process. This can result in the formation of large agglomerates, which appear as visible imperfections in the final paper product, or the agglomerates are too small, which requires the use of retention aids to retain the agglomerates in the sheet.

As stated above, starches have been used to preflocculate filler particles, and some of these inventions have been patented. These inventions involve using starch polymers to flocculate the filler particles, with agglomerates of desired sizes being produced by, for example, subjecting the agglomerates to high shear forces with complicated process designs. One example of a method for flocculating filler particles using starch polymers is Richard Davidson's U.S. Pat. No. 4,151,187.

Although starches have been used to form paper products prior to the present invention, conventional wisdom in the art of paper making is to use cationic starches in the wet end of the paper making process to enhance retention of filler fines and pigment particles. Furthermore, most starches are chemically modified from their natural form prior to being used as flocculating agents. For example, corn starches often are chemically treated, such as by ethylation, to change the naturally occurring chemical structure. The modified starch is then cooked, which breaks the starch up so that it dissolves in water. It can then form a film on the fiber. Starch also is cationized, i.e., chemically treated to provide the material with positive charge so that it is electrostatically attracted to the fiber portion of the paper, which is negatively charged. Starch modification and cationization add processing steps and expense to the overall paper-making process.

SUMMARY OF THE INVENTION

The present invention provides a new approach that in one aspect addresses the filler concentration-strength problem illustrated by FIG. 1, and further demonstrates a fundamentally different approach to the composition, structure and formation of cellulosic products. Past attempts to overcome strength reduction limits of paper products made with fillers were limited by the basic principle that strength is derived primarily from the bonding together of fibers. Prior to the present invention, people of ordinary skill in the art of paper making generally did not consider bonding filler particles together during the formation of paper products beneficial because this reduces the number of individual filler particles, which decreases both product opacity and bulk.

The present invention departs from the concept of relying solely on the bonding together of fibers in cellulosic products to provide adequate strength. The products of the present invention are not just bonded fibrous mats with fillers, but rather comprise composite structures having filler particles bonded to each other (and perhaps also to the cellulosic material) to form a mineral network by polymerization reactions about the cellulose. The result is a new composite product having properties different from conventional paper products. One reason for this may be because properties of the composite product, such as strength, stiffness, opacity, printability, etc., are derived from the bonding together of fiber, the filler network polymerized generally at least partially in the presence of the fiber, and in some embodiments about the fiber, and perhaps bonding between the network and the fiber.

Certain embodiments of the composite products of the present invention differ from conventional paper products in that the method used to produce such products, referred to herein as Ca-FLOCC purposefully results in-the formation of a mineral network, such as a silica/silicate network polymerized around, throughout and/or surrounding the fiber material, which is referred to herein as forming a mineral network "about" the cellulosic material. This is in contrast to conventional processes which deposit isolated particles of filler material onto or bond such filler particles to the cellulosic material. In other embodiments, the formation of the mineral network is initiated outside the presence of the fiber, and then continues after being combined with the fiber, referred to herein as Mg-FLOCC and Si-FLOCC.

One difference between the composite products of the present invention and conventional paper products is illustrated in FIGS. 3–6. SEM images of paper products made according to the present invention, particularly by the Ca-FLOCC method, are clearly distinguishable from paper products made using prior methods, and further show that the Ca-FLOCC method, and to a lesser extent Mg-FLOCC and Si-FLOCC methods produce a mineral network about the fibers. SEM images of ash (i.e., primarily the combustion product of materials added to form the product other than cellulose) of cellulosic products made according to the Ca-FLOCC method still resemble polymerized networks, as opposed to the more friable ash produced from products made having individual filler particles deposited onto or bonded to the cellulosic material as with conventional paper products. See, FIGS. 7–10.

The products of the present invention are usually much stronger than conventional paper products with the same ash content. This is achieved while significantly increasing filler amounts relative to amounts thereof commonly found in paper products made having isolated individual particles of filler product distributed on or bonded to the cellulosic material.

The present invention also concerns a method for making the composite products. The method comprises polymerizing a mineral network at least partially in the presence of the cellulosic fiber, or about a cellulosic fraction. The simplest and easiest approach to forming products by the method Si-FLOCC involves acidifying, such as by adding carbon dioxide to a Group I metal silicate material to initiate polymerization, and then adding this material to cellulose. Another approach to polymerizing the mineral network comprises providing a mixture comprising cellulosic material, a Group I metal silicate, particularly sodium silicates, and a Group II metal base or salt, particularly calcium and magnesium salts, examples of which are calcium and magnesium oxide and calcium and magnesium hydroxide. This mixture is then acidified, and perhaps simultaneously carbonated, to produce a product comprising precipitated carbonate filler material and a polymerized mineral network about the cellulosic material. This product can be formed into common cellulosic products, such as paper products. Carbonating the mixture has been accomplished by combining carbon dioxide with the mixture, but other conventional methods of carbonating aqueous mixtures also can be used.

The mixture typically comprises: (1) from about 40% to about 60%, by weight, (all percents stated herein are by weight relative to the oven dried solids of the stock unless noted otherwise) cellulosic material, particularly delignified cellulose, (2) from about 0.5% to about 20% Group I metal silicates, particularly sodium silicate, and (3) from about 0.5 to about 45% of a Group II metal salt, such as calcium oxide, with the Group II metal salt content being generally equal to, and more typically greater than, the silicate content. The mixtures are then formed into paper products. The mixture also may include other materials commonly used in the formation of paper products, such as but not limited to, materials selected from the group consisting of fillers, such as precipitated calcium carbonate, starch, retention aids, brighteners, biocides, sizing agents, pigments ($TiO_2$, clay, talc, etc.), and mixtures thereof.

The present method provides several advantages over prior methods. For example, much higher filler contents can be used in the formation of products with concomitant cost savings. Moreover, precipitated filler material, such as precipitated calcium carbonate, also can be produced in situ during formation of the product, which ensures that good quality filler is used and is evenly distributed throughout the product, and perhaps incorporated into the mineral network.

The present invention also provides a method for preflocculating filler particles useful for making paper products. The method comprises providing a starch, processing the starch to form starch granules, and and forming filler particle-starch floccules by mixing filler particles with the starch granules. The starch generally is selected from the group consisting of leguminous starches, potato starch, corn starch, and mixtures thereof, preferably pea starch. The step of processing the starch typically comprises providing an aqueous starch dispersion comprising from about 1 to about 10 weight percent starch, and heating the dispersion to a temperature of from about 60° to about 120° C., preferably from about 70 to about 90° C. The average size of the starch granules is typically is from 15 $\mu$m to about 150 $\mu$m, and preferably from about 40 $\mu$m to about 70 $\mu$m The present invention also provides a method for making a paper product comprising: preflocculating filler particles useful for making paper products by processing a starch to form starch granules and forming filler particle-starch floccules by mixing filler particles with the starch granules; providing a cellulosic fraction; and forming a mineral network about the cellulosic fraction simultaneously with or subsequent to combining the filler particle-starch floccules to the cellulosic fraction.

BRIEF DESCRIPTION OF THE DRAWINGS

FIG. 12 is a block diagram of an apparatus for making FLOCC compositions by the method of the present invention.

FIG. 14 is a schematic drawing of a carbonation unit for the apparatus of FIG. 13.

FIG. 15 is a cross sectional view of a carbonation unit of FIG. 14.

DETAILED DESCRIPTION OF THE PREFERRED EMBODIMENTS

The present invention is directed to making paper products that addresses the disadvantages discussed in the Background of the Invention. The present invention involves forming polymerized mineral networks about the fiber and/or preflocculating filler particles with starch granules prior to combining the flocculated filler particles with fiber furnish. Various embodiments of a method for making paper products having polymerized mineral networks, and various embodiments of products made by the methods, are described below. Various embodiments of a method for making paper products by preflocculating filler particles with starch granules, and various embodiments of products made by the method, are described below. The Examples describe working embodiments of these methods and products, as well as paper product made by both preflocculating filler particles with starch granules and forming mineral networks about the fiber furnish.

I. GENERAL PAPER MAKING PROCESS

The general paper making process is known in the art. The following summarizes a particular embodiment of a conventional paper making process to provide an overview of the process that helps explain subsequent features of the present invention.

Figure 11:
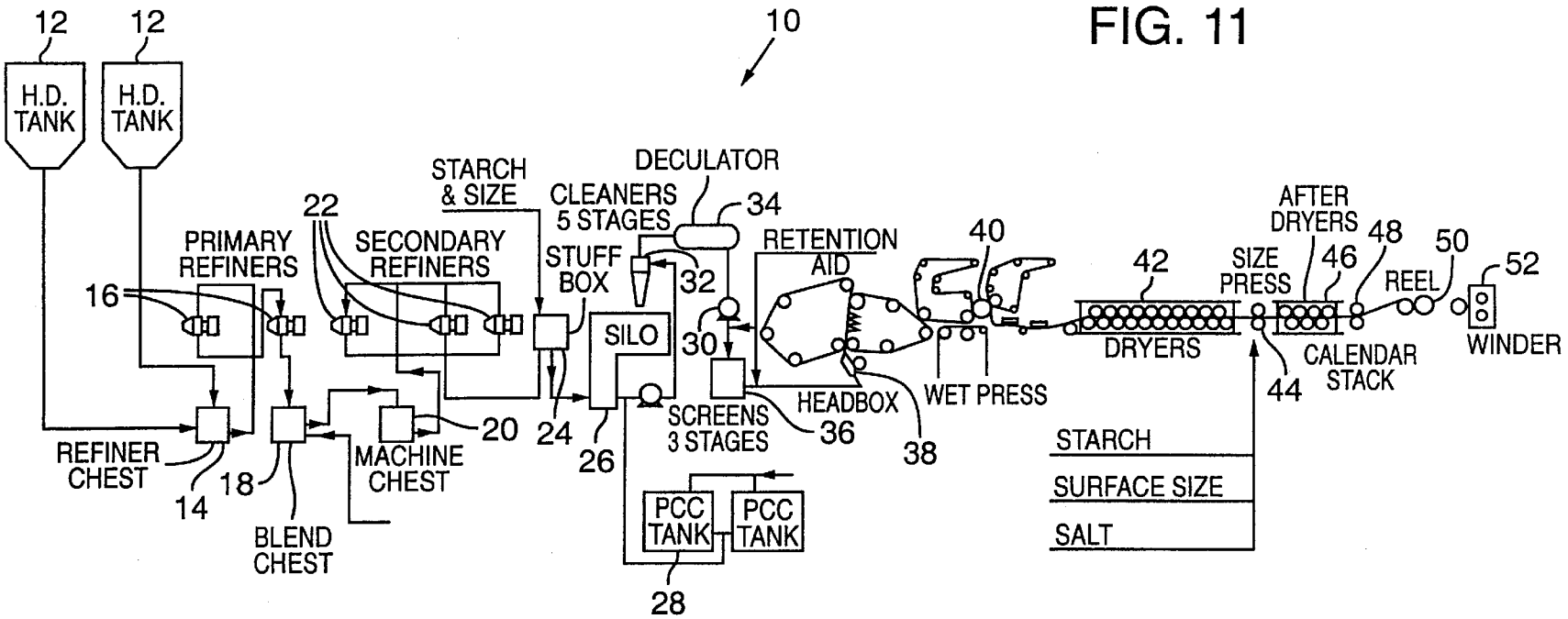
FIG. 11 is a schematic drawing of a conventional paper making process.

FIG. 11 is a schematic of a particular paper making process 10, although it should be understood that the present invention may be practiced with paper making processes that vary from this illustrated process. Viewing FIG. 11 from left to right, the paper making process 10 begins with stock slurry, which includes a dilute suspension, such as about 5–10% consistency, of cellulosic fibers in water. The stock is held in holding tanks designated H.D. TANK 12 in FIG. 11. The stock is fed from H.D. TANK 12, through a REFINER CHEST 14 and into a series of PRIMARY REFINERS 16. The PRIMARY REFINERS 16 alter the characteristics of the fibers by subjecting the fibers to mechanical and hydraulic forces. The stock is then fed into a BLEND CHEST 18, where it is blended with different types of fibers and/or different types of agents, chemicals and filling agents. The resulting stock is then fed through MACHINE CHEST 20 and into a series of SECONDARY REFINERS 22. The SECONDARY REFINERS 22 subject the fibers to mechanical and hydraulic forces to further alter the fiber characteristics. The alteration of the fiber characteristics in the PRIMARY REFINERS 16 and the SECONDARY REFINERS 22 includes breaking some of the intrafiber bonds and allowing penetration of water into the fibers.

After the secondary refining process, to ensure a uniform dispersion through the system, the stock is fed into a constant head tank, called a "STUFF BOX" 24. In the STUFF BOX 24, starch and sizing agents may be added to the stock. Starch acts as an interfiber binding agent, while the sizing agents act to make the finished paper product repel water. From the STUFF BOX 24, the stock enters a machine SILO 26 for dilution.

After the stock exits the SILO 26, a filler can be introduced into the stock. In the diagram shown, the filler is precipitated calcium carbonate (PCC), which is fed into the stock from PCC TANK 28. The filler fills the interstitial sites within the web of cellulosic fibers. Next, the stock is fed by a primary cleaner supply pump into a series of centrifugal CLEANERS 32, and from there into a DECULATOR deaeration system 34, which removes entrained air from the stock. The fan pump 30 feeds the SCREENS 36 to remove foreign substances and course, irregular or unseparated fibers from the stock. A RETENTION AID can be added before and after the stock is fed through the fan pump 30. The retention aid retains the filler, fibers, fines, additives (size, starch), etc. within the web of cellulosic fibers while the dilute stock is passed along the porous conveyor of the paper machine.

The stock is then fed into a paper machine. The stock first enters a HEAD BOX 38 that pressurizes the stock and thereafter dispels a sheet of the stock onto a continuous porous conveyor belt. While the sheet is being moved by the conveyor belt, the machine applies suction to remove water from the web of fibers. The sheet is then conveyed through a WET PRESS 40, which removes additional water from the sheet and forces the fibers together. Subsequently, the sheet is conveyed through a series of heated rollers, DRYERS 42, that evaporate most of the remaining water and induce the formation of inter-fiber bonds within the sheet. After DRYERS 42, the sheet then runs through a SIZE PRESS 44 which sizes the surface of the sheet ("sizes" refer to adding a sizing agent to the surface of the sheets), adds starch to the surface of the sheet to help bind down the filler and any fibers that may be telescoping upwardly from the surface of the sheet, and may also add a mineral or filler, such as salt. The sheet is then conveyed through another series of heated rollers, AFTER DRYERS 46, which evaporate any remaining water from the sheet. The dried sheet is calendared through a series of roll nips, CALENDER STACK 48, to reduce the thickness of the sheet and to produce a smooth sheet surface. The sheet then goes through a REEL 50, and a WINDER 52 winds the sheet into a roll of paper.

II. Ca-FLOCC, MG-FLOCC and Si-FLOCC PAPER PRODUCTS

A. General Methods and Steps for Forming Composite FLOCC Products Currently, there are three general methods for forming mineral networks of the present invention: (1) acidifying a mixture comprising a Group I metal silicate in the presence of a Group II metal base or salt; (2) carbonating a Group I metal silicate mixture, perhaps in the presence of a Group II metal base or salt; and (3) using cementious materials. The first and second methods currently are preferred, and working examples of handsheet formation and paper trials for both of these methods are provided below. The general methods can be practiced by (1) selecting appropriate reagents; (2) forming an aqueous mixture containing most, if not all, of the desired reagents; (3) acidifying, and perhaps carbonating, the mixture; (4) optionally adding additional materials conventionally used to form paper-products; and (5) forming paper products from the mixture after a cure time sufficient to provide desired product properties. Each of these steps is discussed in more detail below.

1. Selecting Reagents a. Cellulosic Material

Cellulosic material is a primary component, in terms of weight percent, of the present composite products, and the cellulosic materials used can vary. Working embodiments of the present invention have used mixtures comprising hardwood and softwood. But, it should be understood that the present invention can be practiced with all cellulosic materials commonly used to form paper products, including both virgin and recycled materials, chemical pulp, mechanical pulp, and chemimechanical pulp containing lignin. The amount of cellulosic material added generally is the balance of the composite product after considering the additional desired materials used to form particular products.

b. Mineral Network Materials

A second material (or materials) used to form the products of the present invention is the material (or materials) used to form the mineral network. A number of mineral networks are likely useful, and the present invention is directed to all such mineral networks. Working embodiments of the present method have produced paper products having mineral networks comprising silica, silicates and aluminosilicates. These materials are discussed in more detail below, as is a possible chemical theory for the formation of the mineral network. Additional examples of a mineral network useful for forming the present products are boron oxide, aluminum oxides, silicophosphate, silicoaluminophosphate, and mixtures thereof.

Silicate networks generally are formed by the present method by processing mixtures comprising Group I metal silicates, particularly sodium silicates. The aluminosilicates are formed using a Group I metal silicate, and reacting such silicate material with an aluminum compound, such as aluminum sulfate (alum). See, Example 3 for further guidance concerning the formation of composite products comprising aluminosilicates.

The amount of mineral network formed with the present composite products typically is specified with respect to the amount of starting reagent added to make such products. The mineral network generally is less expensive than the cellulosic material; as a result, the portion of the composite product resulting from the mineral network should be as high as possible without sacrificing desirable properties in the composite product. This amount varies depending on the nature of the product being produced. Solely by way of example, it currently is believed that the amount of mineral network precursor material to be added, again based on the oven-dried solids weight of the composite, should be from about 0.1% to about 60%, preferably from about 1% to about 40%, and even more preferably from about 2% to about 20%.

The amount of a particular material added to the composite products also can be specified with respect to its proportion of the ash produced by burning paper products. Cellulose and other organic materials used to make paper form gaseous products upon combustion, primarily carbon dioxide and water, but the combustion products of the mineral additives (pigments and fillers) remain to form the ash. As a result, the amount of mineral materials, other than cellulose, forming the present composite products can be specified as a percent of the ash produced by burning the cellulosic product. The total ash content of products made according to the present invention ranges from about 0.1% to about 60%, typically from about 1% to about 40%, and preferably from about 2% to about 35%. The amount of this ash contributed by the mineral network is from about 1% to about 100%. There currently are three primary compositions, and methods for processing these compositions, to produce mineral networks, Ca-FLOCC, Mg-FLOCC and Si-FLOCC. Each of these is discussed separately below.

i. Ca-FLOCC

Ca-FLOCC is the primary method by which mineral networks are polymerized entirely in the presence of the fiber, thereby forming mineral networks about the fiber. Compositions found useful for practicing Ca-FLOCC comprise a Group II metal source, particularly $Ca^{2+}$, particularly CaO, a Group I metal silicate source, such as sodium, potassium and lithium silicate, particularly sodium silicate, and fiber. An aluminum source, such as aluminum nitrate, aluminum acetate, aluminum halogen salts, and aluminum sulfate, can be added to form aluminosilicates. This mixture is then combined with cellulose and acidified. A currently preferred method for acidifying the silicate is to carbonate the mixture by the addition of dry ice, or by bubbling carbon dioxide gas through the aqueous mixture.

The relative amounts of these materials are as follows: 40% to 95% fiber, preferably 60% to 80%; 0.5% to 35% sodium silicate, preferably about 2% to about 15%; 0.5% to 35% calcium hydroxide, preferably about 2% to about 15%. A sufficient amount of carbon dioxide is administered to obtain a pH of from about 7 to about 9, preferably about 8.0.

ii. Mg-FLOCC

Compositions found useful for forming paper products by Mg-FLOCC process comprise an aqueous composition, a Group II metal source, preferably $Mg^{2+}$, such as MgO, a Group I metal silicate source, such as sodium, potassium, or lithium silicate particularly sodium silicate. Aluminum compounds, such as aluminum sulfate, can be added as well to form the aluminosilicate. This composition is then acidified, preferably by the addition of gaseous carbon dioxide.

In contrast to Ca-FLOCC, the polymerization or gelling of the reaction mixture can be done partially outside the presence of the fiber. But, the reaction mixture typically continues to polymerize in the presence of the fiber.

The relative amounts of the components used for the Mg-FLOCC composition are stated typically with reference to the amount of Group I metal silicate and are as follows. The amount of Group I metal silicate is from about 1% to about 7% sodium silicate relative to the amount of water added, preferably about 3.5%. From about 0.05 percent by weight to about 10% by weight, preferably from about 0.25 to about 0.3 percent by weight, of the $Mg^{2+}$compound. If aluminum is desired, then the source of aluminum (like alum) should be added at an amount greater than 0 to about 0.4 gram/gram of silicate, preferably from about 0.15 to about 0.2 gram aluminum source/gram of silicate. The mixture is then acidified, preferably by carbonation, to a pH of from about 7 to 9, preferably about 7–8.

iii. Si-FLOCC

Composition found useful for forming paper products by Si-FLOCC process comprise an aqueous composition having a source of silicate, such as sodium potassium or lithium silicate, particularly sodium silicate. Aluminum compounds, such as aluminum sulfate, also can be added as well to form the aluminum silicate. The composition is then acidified, preferably by the addition of gaseous carbon dioxide, to a pH of from about 7 to 9, preferably about 7–8. The amount of silicate used can vary. However, it currently is believed that about 1% to about 7% sodium silicate, preferably from about 2% to about 3% sodium silicate, are preferred material amounts for practicing the Si-FLOCC process. Furthermore, if an aluminum compound is added, such as alum, then from about 0 to about 0.4 gram/gram of silicate of the aluminum compound (alum) is used.

c. Fillers

Filler materials commonly used in the formation of paper products also can be used to form the composite products of the present invention. Any such fillers now known or hereafter developed that are useful for forming paper products also generally can be used to make composite products in accordance with the present invention. A currently preferred filler is calcium carbonate, particularly precipitated calcium carbonate (PCC). PCC can be added directly to the composite product during its formation using commercially available PCC, can be formed in situ, i.e., in the presence of the cellulosic material during formation of the composite product, or both.

The amount of filler used to form the present composite products also can vary. Working embodiments of the invention have added from about 1% to about 50% filler, particularly PCC, with respect to the oven-dried solids weight of the composite product, typically from about 3% to about 35%, and preferably from about 5% to about 30% filler.

d. Group II Metal Bases or Salts

As stated above, the Ca-FLOCC and Mg-FLOCC processes typically include Group II metal bases and salts, particularly calcium bases such as calcium and magnesium oxide (CaO), and materials chemically equivalent thereto such as $Ca(OH)_2$ and $Mg(OH)_2$. Such materials are added for several reasons, including the formation of mineral networks having Group II metal counterions from the Group I metal silicate reagents, as well as for the formation in situ of fillers such as PCC. A currently preferred approach is to add Group II metal bases or salts to form the mineral network and fillers in situ, and also to add commercially available fillers, such as commercially available PCC. The amount of Group II metal base or salt added to working embodiments of the present invention has been at least less than equal to and more than the amount of Group I metal silicate used, depending upon the desired result.

e. Additional Additives

Other materials commonly used to form cellulosic products also can be used to form the composite products of the present invention. Examples of such materials include, without limitation, starch, retention aids, biocides, fungicides, brightening agents, sizing agents, pigments, dyes, strength-enhancing polymers, alum, other fillers and pigments ($TiO_2$, clay, talc, etc.), and mixtures thereof. These materials are added in amounts determined to enhance particular properties of cellulosic products, and such amounts are best determined with respect to the production of particular products.

Working embodiments of papers made by the method often include retention systems, both cationic and anionic. For example, a number of retention systems have been used, including cationic Percol 175 anionic Percol 122LE, Organopol 21, Hydrocol O, and mixtures thereof. Currently, a preferred retention system comprises Hydrocol O and Organopol 21. A sufficient amount of these materials are added to increase retention of filler and other materials used to make the present products. It currently is believed that from about O pounds/ton of Hydrocol O to about 16 pounds/ton Hydrocol O, preferably about 8 pounds/ton Hydrocol O, and from about 0.05 pounds/to about 2 pounds/ton Organopol 21, preferably about 0.4 pounds/ton, provide working embodiments of paper products.

2. Forming an Aqueous Mixture

Once appropriate reagents are selected, the next step is the formation of an aqueous mixture comprising some or all of the reagents. A currently preferred method is to form an aqueous mixture comprising: (1) the cellulosic material at a consistency of from about 0.1% to about 20%, typically from about 1% to about 16%, preferably from about 2% to about 12%, and even more preferably from about 2.5% to about 11%; (2) filler materials, usually added later in all examples, such as PCC (although fillers also can be added later); and (3) optionally Group II metal bases or salts for the Ca-FLOCC and Mg-FLOCC. This mixture is then stirred to obtain a well mixed composition. Thereafter, an aqueous solution comprising a Group I metal silicate is added to the aqueous mixture with stirring.

D. Acidifying, and Perhaps Carbonating, the Mixture

The next general method step is to acidify, and perhaps simultaneously carbonate, the mixture. It should be realized that carbonating the mixture is essentially a specific instance of acidifying the mixture. This is because the addition of a carbonating agent to the aqueous system either calls for the addition of an acid or results in the formation of such an acid in situ.

Carbonating the mixture can be accomplished in a variety of ways, such as through the addition of carbonic acid, dry ice, etc. A currently preferred carbonating method comprises bubbling carbon dioxide through the mixture. This forms carbonic acid, which then further reacts with the components of the mixture to form the silica/silicate network. Working embodiments of the present invention have carbonated the mixture by fitting a gas diffusion tube to a gas cylinder containing carbon dioxide. See "Description of a Continuous Apparatus" provided below. The diffusion tube is inserted into the aqueous mixture. Carbon dioxide gas is introduced through the diffusion tube into the mixture at a pressure of about 0.5–80 psi. The carbonation step is continued for a sufficient time to lower the pH from an initial pH of about 10–12 to a final pH of about 7–9.

4. Forming Products Having Mineral Networks Other than Silica/Silicate Networks

It should be realized that the above general process steps are particularly directed to the formation of composite products by the general Ca-FLOCC, Mg-FLOCC and Si-FLOCC processes. These process steps may vary if different mineral networks are used to form the product. For example, if the mineral network is an aluminosilicate network, then an aluminum-containing reagent, such as alum, also currently is added in a weight percent less than equal to or in excess, with less than being currently preferred with respect to strength in excess of the Group I metal silicate reagent, See Example 3.

5. Cure Time

Without limiting the present invention to one theory of operation, it currently is believed that the properties desired in the composite product are derived, at least in part, from the formation of the mineral network. The formation of a mineral network in sufficient quantities to result in a composite product having desirable properties, such as relatively high filler amounts with suitable breaking lengths, may take some time to complete.

The time required to form the composite product; which apparently is primarily due to the time required to form the mineral network, is referred to herein as the "cure" time. The cure time can vary, depending upon a number of factors including, but not limited to, the composition of the mineral network, the manner in which the network is formed, the extent to which the mineral network must be formed to provide the desired product properties, pH, temperature, stirring rate, etc. Solely by way of example, it currently is believed that Ca-FLOCC products of the present invention can be formed using cure times of greater than about 1 hour up to about 50 hours, typically from about 5 to about 45 hours, preferably from about 10 to about 45 hours, and even more preferably from about 20 to about 45 hours. However, it also should be realized that the maximum cure time is more likely determined by business reasons, i.e., the business cost of waiting for periods greater than that stated, whereas the minimum cure time is more dependent on the formation of sufficient amounts of the mineral network. And, the polymerization (gelation) process is not stopped at the subcolloidal stage but rather is allowed to proceed to form the mineral network about the fiber material.

Mg-FLOCC and Si-FLOCC can be practiced by forming the compositions started outside the presence of the fiber. The polymerization reaction begins upon acidification. If the acidified composition is added too soon to the fiber, then the resultant paper products do not have the desired characteristics.

But, at the concentrations stated above, the Mg-FLOCC and Si-FLOCC compositions can be formed and then stored for a period of at least several days before being combined with cellulose. As a result, it appears that the Mg-FLOCC and Si-FLOCC compositions should be allowed to cure for a time of greater than 15 minutes, perhaps as long as at least about 30 minutes, but thereafter the time for combining the Mg-FLOCC and Si-FLOCC compositions with cellulose can vary considerably.

6. Forming Cellulosic Products

The next step is the formation of cellulosic products by conventional means, such as using paper machines. Working embodiments of paper products made according to the present invention have been made using both laboratory handsheet devices and pilot paper machines. Further details concerning the formation of paper sheets are provided in the examples. The following section describes one embodiment of an apparatus useful for continuously forming FLOCC compositions.

B. Apparatus for the Continuous Formation of Mineral Materials

FIG. 12 illustrates a block diagram of an apparatus for continuously producing a gelled product called FLOCC sufficient for addition as a filler in a fiber slurry as described above. Preferably, a SILICATE SOURCE 100 and an ALUM SOURCE 102 feed a silicate solution and an alum solution, respectively, into a MIXER 104 which combines the solutions to form a homogeneous reaction mixture. Alternatively, the reaction mixture may include the silicate solution without the alum solution. A CARBONATION SYSTEM 106 then diffuses $CO_2$ from a $CO_2$ SOURCE 108 into the reaction mixture. The reaction mixture then goes through a CURING SYSTEM 110, wherein the mixture polymerizes and cross links to form a gel. The gelled product called FLOCC is then introduced into a fiber slurry at the suction side of the FAN PUMP of a paper machine (see FIG. 11, Paper Making Schematic, FAN PUMP 30).

Figure 13:
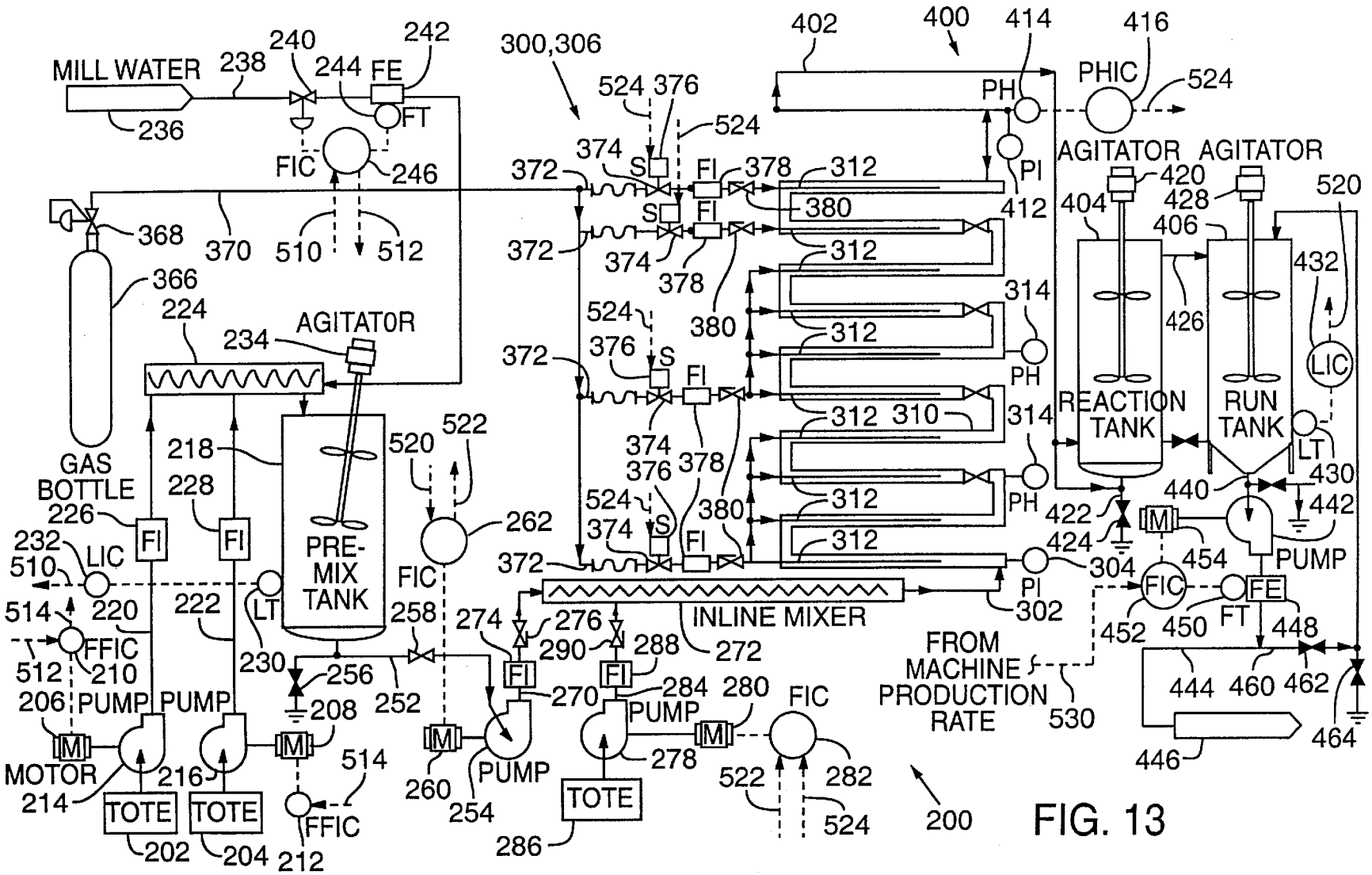
FIG. 13 is a schematic drawing of a commercial embodiment of an apparatus for continuously making FLOCC compositions by the method of the present invention.

FIG. 13 illustrates a possible commercial embodiment of an apparatus 200 more specifically in schematic form. The apparatus 200 includes two alternative chemicals to make up the SILICATE SOURCE (see FIG. 12) SILICATE SOURCE 100), which are preferably TOTES 202, 204. MOTORS 206, 208 power two PUMPS 214, 216, with PUMP 214 pumping silicate from TOTE 202 and PUMP 216 pumping another chemical from TOTE 204. In a possible commercial embodiment, MOTORS 206, 208 are 1 horsepower motors available from Waukesha. Motors (designated M throughout the figure) 206, 208 are controlled by ratio fluid flow indicator controls 210, 212 (designated FFIC). Preferably, the ratio of the flow from PUMP 214 to the flow from PUMP 216 is constant whether they are pumping solids or liquids, so that the composition of the silicate mixture will remain constant. Also, PUMPS 214, 216 preferably do not pulse during use. In a working embodiment of the invention, PUMPS 214, 216 are 500 series pumps available from Moyno, a division of Robbins & Myers, Inc. in Springfield, Ohio. Alternatively, PUMPS 214, 216 are 1000 series pumps available from Moyno. In a possible commercial embodiment, PUMPS 214, 216 are Waukesha Positive Displacement Pumps. The two pumps 214, 216 allow two chemicals to be mixed in a constant ratio or proportion. In an embodiment wherein the apparatus 200 produces Mg-FLOCC, the two chemicals are magnesium oxide (MgO) and sodium silicate. Alternatively, in an embodiment wherein the apparatus 200 produces Si-FLOCC, a single chemical may be introduced and only a single pump is required.

In the possible commercial embodiment wherein the apparatus 200 produces Mg-FLOCC, the silicate and MgO are pumped from TOTES 202, 204, respectively, through conduits 220, 222, through PRE-MIXER 224 and into PRE-MIX TANK 218. Conduits used to communicate material between the components of this apparatus 200 are hereinafter referred to as lines. In a possible commercial embodiment, each line 220, 222 includes a flow indicator 226, 228 (designated FI throughout the figure) to indicate the rate of silicate flow into the PRE-MIX TANK 218. Each line 220, 222 preferably also includes a pressure relief valve (not shown). The pressure relief valve preferably is included because the PUMPS 214, 216 could explode one of the lines if a clog occurred. The PRE-MIXER 224 mixes the silicate and the MgO so that the MgO is suspended within the silicate. The PRE-MIXER 224 may be a Komax static mixer.

In a possible commercial embodiment, the PRE-MIX TANK 218 includes a level transducer 230 (designated LT throughout the figure). The level transducer emits a signal to the level indicator control 232 (designated LIC), which indicates the level of liquid in the PRE-MIX TANK 218.

An AGITATOR 234 agitates the silicate solution within the PRE-MIX TANK 218 to keep the solution homogeneous and to keep the MgO suspended. The AGITATOR 234 is preferably capable of stirring a 100–200 cps (centipoise) viscosity solution. In a possible commercial embodiment, the AGITATOR 234 is a Lightnin model XJ-30 Heavy Duty mixer.

Water also feeds into the PRE-MIXER 224 to assure that the solution remains at its desired percentage composition, which is critical for proper operation. The water originates from a MILL WATER source 236. A water line 238 extending from the MILL WATER source 236 includes a variable valve 240 (designated throughout the drawing by a ⋈connected to a closed semicircle), which varies the flow of water through the water line. The water line 238 further includes a magnetic flow meter 242 (designated FE), a flow transmitter 244 (designated FT) and a ratio fluid flow indicator control 246 (designated FIC), indicating the flow of water through the line.

The silicate mixture exits through the bottom of the PRE-MIX TANK 218 and flows through a line 252 and into a PUMP 258. A drainage valve 256 (drainage valves and other valves that are typically closed during use are designated by a darkened z,900 ) is fluidly connected to the line 252 near the PRE-MIX TANK 218. Line 252 also includes a shutoff valve 258 (shutoff valves and other valves that are typically open during use are designated by a z,900 ).

In a working embodiment of the present invention, a tank feeds PUMP 254 without the use of the pumps and the PRE-MIX TANK as described above. The tank in the working embodiment includes an agitator and has a line flowing from the tank to PUMP 254.

A variable speed motor 260 powers the PUMP 254. The motor 260 preferably is a larger motor and is controlled by a flow indicator control 262 (FIC). The PUMP 254 pumps the silicate mixture through a line 270 and into an INLINE MIXER 272 (see FIG. 12), MIXER 104). Preferably, the PUMP 254 will pump at the same rate, whether it is pumping solids or liquids. Also, the PUMP 254 preferably does not pulse during use. In a working embodiment, the PUMP 254 is a 500 series pump available from Moyno. However, the PUMP 254 also may be a 1000 series pump available from Moyno. In a possible commercial embodiment as illustrated in FIG. 13, the PUMP 254 is preferably a Waukesha Positive Displacement Pump. Also in a possible commercial embodiment, the line 270 between the PUMP 254 and the INLINE MIXER 272 includes a flow indicator 274 and a back flow prevention valve 276 (designated throughout the figure by ⋈, with an additional line extending in the direction of the flow) that prevents material from flowing back into the PUMP 254.

A solution or mixture is fed into a PUMP 278. Preferably, the solution contains alum. Preferably, the PUMP 278 will pump at the same rate, whether it is pumping solids or liquids. In a working embodiment, the PUMP 278 is a Vera Varistallic pump. However, the pump 278 may be a 500 series pump available from Moyno, or a 1000 series pump from Moyno, or some other pump with the desired characteristics. In a possible commercial embodiment, the PUMP 278 may be a Waukesha Positive Displacement Pump. The PUMP 278 is powered by a motor 280, which is controlled by a flow indicator control 282 (FIC). The motor 280 may be of the same type as motors 206, 208, 260 described above, but it is preferably a 1 horsepower motor. The PUMP 278 pumps the solution or mixture through a line 284 into the INLINE MIXER 272, where it is mixed with the silicate mixture, since the ratio between the flows of PUMP 254 and PUMP 278 is important to produce the correct composition in the resulting mixture. In a working embodiment, the ALUM SOURCE (see FIG. 12), ALUM SOURCE 102 is a tank feeding into a pump. In a possible commercial embodiment, the ALUM SOURCE (see FIG. 12), ALUM SOURCE 102) is a TOTE 286. Also, in a possible commercial embodiment, the line 284 between the PUMP 278 and the INLINE MIXER 272 includes a flow indicator 288 and a back flow prevention valve 290.

In a possible commercial embodiment, the line 270 between the PUMP 254 and the INLINE MIXER 272 and the line 284 between PUMP 278 and the INLINE MIXER each include a pressure relief valve (not shown). The silicate solution and the alum solution could clog within the lines and both PUMP 254 and PUMP 278 will continue to pump at the same rate even when such clogging occurs. Thus, the clogging may cause substantial increases in pressure within the apparatus 200 in a short period of time. Pressure relief valves at strategic positions will relieve this pressure when necessary.

The INLINE MIXER 272 mixes the silicate mixture and the alum source together so they can react and form a homogeneous mixture. Alternatively, in an embodiment wherein an alum solution is not added to the FLOCC, the INLINE MIXER 272 may be omitted. In a working embodiment, the INLINE MIXER 272 is a static inline mixer Model No. 3/4-40-3-12-2 available from Koft Corp. In a possible commercial embodiment, the INLINE MIXER 272 may be a Komax Static Mixer.

The FLOCC exits the INLINE MIXER 272 and is fed through a line into a CARBONATION SYSTEM 300 (see FIG. 12), CARBONATION SYSTEM 106). In a possible commercial embodiment, the line 302 between the INLINE MIXER 272 and the CARBONATION SYSTEM 300 includes a pressure indicator 304 (designated PI throughout the figure).

The CARBONATION SYSTEM 300 includes at least one carbonation unit 306 (the apparatus 200 of FIG. 13 has only one carbonation unit; (see FIG. 14 for a more detailed illustration of a carbonation unit), and each carbonation unit preferably includes a carbonation line 310 connecting a series of diffusors 312 that diffuse gaseous $CO_2$ into the silicate mixture. Preferably, the carbonation line 310 includes a series of bends to agitate the FLOCC and aid the diffusion of $CO_2$ into the silicate mixture. Multiple pH indicators 314 (designated PH throughout the drawing) are located within the CARBONATION SYSTEM 300 to monitor the pH of the silicate mixture.

FIG. 14 illustrates a working embodiment of a carbonation unit 306, including a series of diffusors 312. In the working embodiment illustrated in FIG. 14 the carbonation unit 306 includes eight diffusors 312. In the embodiment shown, each "T" shaped pipe fitting is adapted to house a diffuser. The "T" shaped pipe fittings are fluidly connected to form the carbonation line 310. Within each diffusor 312, the silicate mixture enters through a first opening 316, changes flow directions by 90 degrees and exits through a second opening 318. The change in direction agitates the silicate mixture and aids the diffusion and mixing. $CO_2$ is introduced through a third opening 320. If a series of eight diffusers 312 does not diffuse sufficient $CO_2$ into the silicate mixture, then more diffusers may be added to the carbonation unit 306, or additional carbonation units may be added to the CARBONATION SYSTEM 300 in series with the existing carbonation unit 306. An inline mixer, such as inline mixer 272 may be added between carbonation units to agitate the silicate mixture.

Referring now to FIG. 15, a $CO_2$ diffusor 312 in a working embodiment is shown in more detail. A $CO_2$ GAS line 330 extends through a first threaded nut 332 and into a tubular bulkhead fitting 334 through a small diameter first end 336. The first end 336 of the bulkhead fitting 334 preferably has outwardly extending threads adapted to engage the threads of the first nut 332. The first nut 332 preferably is snugly turned onto the first end 336 of the bulkhead fitting 334, compressing a gasket 338, such that the gasket 338 presses inwardly on the $CO_2$ GAS line 330 to form a seal. Moving toward the "T" shaped pipe fitting, the first end 336 of the bulkhead fitting 334 extends through an axially extending aperture 340 formed in a radial wall 342 of a threaded plug 344. The threaded plug 344 includes outwardly extending threads that engage inwardly extending threads formed on the wall surrounding the third opening 320 (see FIG. 6) of the "T" shaped pipe fitting. A second end 346 of the bulkhead fitting 334 forms an outwardly-extending head, or flange that is positioned within the threaded plug 344. An annular gasket 348 that is preferably rubber is disposed between the second end 346 of the bulkhead fitting 334 and the radial wall 342 of the plug 344.

Moving back to the opposing side of the radial wall 342, a second nut 350 engages the outwardly extending threads of the small diameter first end 336 of the bulkhead fitting 334. The second nut 350 is tightened toward the radial wall 342 of the threaded plug 344, such that the second nut and the second end 346 of the bulkhead fitting 334 clamp onto the radial wall of the threaded plug. The annular gasket 348 is compressed between the radial wall 342 and the second end 346 of the bulkhead fitting 334 to form a seal.

Moving farther into the "T" shaped pipe fitting, the second end 346 of the bulkhead fitting 334 forms inwardly extending threads (not shown). A filter 360 has a first end 362 with outwardly extending threads that engage the inwardly extending threads formed within the second end 346 of the bulkhead fitting 334. A porous second end 364 of the filter 360 extends farther into the "T" shaped fitting. In a preferred embodiment, the openings within the second end 364 of the filter 360 are between 60 and 110 microns in diameter. The porous filter 360 may be a Capstan Permaflow No. FAP 100 F30 brass porous filter.

In operation, the $CO_2$ flows from the $CO_2$ GAS line 330, through the bulkhead fitting 334 and into the filter 360. The filter 360 separates the $CO_2$ into small bubbles that more easily diffuse into the silicate mixture. It should be appreciated that the diffusion of $CO_2$ into the silicate mixture may be accomplished by some other apparatus that diffuses a pressurized gas into a line that carries a liquid.

Referring back to FIG. 13, the $CO_2$ SOURCE (see FIG. 12; $CO_2$ SOURCE 108) preferably is a pressurized GAS BOTTLE 366 or a liquid Dewar with gas take off or delivery. A variable valve 368 is located at the exit of the GAS BOTTLE 366. A gas line 370 extending from the GAS BOTTLE 366 feeds into multiple gas lines 372 that are arranged in parallel. Each of the parallel gas lines 372 includes a variable valve 374 controlled by a solenoid 376 (designated S throughout the figure), a flow indicator 378, and a back flow prevention valve 380. Each of the parallel gas lines 372 may branch into further parallel gas lines that each feed $CO_2$ into a diffusor 312

As the silicate mixture proceeds through the CARBONATION SYSTEM 300, the diffusion of $CO_2$ into the silicate mixture allows the formation of carbonic acid within the silicate mixture. The carbonic acid subsequently reacts with the silicate, decreasing the pH of the silicate mixture and accelerating the polymerization process. As the pH decreases, the initially formed particles from the polymerization of the silicate mixture cross link so that the particles of silica form a gel. However, when the silicate mixture leaves the CARBONATION SYSTEM 300, it still needs curing time to achieve the optimal amount of cross linking before being introduced into a paper machine.

The CURING SYSTEM 400 (see FIG. 12, CURING SYSTEM 110) allows the FLOCC time to form sufficient cross links, but the FLOCC is preferably agitated within the CURING SYSTEM so that it will not over-solidify. The CURING SYSTEM 400 preferably includes a curing line 402, a REACTION TANK 404, and a RUN TANK 406. Preferably, the CURING SYSTEM 400 begins with the curing line 402 extending from the CARBONATION SYSTEM 300. The movement of the silicate mixture or reaction mixture through the curing line 402 allows the polymerization process to occur. In a possible commercial embodiment, pressure indicator 412 and a pH indicator 414 are also located within the curing line 402. The pressure indicator 412 is connected to a pressure relief valve (not shown). The pH indicator 414 preferably emits a signal to the pH indicator control (PHIC) 416 that indicates the pH of the silicate mixture. The pH indicator current 416 is sent to the controls for the solenoids 376 that control the valves 374 for the $CO_2$ lines 372 in the CARBONATION SYSTEM 300. Thus, the amount of $CO_2$ is varied depending on the pH of the silicate mixture. In this way, the apparatus 200 can produce silicate mixture having a desired pH.

The curing line 402 preferably feeds the silicate mixture into the REACTION TANK 404. An AGITATOR 420 agitates the silicate mixture within the REACTION TANK 404. A drainage line 422 extends from the bottom of the REACTION TANK 404 and includes a shutoff valve 424 that is normally closed during operation of the apparatus 200. The silicate mixture exits the REACTION TANK 404 within a line 426 located near the top of the tank and empties into a RUN TANK 406. The REACTION TANK 404 may include multiple exit lines (not shown) that exit at different levels. Each exit line preferably includes a shutoff valve. During use, one of the multiple exit lines is opened, and the level of the silicate mixture within the REACTION TANK 404 will rise to the level of the open exit line. Thus, the level within the REACTION TANK 404 may be varied by opening different exit lines. The varying tank level will vary the time that the silicate mixture remains within the REACTION TANK 404 with a constant flow rate through the system. In this way, the apparatus 200 can provide the optimal time for the silicate mixture to gel. Additional reaction tanks may be included and arranged in series to allow additional time for polymerization of the silicate mixture. Such an embodiment is preferable for a portable commercial apparatus.

Preferably, an AGITATOR 428 agitates the FLOCC product within the RUN TANK 406. The AGITATOR 428 may be of a type similar to the AGITATOR 234 described above. In a possible commercial embodiment, the RUN TANK 406 includes a level transducer 430, which sends a signal to a level indicator control (designated LIC) 432.

The FLOCC exits the RUN TANK 406 within a line 440 located near the bottom of the tank. In a possible commercial embodiment, PUMP 442 then pumps the FLOCC through a line 444 that preferably empties into the suction side of the FAN PUMP 446 (see FIG. 12, FAN PUMP 112; and FIG. 13, PUMP 30) of the paper machine. Line 444 further includes a magnetic flow meter (designated FE) 448 and a flow transmitter 450, which emit a signal to a flow indicator control 452 indicating the rate of flow through the line. PUMP 442 is preferably powered by a MOTOR 454, which is controlled by the flow indicator control 452. The PUMP 442 is preferably the same type as the PUMPS 202, 204, 278 described above, but it is preferably a 7.5 horsepower motor.

The line 444 between the PUMP 442 and the Fan Pump 446 preferably is connected to a diversion line 460. The diversion line 460 has shutoff valves 462, 464 that are normally closed, but when they are open they allow the FLOCC that leaves PUMP 442 to either be drained from the apparatus 200 (by opening both valve 462 and valve 464) or to be diverted back into the RUN TANK 406 (by opening valve 462 and closing valve 464).

The apparatus 200 preferably is controlled so that the flows within the system allow sufficient time for proper polymerization, provide the proper composition of FLOCC and produce the proper amount of FLOCC for the paper making process. Beginning with water line 238, the flow indicator control 246 receives a control signal 510 from the level indicator control 232, indicating the level of silicate mixture in the PRE-MIX TANK 218. If the level is too low, the flow of water into the PRE-MIXER 224 will be increased by the flow indicator control 246; if the level is too high, the flow of water into the PRE-MIXER 224 will be decreased by the flow indicator control 246. The flow indicator control 246 for the water sends a control signal 512 to the ratio fluid flow indicator control 210, which adjusts the flow rate from the PUMP 214 into the PRE-MIXER 224 so that the flow into the PRE-MIXER of water line 238 and the line 220 remains substantially constant. The ratio fluid flow indicator control 210 sends a signal to the ratio fluid flow indicator control 212 to adjust the flow rate through line 222 so that it remains proportional to the flow rate through line 220. Thus, the composition of the silicate mixture flowing into the PRE-MIX TANK 218 remains substantially constant and the level of the silicate mixture within the PRE-MIX TANK remains substantially constant.

The level indicator control 432 indicating the level of FLOCC within the run tank 406 sends a signal to the flow indicator control 262, which controls the PUMP 254. If the level is too low, the flow of silicate solution through the apparatus will be increased by the flow indicator control 262 increasing the rate of the motor 260; if the level is too high, the flow of silicate solution through the apparatus will be decreased by the flow indicator control 262 decreasing the rate of the motor 260. The flow indicator control 262 sends a signal to the flow indicator control 282 controlling PUMP 278 indicating the rate of flow through the PUMP 254. The flow indicator control 282 then varies the speed of the MOTOR 280 to adjust the rate of flow through the PUMP 278 to keep the ratio of the flows from the lines 270 and line 284. Thus, the composition of the silicate mixture going into the carbonation line 310 and the level in the RUN TANK 406 are substantially constant.

The pH indicator control 406 sends a signal to the flow indicator control 282 that controls the solenoids 376 that control the flow of $CO_2$ into the diffusers 312. The solenoids adjust the flow of $CO_2$ into the diffusers, which will vary the rate of the carbonation of the system, thus altering the pH of the resulting silicate mixture. These adjustments are done so as to produce a silicate mixture at the point of the pH indicators that is substantially constant, insuring that the proper amount of polymerization will occur within the apparatus 300.

The paper machine sends a signal 530 to the flow indicator control 452 indicating the paper MACHINE PRODUCTION RATE, and the flow indicator control 452 adjusts the rate of the motor 454 to produce the proper flow rate of FLOCC through the line 444 and into the paper machine.

In a possible commercial embodiment, the overall control of the various motors and the valves of the apparatus 200 is implemented by computers which process signals from the user or from the transducers and indicators. The computers then sends control signals to the valves and motors as described above. In a commercial embodiment, PC (personal computers) computers may be used.

A specific example of a working embodiment of the present invention includes a one or two carbonation unit 306 having 8 diffusors 312. The curing line 402 of the embodiment is separated into conduit segments, with an inline mixer (not shown) between each segment. The curing line 402 has a first segment that is 50 feet long, a second segment that is 45 feet long, and a third segment that is 50 feet long. Within this embodiment, the conduit extending between PUMP 442 and the fan pump is 50 feet long. The following table gives some preferred times for retention of the FLOCC within each segment of this apparatus 200, beginning with entry of the FLOCC into the inline mixer 272 and ending with entry of the FLOCC into the headbox 446 of the paper machine. These times allow sufficient polymerization of the silicate mixture within the apparatus 200, but they do not allow the FLOCC to prematurely gel or to cross link within the lines before reaching the REACTION TANK 404. The times are also sufficient to produce paper with the indicated percentage of FLOCC in a 160 lb/hr paper machine.

TABLE 1

| FLOCC Composition | INLINE MIXER to REACTION TANK (Minutes) | Within REACTION TANK (Minutes) | Within RUN TANK (Minutes) | RUN TANK to HEAD BOX (Minutes) | Total Time (Minutes) |
|---|---|---|---|---|---|
| 15% Mg-FLOCC | 0.938 | 8.86 | .95 | 0.28 | 11.03 |
| 10% Mg-FLOCC | 1.409 | 12.29 | 1.42 | 0.43 | 15.55 |
| 5% Mg-FLOCC | 2.81 | 24.5 | 2.85 | 0.86 | 31.02 |
| 15% Si-FLOCC | 0.968 | 7.42 | 0.86 | 0.26 | 9.51 |
| 10% Si-FLOCC | 1.45 | 11.12 | 1.29 | 0.39 | 14.25 |
| 5% Si-FLOCC | 2.905 | 22.27 | 2.59 | 0.78 | 28.55 |

It should be appreciated that the apparatus described above may be varied in many ways, provided it sufficiently mixes the FLOCC, diffuses $CO_2$ into the silicate mixture, and allows sufficient time for cross linking without allowing over-solidification within the lines. For example, rather than using a REACTION TANK 404 and a RUN TANK 406, the apparatus could provide a lengthened curing line to allow sufficient cross linking.

C. Chemical Theory Concerning the Formation of Mineral Networks

The formation of composite cellulose-mineral network products involves forming mineral networks with the fibrous material. One method for bonding fillers to form mineral networks involves using alkali- and/or alkaline-earth metal silicates. Without being limited to one theory of operation, it appears that the mechanism explaining the formation of the mineral network involves silicate polymerization. Silicate polymerization occurs by the condensation reaction between two silanol end groups (or silicic acid groups), which produces water and silicon-to-oxygen-to-silicon (Si—O—Si) bonds (See, Reaction 1).

Reaction 1

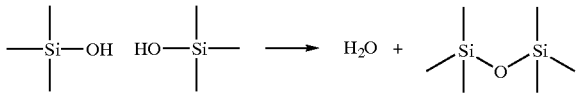

Reaction 1

As the silicate polymerization process proceeds, the silicate components are covenant bonded to each other, and the fibers are trapped in the resulting silicate polymer. Silicon is the second most abundant element of the earth's crust. Silicon is not found in its elemental form in nature but occurs chiefly in combination with the most abundant element, oxygen, as the oxide and silicates. Silicon and oxygen in combination with other elements make up the majority of the minerals on the earth. Thus, it is not surprising that many paper fillers are silicon dioxide (precipitated silica, diatomaceous earth, etc.) and silicates (kaolin clay, talc, mica, etc.). These minerals are commonly called covalent network solids, a crystal lattice composed of atoms, all of which are linked by an indefinitely extended three-dimensional network of polar or nonpolar covalent bonds. Paper fillers commonly used, such as clay, talc, silica, etc., do not exhibit Reaction 1 bonding behavior during formation of paper products made according to methods developed prior to this invention because the silicon is already polymerized or condensed into a covalent network solid. Thus, such materials cannot thereafter be polymerized in the presence of the fibrous network to form the mineral network about the fibrous web. Essentially we are working with components that have been depolymerized and then allowing polymerization to proceed around, throughout, and surrounding the material.

The silanol condensation process can be expanded to include other elements. For example, aluminum can be substituted for one of the silicon atoms in the condensation reaction. Thus, a covalent network solid can be produced where some silicon atoms are replaced by aluminum atoms in the three-dimensional framework structure of $SiO_4$ tetrahedra in which every oxygen is shared between two tetrahedra. Whenever aluminum is substituted for silicon in the three-dimensional framework, the framework must be negatively charged and there must be other cations uniformly distributed through it. These aluminosilicates are among the most widespread, diverse, and useful silicate mineral in nature. Thus, materials like aluminum sulfate, sodium aluminate, sodium stannate, sodium orthoborate decahydrate, metal phosphates, etc. which contain elements (aluminum, tin, boron, phosphorus, etc.) that can substitute for silicon in the condensation process also can be used to form covalent network solids for use in the formation of the present composite products.

In silica, silicates, and aluminosilicates silicon is always tetrahedrally bonded to four oxygen atoms, but the covalent bonds have considerable ionic character. $SiO_4$ tetrahedra are the basic structural units of these materials, and occur singly, or by sharing oxygen atoms, in small groups, in small cyclic groups, in infinite chains, in infinite sheets, or in three dimensional frameworks. The oxide, silicon dioxide (commonly known as silica), occurs naturally in various forms (sand, quartz, flint, etc.) and consists of a continuous network of silicon to oxygen bonds with each silicon bonded to four oxygen atoms and each oxygen to two silicon atoms.

When metal carbonates are fused with silica at high temperatures, carbon dioxide is driven off and a complex mixture of metal silicates is obtained. Essentially, the covalent network solid is depolymerized by cleaving silicon to oxygen to silicon bonds. If alkali metal carbonates are used in the fusion and the mixture is rich in alkali, the products are soluble in water. But, with low alkali content the metal carbonates are still insoluble (not enough depolymerization). Theoretically, with high alkali content it should be possible to generate discrete $SiO_4^{4-}$(orthosilicate) anions, but normally these aqueous alkali silicate solutions contain a complex mixture of polymeric anions. The only silicates soluble in water are those of the alkali metals. The alkaline earth metal silicates are not soluble in water.

The fusion of metal carbonates with silica, silicates, and aluminosilicates is utilized in many industrial processes from the production of cement to sodium silicate. The covalent network solid is depolymerized by the cleaving the covalent linkages (silicon to oxygen to silicon bonds) and the products are metal salts of polysilicic acid (hydrous silicon dioxide). When the fusion products (metal silicates) have high alkali or alkaline metal content (high degree of depolymerization), they are basic. If these products are added to water or neutralized, silicic or polysilicic acid is produced (silanol end groups) which polymerize according to Reaction 1 to regenerate the covalent network solid. With the method of the present invention, this process is used to trap cellulose fibers in a mineral matrix to generate a novel composite material.

Another potential approach to forming the composite products of the present invention uses the usual abbreviated notation employed by cement chemists:

$C3S=3CaO.SiO_2$ $C2S=2CaO.SiO_2$

CS=CaO.SiO2

C=CaO $CH=Ca(OH)_2$

C—S—H=calcium silicate hydrate gel of variable stoichiometry.

$S=SiO_2$ $H=H_2O$

Addition of calcium silicates (C3S, C2S, & CS) to water gives the calcium silicate hydrate gel and calcium hydroxide (See, Reaction 2).

C3S, C2S, and/or CS+H→C—S—H+CH—

Reaction 2

In the presence of a pozzolan the calcium hydroxide can react further to form additional calcium silicate hydrate gel (See, Reaction 3) called the pozzolanic reaction).

Pozzolan or S+CH+H→C—S—H

Reaction 3

A pozzolan is defined as a siliceous or siliceous and aluminous material which itself possesses little or no cementitious value, but in finely divided form and in presence of moisture chemically reacts with calcium hydroxide at ambient temperatures to form compounds possessing cementitious properties. Examples of natural pozzolanas are diatomites, opaline cherts and some shales. Volcanic materials such as pumicites and tuffs are generally less active, while materials such as clays require calcination or heat treatment before they become reactive. Ground blast furnace slag can be considered a pozzolan even though it has some cementitious properties.

Calcium silicate hydrate gels undergo silicate polymerization which binds the filler particles (calcium silicate, silica, etc.) together. These reactions of calcium silicates (C3S, C2S, and/or CS) also can be used to practice the method of the present invention to form covalent mineral network solids that trap the fiber within the mineral matrix.

D. Ratio Of Percent Increase In Breaking Length To The Percent Ash

One primary goal of the present invention is to increase the strength of the paper while also increasing the ash content. One measure of this is the ratio of the percent increase in breaking length to the percent ash. The percent increase in breaking length is the percent increase in breaking length when compared to a control sample without silicate. The percent ash is the percent of material remaining after combusting the sample at 500° C. The percent silicate applied is the weight percent of oven dried sodium silicate added to the oven dried handsheet stock (fiber, filler, sodium silicate, etc.). This ratio increases as the ash content increases because the mineral network is a greater percentage of the total mass. Thus for a mineral component that is adding strength to the composite the ratio should increase as its percentage of the whole.composite (ash percentage) increases. The ratio for a normal filler would be relatively unchanged as the ash percentage increased since it doesn't contribute to the strength. Also, as the silicate concentration increases this ratio should increase since it is the component adding strength to the composite in contrast to other fillers.

Particular ratios for ash percent s ranging from about 5% to about 30% and silicate levels of 3.4% and 12.1% are provided below in Table 18.

TABLE 18

| Ash % | 5 | 10 | 15 | 20 | 30 |
|---|---|---|---|---|---|
| 3.4% Silicate Applied | 1.5 ratio | 1.5 ratio | 1.6 ratio | 1.9 ratio | 2.1 ratio |
| 12.1% Silicate Applied | N/A | N/A | 2.2 ratio | 2.8 ratio | 3.5 ratio |

III. PREFLOCCULATING FILLERS WITH STARCH GRANULES

Making paper by preflocculating filler particles with starch granules includes the following steps, some of which may be optional for producing working embodiments: providing a starch that can be processed to form adhesive granules having suitable size characteristics; processing the starch to form swollen starch granules; forming filler particle-starch floccules by mixing filler particles with the swollen starch granules; and combining the particle-starch floccules with cellulosic furnish to form paper products. Each of these steps, and the materials used to practice each step are, discussed below.

A. Materials

1. Starch

Two features were primarily considered for selecting starches for practicing the present invention. First, suitable starches can be processed to form starch granules. Second, the starch granules formed preferably have a granule size within a desired granule size distribution. One advantage of the present invention is that the process can repeatedly process starch to form granules having optimal and preselected granule size and size distribution for producing paper products having desired characteristics.

For example, copy (or xerographic) paper can be made by this process. Working embodiments of these products have been made using starch granules having a granule size within the range of from about 15 microns to about 150 microns, preferably from about 40 to about 70 microns, and even more preferably from about 50 to about 60 microns. The standard deviation in granule size preferably is about 20 microns. Working examples of paper products made using cooked pea starch typically used pea starch that when processed produced granules having an average size of about 56 microns.

One primary purpose for using starch granules is to flocculate the filler particles and bind such filler particles to the starch granules. Thus, the starch granule's ability to flocculate, as well as its resistance to deflocculation, can be compared. Without limiting the invention to one theory of operation, it currently appears that there is a charge phenomenon associated with the starch granule's ability to flocculate filler particles. It may be that protein associated with certain starches enhances their ability to flocculate the filler particles, but this has not been fully confirmed. As a result, those starches having charge properties that allow them to flocculate filler particles well, perhaps through associated protein, also are likely candidates for practicing the present invention.

The size and size distribution of starch granules, as well as the ability to flocculate filler particles, are dependent upon the species of plant from which the starch is derived. For those paper products listed above, the following several starches have proved useful for producing starch granules having suitable size characteristics including.

Plants belonging to Leguminosae, such as pea and bean, are particularly suitable sources of starch for practicing the present invention. Pea starch currently is a preferred material because it satisfies the two criteria set forth above, and further has proved to be an excellent flocculating agent for filler materials. Preferred pea starch is commercially available from Parrheim of Saskatchewan under the STARLITE mark. STARLITE pea starch is dry ground and is air classified to remove undesirable materials. Wet processed pea starch also has ben tried, but so far has not worked as well as dry processed starch. STARLITE pea starch is derived from field peas, is not modified and is air classified to provide large starch particles. The size of the STARLITE particles as sold is about 23 $\mu$m. STARLITE is a white, free-flowing powder sold having about 10% to about 13% water content, a pH for the cooked starch of about 6.5, and an amylose content of about 35 percent. Chemical analysis of STARLITE shows that it contains about 84% starch, about 5% protein, about 4% sugars, about 1% lipids and about 1% ash.

Potato (bud and whole potato) starches also have been tried. These starches produce granules significantly larger than that of pea starch, e.g., such as about 265 Am for potato compared to about 60 $\mu$m for pea starch. Potato starch may have more associated protein than corn starch, and therefore may be a better flocculating agent. Potato starch also is amphoteric, which is beneficial because it can be made cationic or anionic depending on the pH of the system and the desired results for a particular paper formulation. But, potato starch also forms granules having a slightly larger average granule size than pea starch, which is one reason why pea starch is the currently preferred starch material.

Pearl corn starch also has been tried, and has proved useful for making products in accordance with the process of the present invention. Modified corn starch also has been tried, but the modified corn starches tried tend to dissolve during aqueous processing instead of forming granules. To the extent a modified starch or starches are known or hereafter produced that form granules having suitable size characteristics by processing in accordance with the claimed process, then such materials also are or likely to be suitable starch sources as well.

Based on the above, starches that currently appear to be most useful for practicing the present invention can be selected from the group consisting of starch from plants belonging to Leguminosae, particular pea starch, potato starch, corn starch, and mixtures thereof.

One primary purpose for using starch granules is to flocculate the filler particles and bind such filler particles to the starch granules. Thus, the starch granules ability to flocculate and resist deflocculation can be compared. Without limiting the invention to one theory of operation, it currently appears that there is a surface charge phenomenon associated with the starch granule's ability to flocculate filler particles. It may be that protein associated with certain starches enhances their ability to flocculate the filler particles, but this has not been fully confirmed.

2. Filler Particles

In general, the method of the present invention can be practiced using any filler material useful for making paper products which can be flocculated using starch granules made as described herein. A partial list of such filler materials includes calcium carbonate, including but not limited to, precipitated calcium carbonate (PCC), ground calcium carbonate, chalk, clay, titanium dioxide, talc, dolomite, calcium sulphate, barium sulfate, kaolin, aluminum hydroxide, satin white, and mixtures thereof 3. Additional Paper Additives Materials in addition to fillers that are commonly used to produce paper products also can be used in combination with the filler particles preflocculated using particulate starch. For example, paper additives such as sizing agents, cationic starch, dyes, wet and/or dry strength enhancing agents, and mixture thereof can be used. Working embodiments of the present invention have mixed starch granules, such as cooked pea starch granules, with cationic polymers, such as polyaluminum chloride, to help preflocculate filler particles.

Moreover, retention chemicals and drainage aids commonly used in paper making at the wet end also can be used in combination with the filler particles agglomerated using starch granules. Without limitation, a partial list of such materials considered useful for use in combination with the filler-particle/starch floccules of the present invention includes cationic starch, cationic polyacrylamides, cationic polyamides, polyimides, polyamines, polyaluminum chloride, alum, aluminum chlorohydrate, cationic metal ions, such as calcium ion, magnesium ion, and ferric ion, and mixtures of these materials.

B. Processing Starch to Form Starch Granules

Suitable starches, selected as discussed above, are then processed to form starch granules having the desired average granule size and distribution, as well as filler particle flocculation characteristics. These processing steps include processing the starch to form starch granules, flocculating filler particles with the starch granules, and adding starch-granule/filler particles floccules to cellulosic furnish for the production of desired paper products. The method also optionally can include the step, or steps, of adding additional materials, such as starch cationizing agents, to either the starch, the filler particles, or the floccules.

1. Forming Starch Granules

A desired amount of starch is first obtained. The amount of starch depends on the amount of filler being added, as well as the ratio of starch-to-filler being used. Working embodiments of paper products have been made in accordance with the method of the present invention using filler particle:starch granule ratios of from at least about 1:1 to about 25:1, more typically at least about 10:1, preferably from about 15:1 to 22:1, and even more preferably about 18:1. Too little filler or too much filler can be detrimental to paper properties other than just strength. For example, if there is too much filler then the ratio of the starch used to filler particles is too high and the cost of producing the paper product is significantly increased. If too little starch is used, then there is insufficient starch granules to flocculate all the added materials. Filler and pigment particles free from the floccule are not retained during the paper making process as well and also form dust after the product is made.

Once the desired filler particle:starch granule ratio is determined, an aqueous starch dispersion is then formed using the appropriate amount of starch. This typically involves dispersing the starch in cold water. The relative amounts of starch and water can vary, being governed by processing considerations, such as ease of stirring. If too high a solids content is used then it is difficult to mix/stir the dispersion. This upper practical limit probably is about 10 percent by weight of solids. The lowest limit practical amount is that amount that allows products having desirable characteristics to be formed. Currently, it appears that the amount of starch to be used should be from about 0.1 weight percent to about 10 weight percent, preferably greater than about 1 percent, with about 6 weight percent being a typical consistency.

Figure 43:
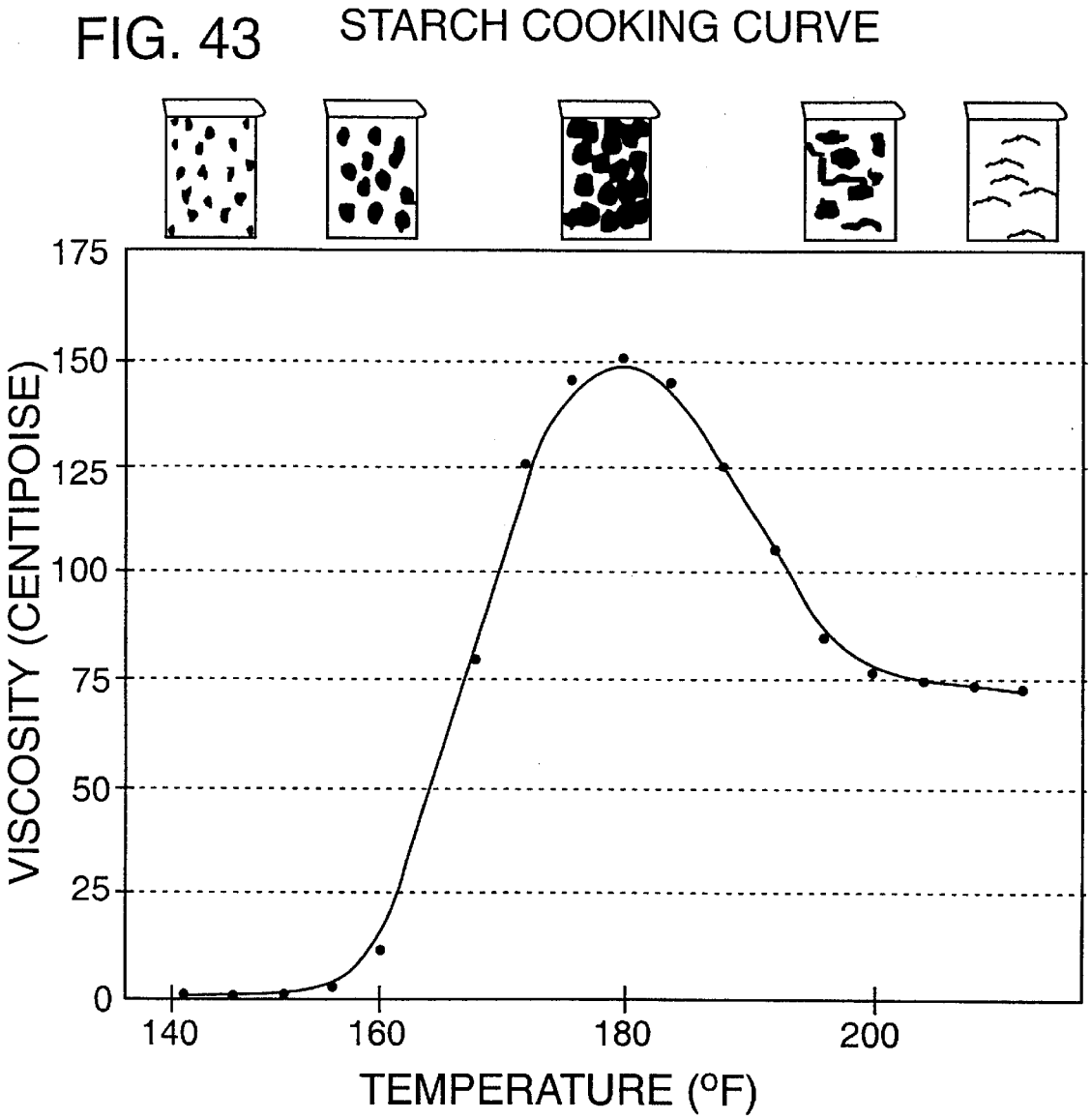
FIG. 43 illustrates how viscosity of an aqueous starch dispersion varies with increasing temperature.

This aqueous dispersion is then heated with agitation. The purpose for heating the starch is to change the physical form of the starch from that of its crystalline form to discrete swollen granules. FIG. 43 illustrates the effects heating has on starch. Starches generally are high-molecular weight materials that do not dissolve well in water. These starches can be dispersed in water, and when heated begin to swell and the viscosity of the dispersion increases. If heated too long at too high a temperature, the starch particles eventually burst. Conventional wisdom has been to treat starches so that the starches dissolve in water. The dissolved starches are added to filler particles to form films thereon and to bind the particles. One feature of the present invention is the recognition that filler particle flocs can be produced more efficiently and with better, more reproducible size distributions by processing the starches to the granule stage rather than form starch solutions, and then using these starch granules to agglomerate filler particles.

The temperature at which the aqueous dispersion is heated to form starch granules can vary, but generally is from at least about 50° C. to about 120° C., and preferably from about 70° C. to about 90° C. Starch has been cooked in a pressure vessel and starch granules were produced by this method, but as temperature increases the granules start to split or burst. Although the aqueous starch dispersion can be cooked at the boiling point of water, or even higher, it generally is not. Rather, the aqueous starch dispersion typically is cooked at a temperature of from about 85° C. to about 90° C. for about 5 minutes.

It is common at a paper mill to cook starch with pressurized steam, and this process is referred to as "jet cooking." The temperature and pressure of the pressurized steam is significantly higher than that at atmospheric pressure. The "jet" not only cooks the starch, but also ruptures the starch particles. Jet cooked starch particles can be used to flocculate particles, but the size and distribution of the flocculated materials produced by jet cooking is not as consistent as that produced by cooking the starch at temperatures of from about 85° C. to about 90° C. and at about one atmosphere.

After this initial heating step, the heated dispersion is then diluted and cooled to a temperature less than the processing temperature but typically greater than about 50° C., and more typically about 70° degrees. The dispersion is then held at this temperature with stirring until being used for the next step of the operation. This can be accomplished by diluting the aqueous starch dispersion with hot water to a consistency of about 2%–3%.

Figure 40:
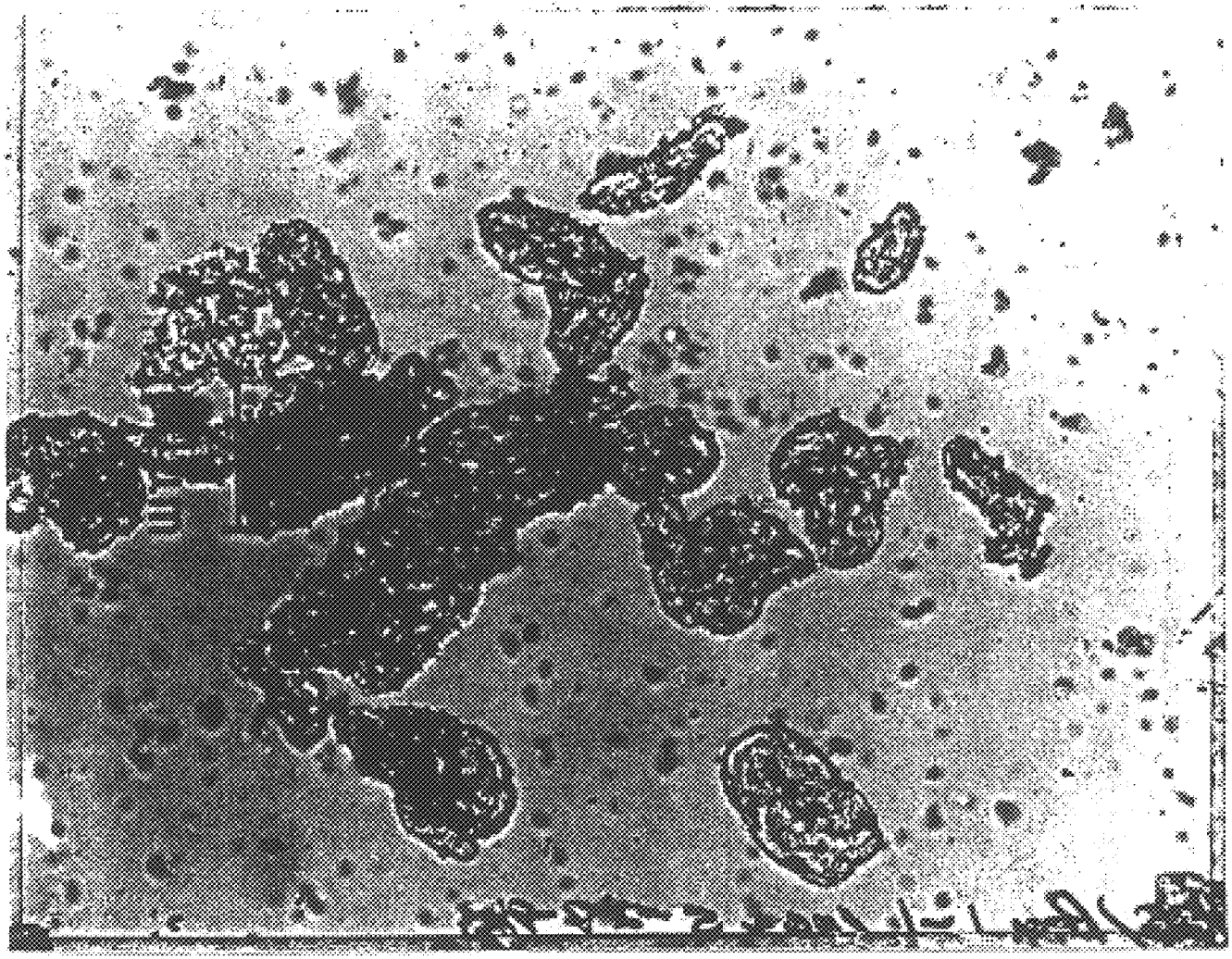
FIG. 40 is a photomicrograph of pea starch prior to processing according to the method of the present invention.
Figure 41:
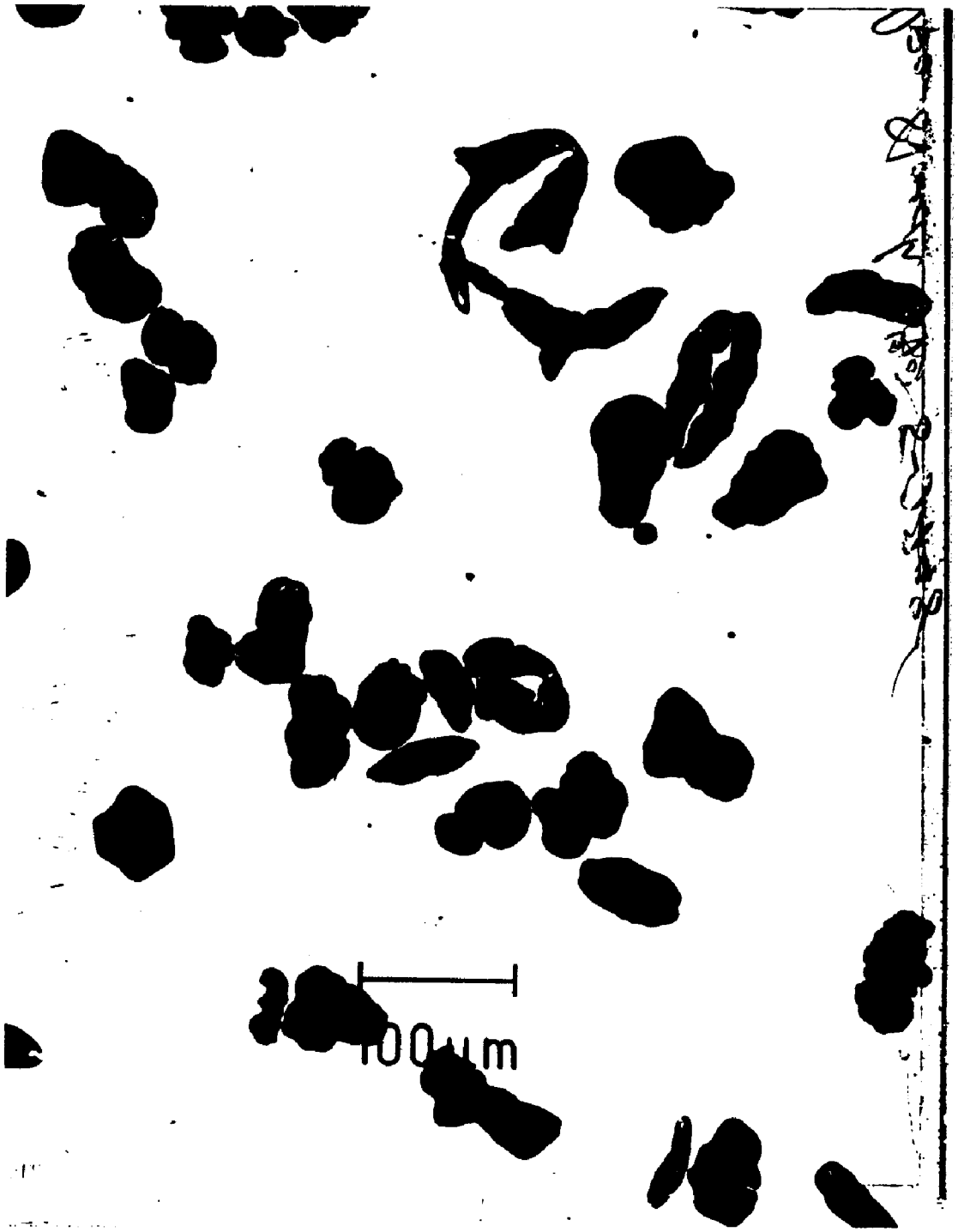
FIG. 41 is a photomicrograph of pea starch granules processed according to the present invention, the photomicrograph having a 100 $\mu$m size bar indicator.
Figure 42:
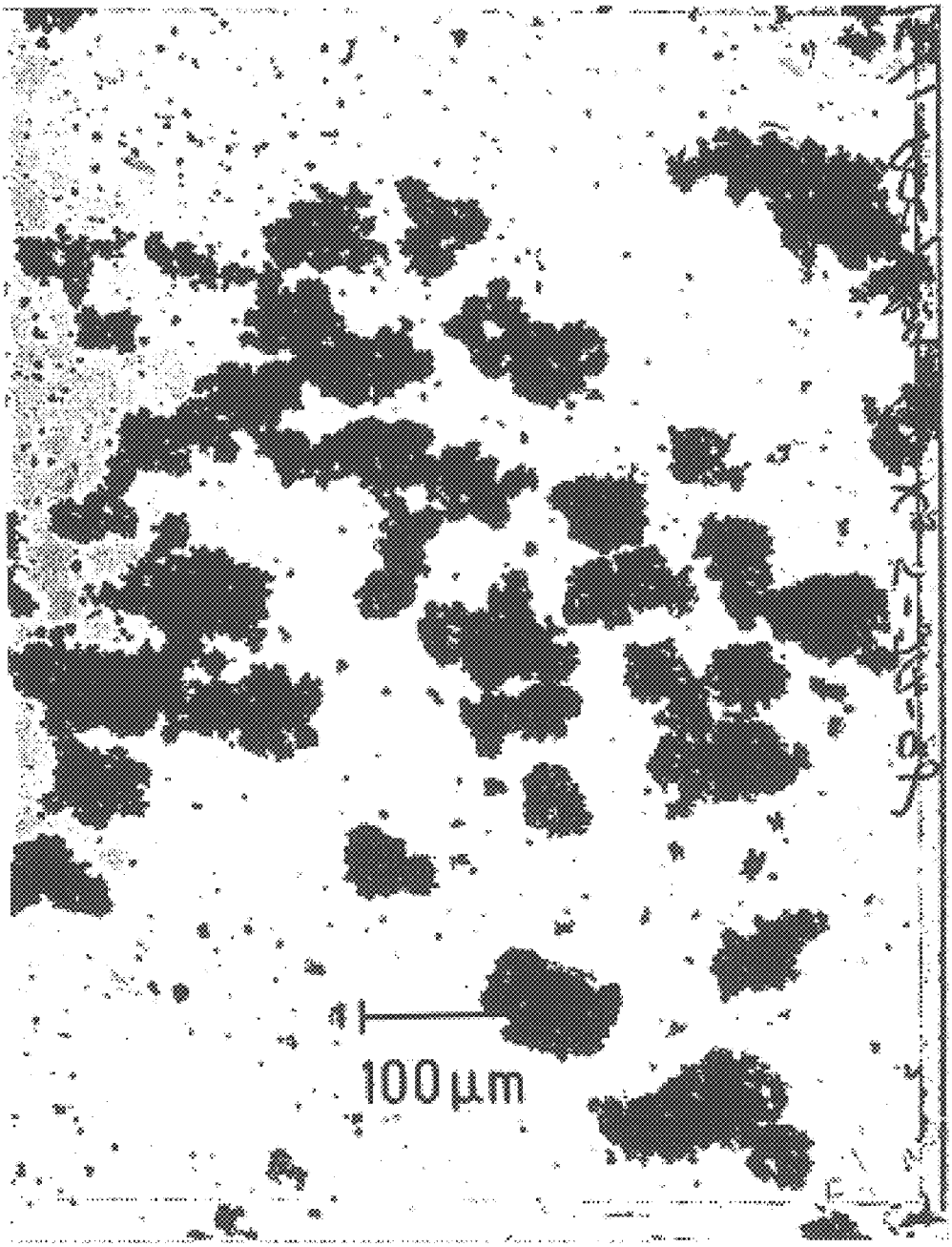
FIG. 42 is a photomicrograph of PCC filler particles flocculated to the pea starch granules following processing according to the present invention, the photomicrograph having a 100 $\mu$m size bar indicator.

The heating operation described above is typical of the heating process used to process pea starch. But, the heating process is best judged by the nature of the granules produced by the process. FIGS. 40 and 41 are photomicrographs of starch prior to processing as described above, and subsequent to heat processing, respectively. These photomicrographs clearly demonstrate the transformation that occurs with starch when it is heat processed in this manner, and further that the desired characteristics are swollen starch granules of a substantially uniform size.

2. Optional Starch Cationizing Step

A cationizing agent can now optionally be mixed with the starch. The purpose of adding the cationizing agent is to enhance the flocculating capability of the starch. Suitable cationizing agents include polyaluminum chloride (PAC), aluminum chlorohydrate, alum, cationic retention aids, acids, salts and mixtures thereof, with PAC being a currently preferred material.

The amount of the cationizing agent used depends on the nature of the agent selected. With respect to PAC, currently the upper practical limit is a 1:1 weight ratio of PAC and starch, and the lower practical limit appears to be about 1 weight percent PAC based on the weight of starch. Currently the preferred amount of cationizing agent is about 10% to about 20% weight percent with respect to the amount of starch added.

The starch:cationizing agent can be added to the dispersion in various way. Good results have been obtained by adding PAC with the water used to dilute the cooked starch.

3. Flocculating Filler Particles

Filler is then added to the cationized starch dispersion with vigorous agitation, or they can be pumped into a small vessel and mixed together, or pumped and mixed in a static mixer. Generally the filler is warm, such as a temperature of from about 45° C. to about 60° C. simply because it is used right after its production. But, heated filler also may facilitate the flocculation process. Moreover, cool filler would lower the temperature of the aqueous cationized starch dispersion. If the temperature of this dispersion is below about 50° C. the aqueous dispersion begins to gel quickly.

4. Adding Flocculated Filler to Cellulosic Furnish

Once flocculated as described above, the filler is then ready for combination with cellulosic furnish.. The flocculated filler is to the fiber system prior to the headbox, such as at the discharge pump or machine pump. The preflocculated material is added right into the pump because this provides good mixing with the cellulosic furnish.

5. Adding Filler Particles and Cooked Starch to Cellulosic Furnish

The cooked pea starch can be added to the cellulosic furnish comprising a filler dispersion and retained by retention aids. The filler particles will be flocculated and retained like those in the conventional wet-end process and will not be preferentially flocculated onto starch granules. By doing so, it may be possible to improve paper strength.

6. Retention Systems

All retention systems commonly used in the wet-end of the paper making process can be used in combination with the precess of the present starch flocculating method. Without limitation, a partial list of such retention aids includes cationic polymers, anionic polymers, alum, polyaluminum chloride, aluminum chlorohydrate, cationic particles, anionic particles, cationic or anionic microparticles, and mixtures thereof, particularly combinations of anionic and cationic materials.

D. Pilot Machine Results

Paper products have been made on paper machines on a pilot scale using the method of the present invention. Certain results from these trials are presented in FIGS. 8–12.

Figure 46:
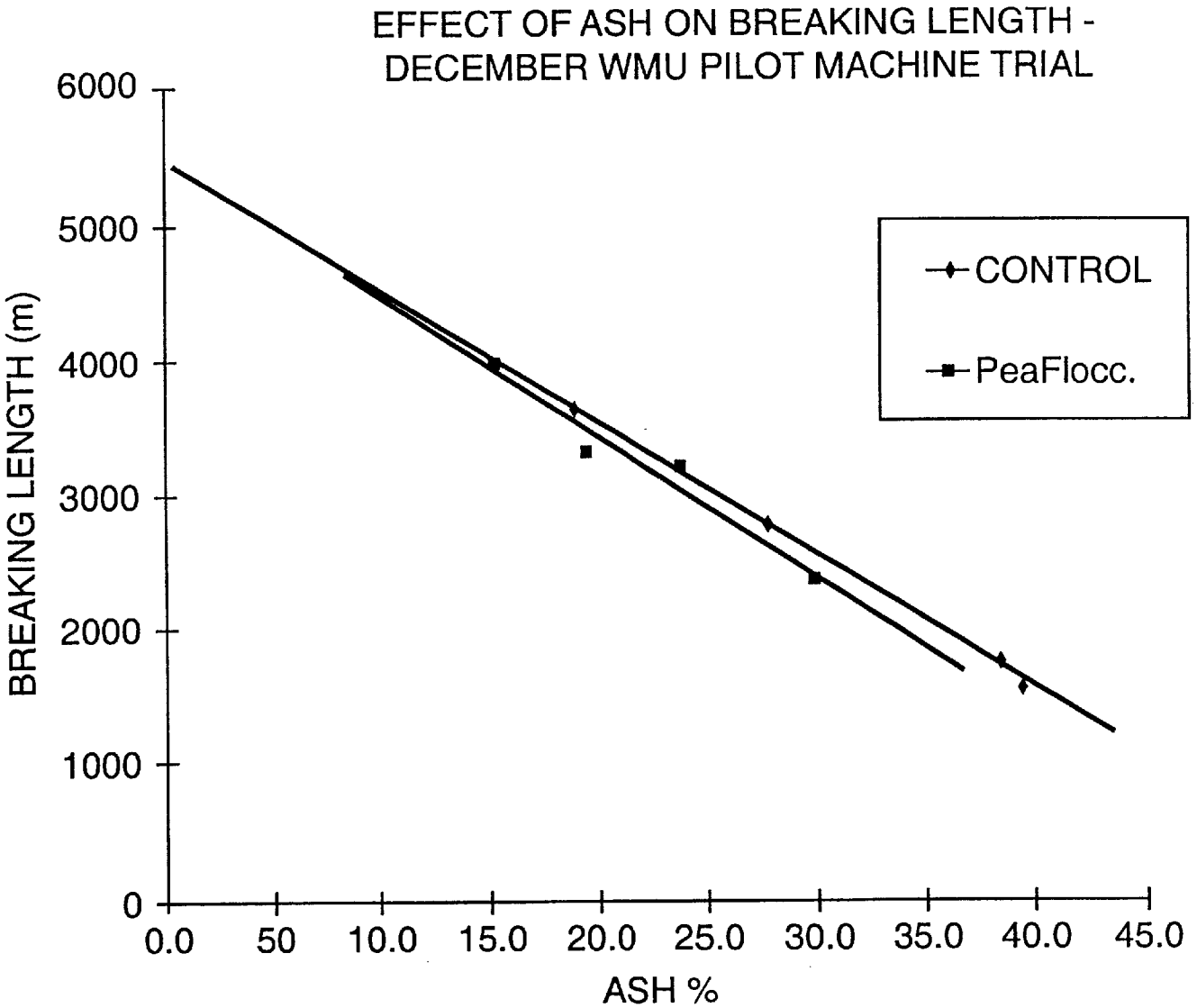
FIG. 46 illustrates how pilot machine breaking length varies for control paper and paper made according to the method of the present invention with increasing ash content.
Figure 47:
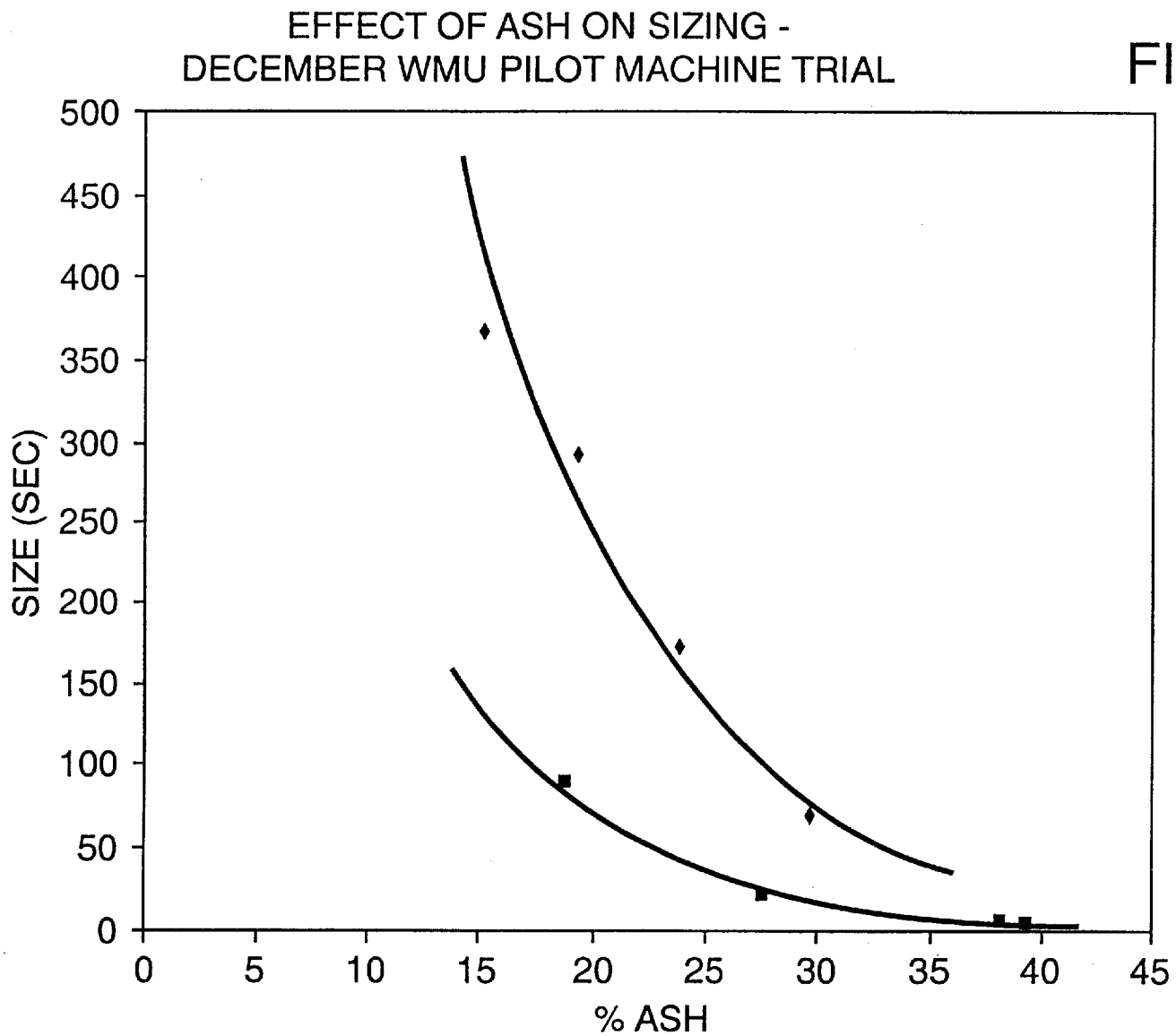
FIG. 47 illustrates how sizing varies for control paper and paper made according to the method of the present invention with increasing ash content.

FIG. 46 illustrates how pilot machine breaking length varies for control paper and paper made according to the method of the present invention with increasing ash content. Breaking length for paper made according to the present invention was comparable to that made with preflocculating filler particles with starch granules. Little or no strength improvement was noted for the paper made with preflocculated filler, probably for two reasons. First, the amount of cationic wet ends starch (16 pounds/ton) added in the control run significantly increased the paper strength and exceeds or equals the strength improvement made with the peas starch preflocculated PCC. Second, the enormous sizing increase, as shown in FIG. 47. With the preflocculated PCC ironically reduces the fiber fonding and results in reducing the paper strength.

FIG. 47 illustrates how sizing varies with increasing ash content for pilot machine control paper and pilot machine paper made according to the method of the present invention. Sizing is a measure of a paper's tendency to absorb or resist absorbing water, and is measured in terms of the time in seconds required for water to be absorbed. FIG. 47 illustrates that paper made on the pilot machine had significantly improved sizing relative to the control. At 20% ash content the control had a sizing of about 100 seconds, whereas paper made according to the process of the present invention had a sizing of about 300 seconds at 20% ash content. Moreover, the ash content of paper made according to the present invention was increased to 30% before its sizing was reduced to 100 seconds. The preflocculation filler reduces the absorption of sizing chemical to the filler particles and leave it to be absorbed onto filler surface, thus improve sizing efficiency.

Figure 48:
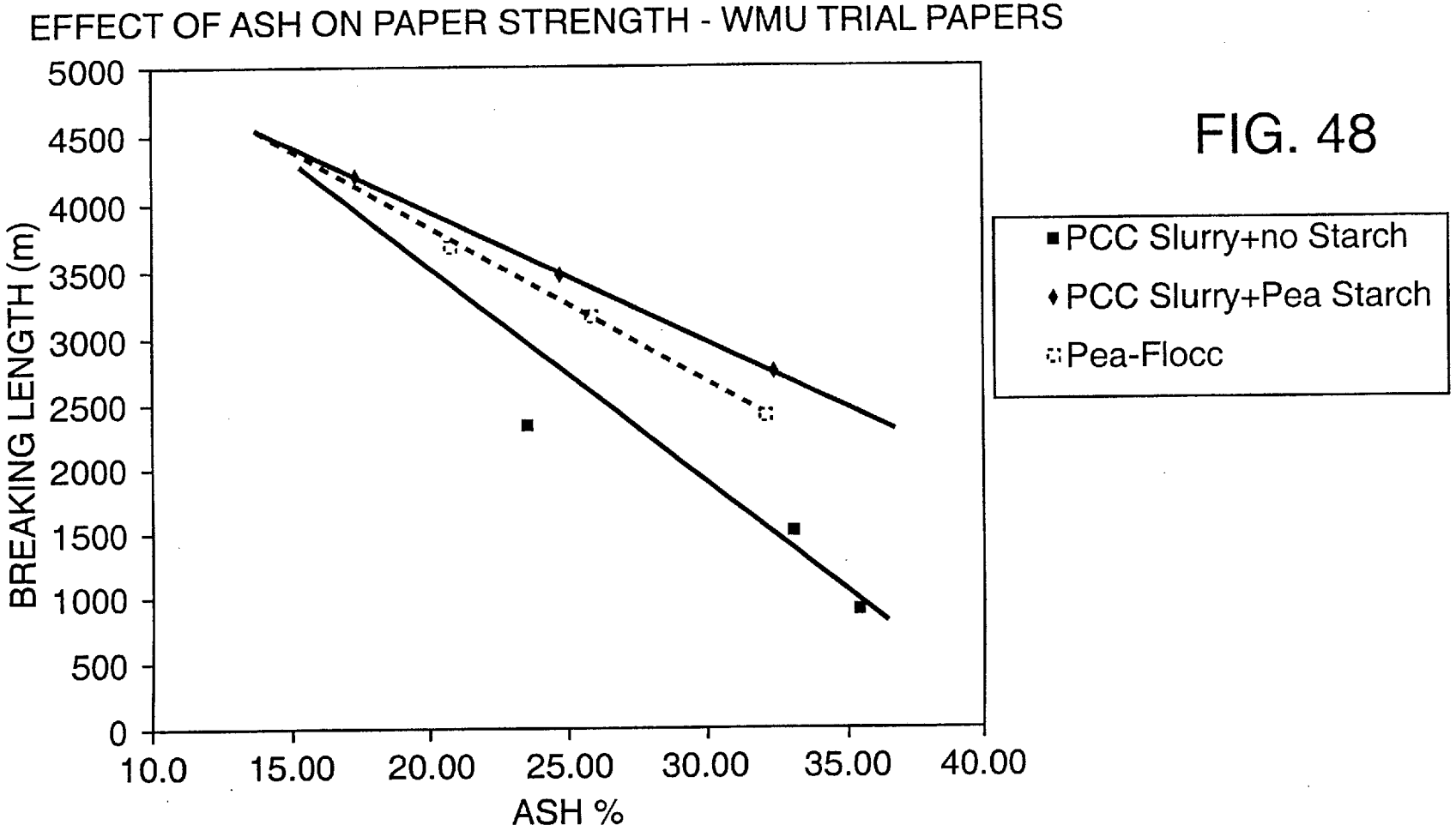
FIG. 48 illustrates how pilot machine breaking length varies for control papers and paper made according to the method of the present invention with increasing ash content.

FIG. 48 illustrates how paper strength varies with increasing ash content for pilot machine control paper and pilot machine paper made according to the method of the present invention. FIG. 48 clearly demonstrates that the method of the present invention substantially increases the strength of paper made without starch, and without preflocculating the filler particles. Moreover, with respect to a PCC slurry and pea starch used without preflocculating the filler particles, FIG. 48 shows the strength of the papers made with and without preflocculating PCC. All three groups of paper were made with 10 pounds/ton of starch 300 (cantonic starch), in the control runs not other starches were added, whereas in the runs denoted as PCC slurry and pea starch, various amounts of pea starch were added that would equeal the amount of pea starch employed for preflocculating PCC and added to the wet-end, e.g. if 15% of preflocculated PCC was added, the pea starch used for flocculating the PCC would equal to 17 pounds/ton of the total furnish, and 17 pounds/ton of pea starch would be added with 15% PCC slury into the furnish. In the preflocculated PCC runs, no additional pea starch was added, only the 10 pounds/ton of cationic wet-end starch.

Figure 49:
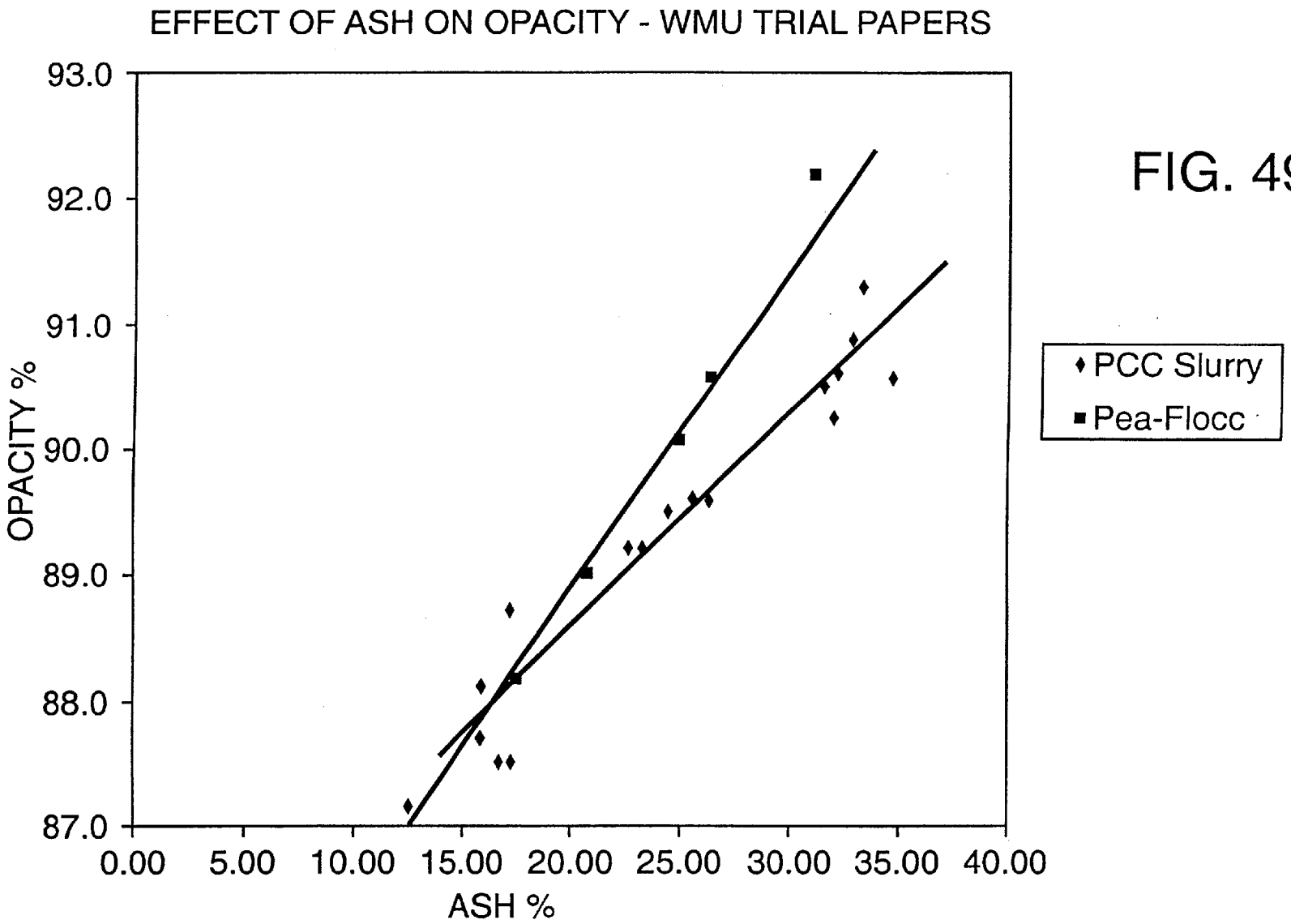
FIG. 49 illustrates how opacity varies for pilot machine control paper and pilot machine paper made according to the method of the present invention with increasing ash content.

FIG. 49 illustrates how opacity varies with increasing ash content for pilot machine control paper and pilot machine paper made according to the method of the present invention. FIG. 49 shows that the opacity of pilot machine paper made according to the present invention is generally greater than that of the control paper, and further that it is not affected by increasing ash content to the extent the control paper was. At 30% ash content, paper made according to the method of the present invention had an opacity of greater than 92%, whereas opacity for the control paper was less than 91%.

IV. EXAMPLES

The following examples are provided to illustrate certain features of the present invention. These examples should not be construed to limit the present invention to the particular features described.

Example 1

This example illustrates one embodiment of the present method for forming paper products, and demonstrates that the method produces a mineral network about the fibrous fraction of the composite product. Handsheets made according to this example, and the components thereof, are summarized below in Table 1.

Approximately 30 grams (oven dried basis) of a fiber slurry [80% refined aspen (hardwood) & 20% refined jack pine (softwood)] at 2.46% consistency were measured into a 2000 ml plastic container. The fiber slurry was stirred while the amounts of precipitated calcium carbonate (HB PCC from St. Helens 5 Mill) and/or calcium oxide (CaO—Technical powder MCB CX267 CB1175) as stated in Table 1 were added. Calcium oxide was added only to T6 and T9. Enough calcium oxide was added to give 22.3% PCC if completely reacted with the carbonic acid. After stirring for 5 minutes, the sodium silicate N solution (National Silicate Ltd. Toronto, Ont.—51.37% oven dried basis) was added to all the trial samples (none to the controls). The ratio of sodium silicate to PCC was kept constant except an additional amount of sodium silicate was added to T5. 1.4 weight percent calcium oxide also was added in T9.

The samples were carbonated by administering carbon dioxide to the mixture using a gas cylinder of carbon dioxide fitted with a gas diffusion tube. The carbon dioxide administration continued for about 1.5 hours, which provided a mixture pH value of from about 7 to about 8. The carbon dioxide delivery pressure was very low (about 1 psi) and the starting pH was relatively high at about 10 to 11 (EM Science colorpHast strips). The trial sample T6, having no PCC but calcium oxide, was carbonated for about 1 hour longer in order to reach the same pH values of from about 7 to about 8. The stock was diluted to 4 liters and stirred while 2% starch or alum was added. The cationic starch was a cationic potato starch, Hi-Cat 168 from Roquette Corp. Then 0.035% Percol 175 (retention aid) was added with stirring. The starch step was omitted with the first control—C1.

After the addition of all materials and the carbonation step was completed, the stirring was stopped and handsheets were made. All handsheets were formed on a Noble & Wood square handsheet mold, wet felt pressed at 20 psi and dried at 200° F. on a drum dryer. The target basis weight for handsheets made in accordance with this example was 60 g/m$^2$. The handsheets were conditioned according to TAPPI T222 and tested in the same environment. Tensile testing was performed on a 7.1 " strip with a crosshead speed of 1 inch/min. Tensile breaking properties of the composite products were determined according to TAPPI method T494. Caliper and tear testing were performed on 5 plies. ISO brightness was measured on a Technibrite Micro TB-1C and opacity with a Thwing-Albert Model 323 opacimeter. Opacity was corrected to a 60 g/m$^2$ basis weight using the Kubelka-Munk equations. Stretch and TEA were not corrected to basis weight. The constitution of each handsheet made for this first example is summarized below in Table 2, as are certain product properties (breaking length, stretch % and TEA in N.m/m$^2$).

TABLE 2

| Set | Handsheets | Basis Wt. g/m$^2$ | Ash % | Break. length (BL), km | Stretch % | TEA N · m/m$^2$ |
|---|---|---|---|---|---|---|
| C1 | Control - applied 23% PCC & Percol; no cationic starch or $Na_2SiO_3$. | 58.6 | 12.88 | 2.34 | 1.51 | 13.4 |
| C2 | Control - applied 23% PCC, Percol & cationic starch; no $Na_2SiO_3$. | 61.2 | 14.26 | 2.42 | 1.52 | 14.9 |
| T3 | Applied 22.3% PCC, Percol, cationic starch & 3.3% $Na_2SiO_3$. | 59.1 | 6.19 | 3.19 | 1.59 | 20.3 |
| T4 | Applied 21.8% PCC, Percol, cationic starch & 5.4% $Na_2SiO_3$. | 61.1 | 5.0 | 3.21 | 1.64 | 21.3 |
| T5 | Applied 31.7% PCC, Percol, cationic starch & 4.8% $Na_2SiO_3$. | 60.4 | 8.83 | 2.97 | 1.63 | 19.7 |
| T6 | Used Percol, cationic starch, & 3.3% $Na_2SiO_3$, applied no PCC, but CaO for 22.3% PCC. | 58.6 | 14.35 | 2.34 | 1.21 | 11.3 |
| T7 | Applied 22.3% PCC, Percol, pea starch, & 3.3% $Na_2SiO_3$. | 60.4 | 2.77 | 3.65 | 1.75 | 26.0 |
| T8 | Applied 22.3% PCC, Percol, alum, & 3.3% $Na_2SiO_3$. | 58.0 | 10.99 | 2.40 | 1.30 | 12.2 |
| T9 | Applied 22.3% PCC, Percol, Cationic starch, 3.1% $Na_2SiO_3$ and 1.4% CaO (1:1 molar). | 57.9 | 17.86 | 2.15 | 1.58 | 12.9 |

Figure 6:
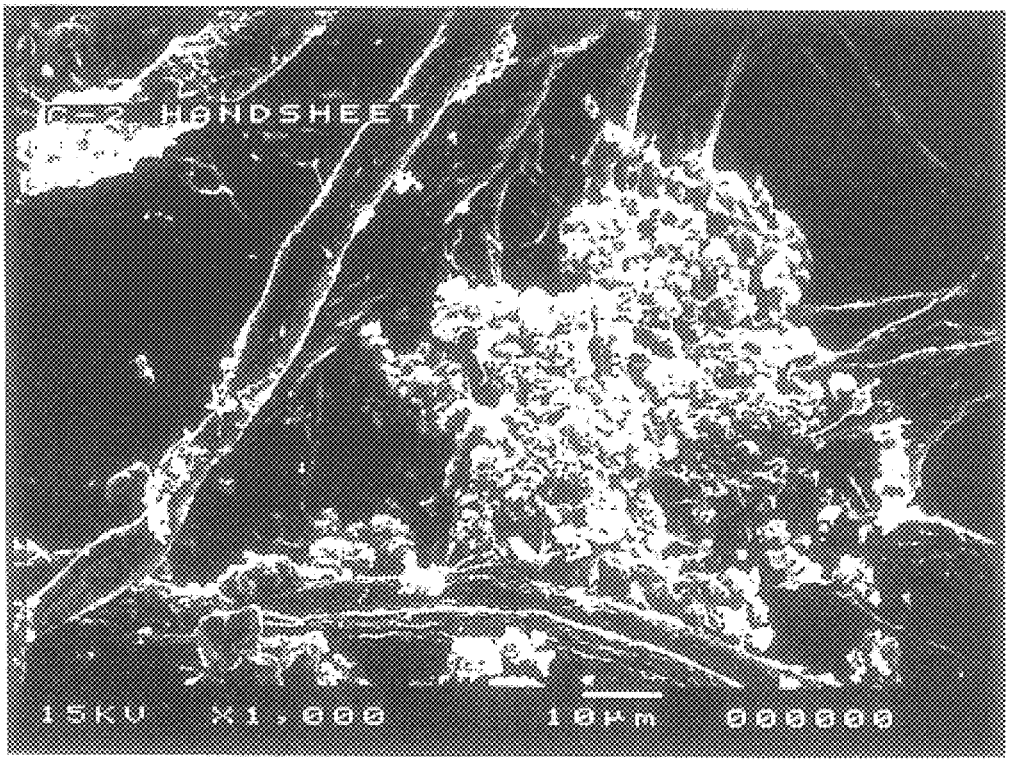
FIG. 6 is an SEM image (×1000) of a handsheet made having PCC according to a conventional method developed prior to the present invention.
Figure 9:
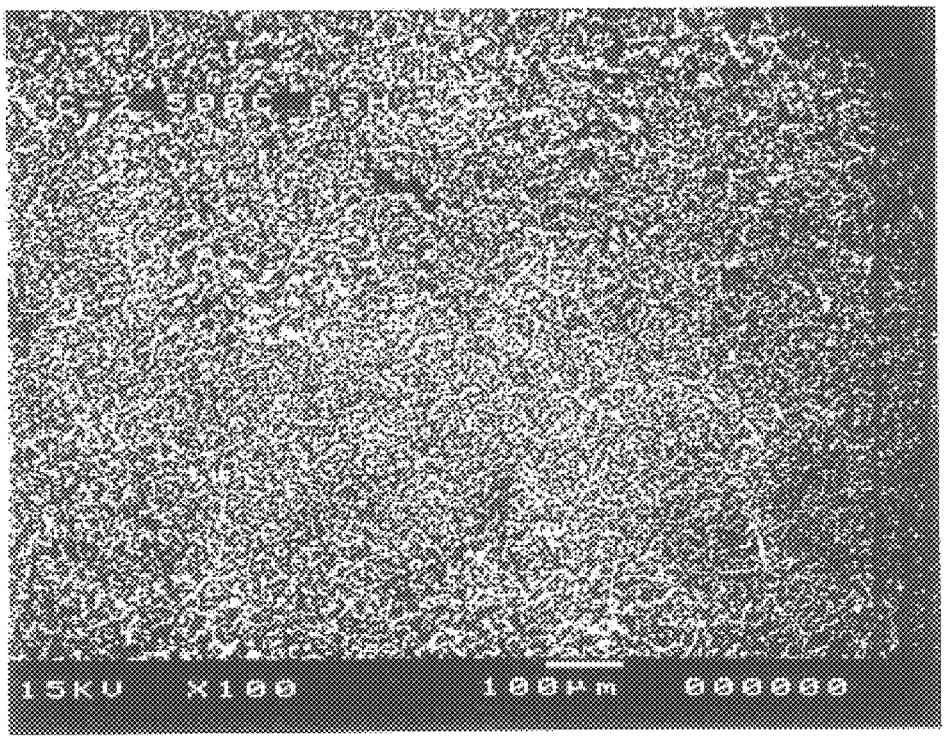
FIG. 9 is an SEM image (×100) of ash from a handsheet having PCC made according to a conventional method developed prior to the present invention.
Figure 10:
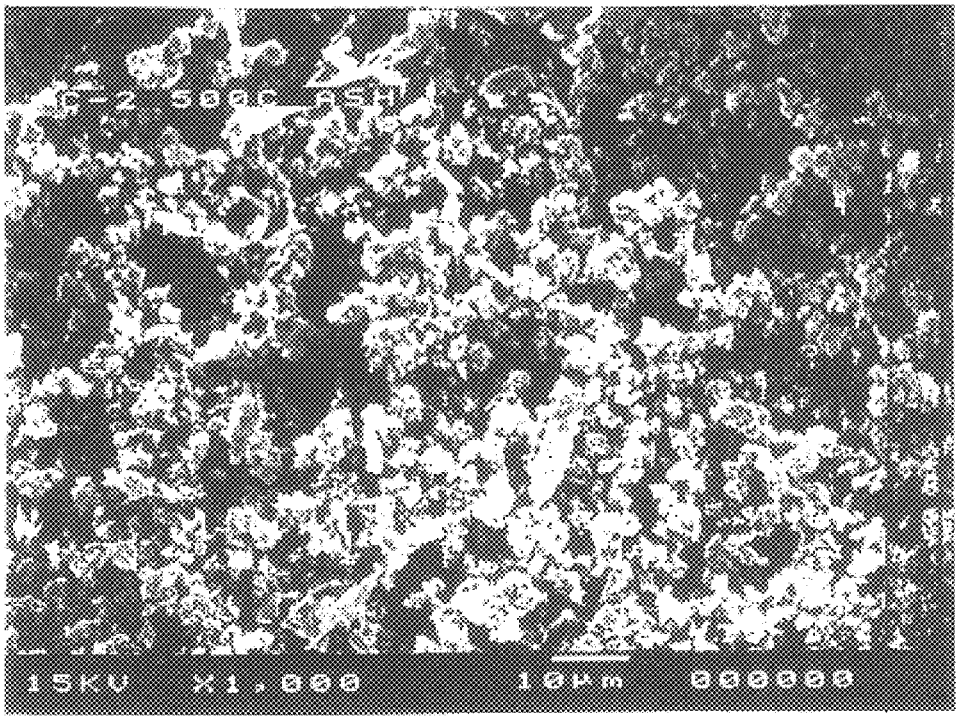
FIG. 10 is an SEM image (×1000) of ash from a handsheet made having PCC according to a conventional method developed prior to the present invention.

Filler retention was entirely satisfactory with most of the trials illustrated by this example, but the addition of a small amount of calcium oxide gave the best (80% of PCC) retention. Furthermore, with this particular example, no dramatic increases in strength were observed. However, SEM analysis of the ash produced by combusting handsheets made in accordance with trial T6 shows that such ash retained the composite structure, which is quite surprising and in direct contrast to the control samples (FIG. 6). This is indicative of filler bonding in the production of a mineral network about the fibrous material. More specifically, 7 [an SEM image (×100) of handsheet ash from handsheets made according to trial T6] and FIG. 4 [an SEM image (×1,000) of handsheet made according to trial T6] clearly demonstrate that the mineral network is formed. Moreover, the distinction between the composite products of the present invention and products made by prior methods also is clearly demonstrated by comparing FIGS. 6 and 7 to control FIG. 9 [an SEM image (×100) of handsheet ash from a control handsheet] and control FIG. 10 [an SEM image (×1,000) of handsheet ash from a control handsheet]. FIGS. 9 and 10 show the friable, particulate nature of ash produced from conventionally made paper products, whereas the ash from composite product T6 clearly retains the mineral structure even after combustion.

Example 2

This example illustrates one embodiment of a method for forming paper products in accordance with the method of the present invention, and further demonstrates that an increase in product strength can be achieved using relatively high filler concentrations. Handsheets made according to this example, and the components thereof, are summarized below in Table 2.

Approximately 30 grams (oven dried basis) of a fiber slurry [80% refined aspen (hardwood) & 20% refined jack pine (softwood)] at 3.02% consistency were measured into a 2000 ml plastic container. The fiber slurry was stirred while the amounts of precipitated calcium carbonate (HB PCC from St. Helens) and/or calcium oxide (CaO—E.M. Science GR powder CX0265-3 lot #35222539) stated in Table 3 were added. Enough calcium oxide was added to give the stated amount of PCC if it completely reacted with the carbonic acid. After stirring for 5 minutes, a sodium silicate solution (sodium silicate N solution, National Silicate Ltd. Toronto, Ont.—51.37% oven dried basis) was added to all the trial samples (none to the controls).

The samples were carbonated by administering carbon dioxide to the mixture using a $CO_2$ gas cylinder fitted with a gas diffusion tube. The carbon dioxide administration continued for about 2.0 hours. Carbonation time is best established by pH values, as the carbonation step lowers the pH. It has been found that a final target mixture pH of from about 7 to about 8 is satisfactory. The carbon dioxide delivery pressure was very low (about 1 psi) and the starting pH was relatively high at about 10 to 11 (EM Science colorpHast strips).

The stock mixtures were then diluted to 4 liters and stirred while 2% starch was added. The starch was a cationic potato starch, Hi-Cat 168 from Roquette Corp. 0.035% Percol 175 (a retention aid) then was added to the mixture with stirring. The starch step was omitted with the first control—C10.

After the addition of all materials and the carbonation step was completed, the stirring was stopped and handsheets were made. All handsheets were formed on a Noble & Wood square handsheet mold, wet felt pressed at 20 psi and dried at 200° F. on a drum dryer. The target basis weight for handsheets made in accordance with this example was 60 g/m$^2$. The handsheets were conditioned according to TAPPI T222 and tested in the same environment. Tensile testing was performed on a 7.1" strip with a crosshead speed of 1 inch/min according to TAPPI T494. ISO brightness was measured on a Technibrite Micro TB-1C and opacity with a Thwing-Albert Model 323 opacimeter. Opacity was corrected to a 60 g/m$^2$ basis weight using the Kubelka-Munk equations. Stretch and TEA were not corrected to basis weight. The constitution of each handsheet made for this second example is summarized below in Table 3. All percents stated in Table 3 are weight percents based on the oven dried solids of the stock.

TABLE 3

| Set | Handsheets | Basis Wt. g/m$^2$ | Ash % | Break. length (BL), km | BL Stand. dev. | Stretch % | TEA N · m/m$^2$ |
|---|---|---|---|---|---|---|---|
| C10 | Control - applied 46% PCC & Percol; no cationic starch or $Na_2SiO_3$. | 58.12 | 30.00 | 1.07 | 0.06 | 1.12 | 4.4 |
| C11 | Control - applied 46% PCC, Percol & cationic starch; no $Na_2SiO_3$. | 60.00 | 33.50 | 1.28 | 0.18 | 1.44 | 6.8 |
| T12 | Applied CaO for 43% PCC, Percol, cationic starch & 6.4% $Na_2SiO_3$. | 55.48 | 31.40 | 1.64 | 0.10 | 1.00 | 5.8 |
| T13 | Applied CaO for 40% PCC, Percol, cationic starch & 12.1% $Na_2SiO_3$. | 58.03 | 33.50 | 1.98 | 0.09 | 1.43 | 10.9 |
| T14 | Applied 21.5% PCC, CaO for 21.5% PCC, Percol, cationic starch & 6.5% $Na_2SiO_3$. | 58.82 | 35.22 | 1.55 | 0.09 | 1.47 | 8.8 |
| T15 | Applied 21.5% PCC, CaO for 21.5% PCC, & 6.5% $Na_2SiO_3$, but no fiber during $CO_2$. | 64.04 | 40.71 | 1.31 | 0.11 | 1.55 | 8.4 |
| T16 | Applied CaO for 21.5% PCC & 6.5% $Na_2SiO_3$ to fiber during $CO_2$; then 21.5% PCC. | 58.92 | 31.62 | 1.64 | 0.12 | 1.26 | 8.0 |
| T17 | Applied CaO for 44% PCC, Percol, Cationic starch & 3.4% $Na_2SiO_3$. | 61.52 | 35.20 | 1.36 | 0.09 | 0.92 | 5.1 |

In contrast to the expected results, handsheets made in accordance with Example 2 exhibit a strength increase with respect to the control sheets at the same ash level. Most interesting is the T13 trial. Handsheets made having the characteristics listed for T13 in Table 3 exhibited the most dramatic increase in strength. T13 also has the highest silicate amounts, which demonstrates that the formation of the mineral network about the fibrous web imparts strength to the end-product.

The trend to higher strength values is shown by comparing T12, T13 and T17. Trials T17 (3.4% sodium silicate; breaking length=1.36), T12 (6.4% silicate; breaking length= 1.64 km) and T13 (12.1% silicate; breaking length 1.98 km) establish that an increase in paper strength results from forming silica/silicate networks about the fibrous web with increasing silicate levels. By increasing the silicate concentration from 0 percent in the control with starch, C11, to 3.4% for T17, 6.4% with T12 and 12.1% with T13, the breaking length increased from 1.28 km (C11), to 1.36 km for T17, to 1.64 km for T12 and up to 1.98km for T13.

Trials T14, T15 and T16 were made using the same components in the same amounts. Each of these trials added precipitated calcium carbonate in addition to the calcium oxide and sodium silicate, but the order of addition of such components differs. For the T14 trial, all the components were carbonated together. For the T15 trial, everything but the fiber was carbonated together. For the T16 trial, everything but the PCC was carbonated together. Based on the results of these trials, it currently appears that carbonating everything but the PCC together, or carbonating everything together, are the best methods for forming products in accordance with the present invention. Moreover, the fact that fiber should be present during the carbonation step further indicates that the formation of the mineral network about the fiber contributes to the strength enhancement observed in such trials.

Figure 16:
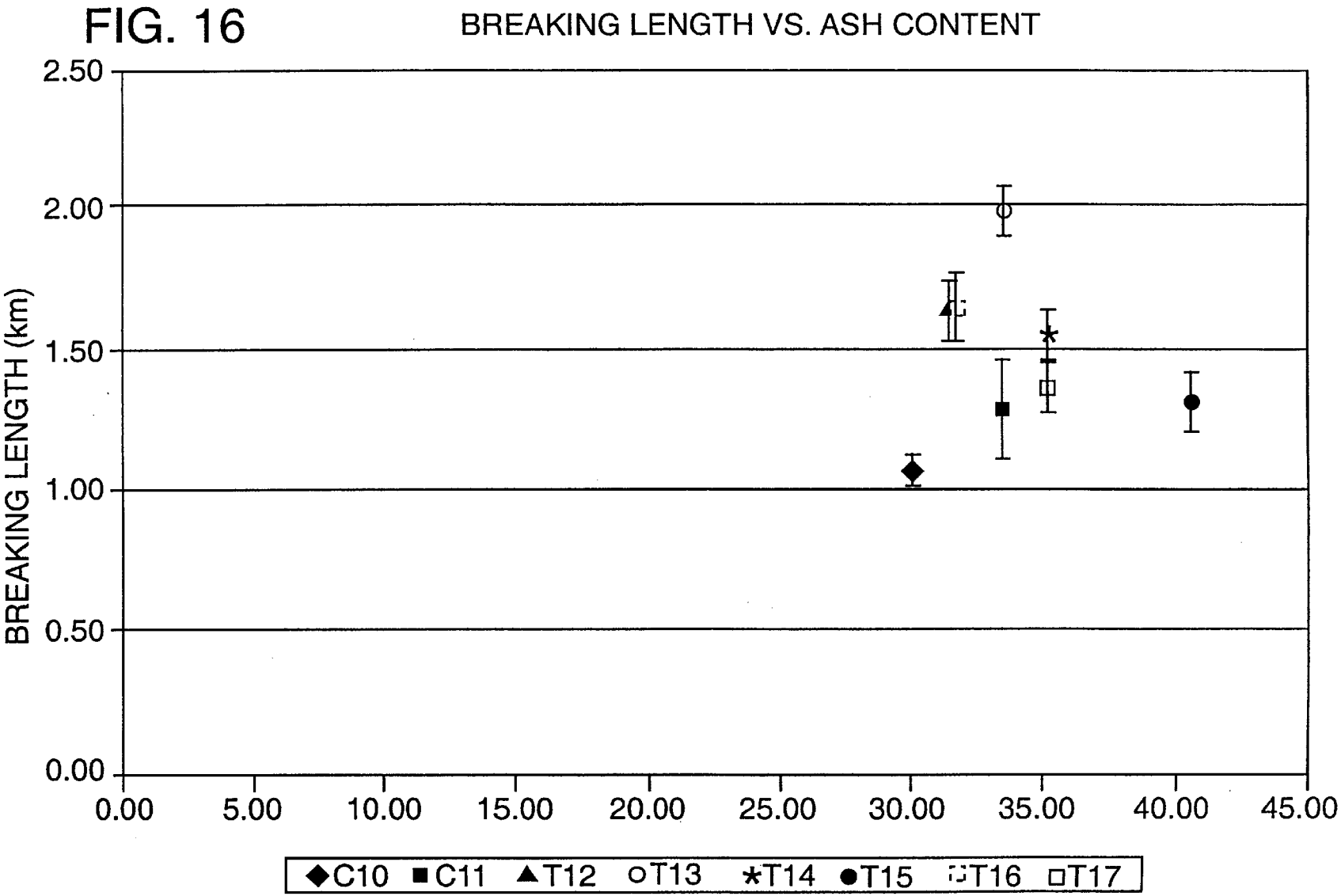
FIG. 16 is a graph of the ash content versus breaking length for controls and composite products made in accordance with the present invention.

FIG. 16 is a graph of the ash content versus breaking length of handsheets made according to this Example 2.

FIG. 16 illustrates that composite products made according to the present invention generally have breaking lengths equal to or greater than controls made having similar ash contents.

Example 3

This example illustrates forming aluminosilicate mineral networks about the fibrous materials. The method involves using a combination of calcium oxide, sodium silicate, PCC and aluminum sulfate in addition to cellulosic material. Handsheets made according to this example, and the components thereof, are summarized below in Table 3. All percentages stated in Table 3 are weight percents based on oven dried solids of the composite.

Approximately 30 grams (oven dried basis) of a fiber slurry [80% refined aspen (hardwood) & 20% refined jack pine (softwood)] at 3.02% consistency were measured into a 2000 ml plastic container. The fiber slurry was stirred while the amounts of precipitated calcium carbonate (HB PCC from ECC), calcium oxide (CaO—E.M. Science GR powder CX0265-3 lot #35222539), sodium silicate N solution (National Silicate Limited, Toronto—44.26% oven dried basis), aluminum sulfate hydrate (E. M. Science AX0745-2), cationic potato starch (Hi-Cat 168 from Roquette Corp., Batch No. E2845) and Percol 175 (retention aid from Allied Colloids Inc., Batch No. 2266A) stated in Table 3 were added.

In trial A4RD, the aluminum sulfate and the fiber were combined together. After stirring for 15 minutes, the sodium silicate was added. Calcium oxide and PCC were stirred together for 15 minutes before they were added to the fiber, alum and sodium silicate.

In trials C-1P and C4PD, the alum and the fiber were combined together. After stirring for 15 minutes the calcium oxide and PCC (which also were stirred together for 15 minutes) were added to the alum and fiber. The sodium silicate was added to the mixture comprising fiber, alum, PCC and calcium oxide.

In trials C4R and C4RD, the alum and the fiber were combined together. After stirring for 15 minutes, the calcium oxide (dispersed in water) was added to the alum and fiber. Then the sodium silicate and PCC (which were stirred together for 15 minutes) were added to the fiber.

In trials S-8R and S-8RD, sodium silicate and fiber were combined together. After stirring for 15 minutes the calcium oxide and PCC (which also were stirred together for 15 minutes) were added to the sodium silicate and fiber. Aluminum sulfate was then added to the mixture comprising fiber, sodium silicate, PCC and calcium oxide.

After all the components were added as indicated above, the stock was diluted to 4 liters and stirred while 2% starch was added. 0.035% Percol 175 then was added with stirring. Stirring was discontinued after 2 minutes and handsheets were made. Controls were made similarly, but no alum, sodium silicate or calcium oxide was used. All handsheets were formed on a Noble & Wood square handsheet mold, wet felt pressed at 20 psi and dried at 200° F on a drum dryer. The target basis weight for handsheets made in accordance with this example was 60 g/m$^2$. The handsheets were conditioned according to TAPPI T222 and tested in the same environment. Tensile testing was performed according to TAPPI method T494 on a 7.1" strip with a crosshead speed of 1 inch/min. ISO brightness was measured on a Technibrite Micro TB-1C and opacity with a Thwing-Albert Model 323 opacimeter. Opacity was corrected to a 60 g/m$^2$ basis weight using the Kubelka-Munk equations. Stretch and TEA were not corrected to basis weight. The constitution of each handsheet made for this first example is summarized below in Table 4.

TABLE 4

| | | Basis | | Breaking Length | | | |
|---|---|---|---|---|---|---|---|
| Set | Attempt. Conds. | Wt. g/m$^2$ | Ash % | km | Std. Dev. km | Stretch % | TEA N · m/m$^2$ |
| A-4RD | Combined fiber and 7.9% alum with 2.6% $Na_2SiO_3$; then added 2.6% CaO & 40% PCC. | 60.84 | 31.97 | 1.38 | 0.10 | 1.38 | 7.8 |
| C-1P | Combined fiber and 42% alum with 1.4% CaO & 42% PCC; then added 3.0% $Na_2SiO_3$. | 59.58 | 35.95 | 1.30 | 0.06 | 1.32 | 6.8 |
| S-8R | Combined fiber and 3.0% $Na_2SiO_3$ with 0.7% CaO & 43% PCC; then added 2.1% alum. | 62.92 | 36.14 | 1.51 | 0.12 | 1.43 | 9.2 |
| S-8RD | Combined fiber and 5.8% $Na_2SiO_3$ with 1.3% CaO & 41% PCC; then added 4.0% alum. | 61.71 | 34.56 | 1.53 | 0.05 | 1.56 | 9.6 |
| C-4PD | Combined fiber and 7.9% alum with 2.6% CaO & 40% PCC; then added 2.8% $Na_2SiO_3$. | 59.40 | 33.18 | 1.40 | 0.12 | 1.44 | 7.8 |
| C-4R | Combined fiber and 4.2% alum with 1.4% CaO; then added 1.5% $Na_2SiO_3$ & 43% PCC. | 61.28 | 33.42 | 1.49 | 0.09 | 1.44 | 8.8 |
| C-4RD | Combined fiber and 7.9% alum with 2.6% CaO; then added 2.8% $Na_2SiO_3$ & 40% PCC. | 59.67 | 32.24 | 1.35 | 0.03 | 1.42 | 7.6 |
| C-C | Control-Applied 30% PCC, Percol, & cationic starch; no sodium silicate, CaO, or alum. | 59.37 | 20.46 | 2.12 | 0.11 | 1.84 | 14.7 |
| C-S | Control-Applied 38% PCC, Percol, & cationic starch; no sodium silicate, CaO, or alum. | 59.70 | 27.38 | 1.58 | 0.07 | 1.51 | 8.9 |

Figure 17:
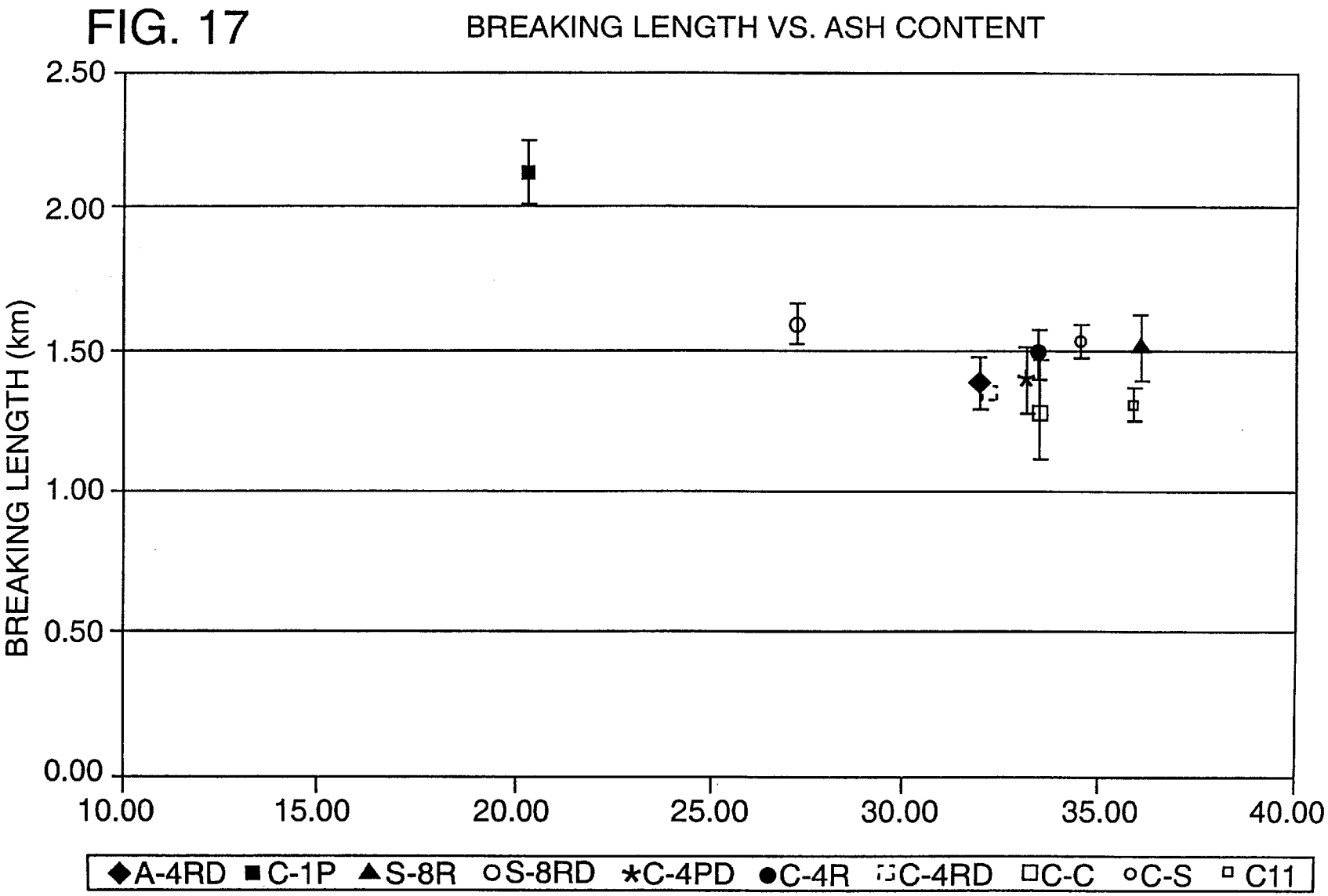
FIG. 17 is a graph of the ash content versus breaking length for controls and composite products made in accordance with the present invention.

This Example 3 demonstrates that composite products can be made in accordance with the present invention having aluminosilicate mineral networks. FIG. 17, a graph of ash content versus breaking length, further demonstrates that such composite products have generally increased strength properties with respect to products made using prior methods at equivalent ash contents.

Example 4

This example further considers the formation of composite products using methods similar to that described in Examples 1–2. Handsheets made according to this example, and the components thereof, are summarized below in Table 4.

Approximately 30 grams (oven dried basis) of a fiber slurry [80% refined aspen (hardwood) & 20% refined jack pine (softwood)] at 3.48% consistency were measured into a 2000 ml plastic container. The conditions stated in Table 4 were then used to make the handsheets. The materials used to make the composite products of Table 4 included precipitated calcium carbonate (HB PCC from St. Helens mill), calcium oxide (CaO—E.M. Science GR powder CX0265-3 lot #35222539), sodium silicate N solution (from The PQ Corp., Valley Forge, PA; 42.06% oven dried basis), cationic potato starch (Hi-Cat 168 from Roquette Corp., Batch #E2845), and Percol 175 (cationic retention aid from Allied Colloids Inc., Batch #2266A).

All handsheets of this Example 4 use 2% starch. In trials T-18 and T-19, calcium oxide and sodium silicate were carbonated together without fiber. The carbonation was carried out with stirring and with a low $CO_2$ delivery pressure of about 1 psi through a gas diffusion tube. The starting pH was about 13 (EM Science colorpHast indicator strips), and the samples were carbonated for about 2.5 hours until the pH was about 7. Carbonated samples T-18 and T-19 were stored at room temperature and combined with fiber on the next day to make handsheets. In trial T-19, PCC was added to the fiber slurry prior to the addition of the carbonated filler. The stock was diluted to 4.5 liters and stirred while 2% starch was added. After stirring for 2 minutes, 0.035% Percol 175 was added to the stock. The stirring was stopped 2 minutes after the addition of Percol 275 and the handsheets were made. The same procedure for adding starch and Percol was used for the following handsheets.

In trials T-20 and T-21, calcium oxide and sodium silicate were carbonated with fiber until the pH decreased from about 12 to about 7. The carbonation time was about 2 hours for T-20 and about 1 hour for T-21. The amounts of calcium oxide and sodium silicate for T-20 were the same as those used previously for making T13, but the lag time between carbonation and handsheet making was different (1 hour for T-20 versus 20 hours for T13). Handsheets of T-21 were made about 3.5 hours after the carbonation. PCC, calcium oxide, and sodium silicate were carbonated together without fiber until the pH was decreased from about 13 to about 7 in trials T-22, T-23 and T-24. The carbonation time was about 1.5 hours. The carbonated samples were stored at room temperature. The amounts of PCC, calcium oxide and sodium silicate for T-22 were the same as those used previously for T15, but the lag time between carbonation and handsheet making was different (5 hours for T-22 versus 22 hours for T15).

All handsheets for this Example 4 were formed on a Noble & Wood square handsheet mold, wet felt pressed at 20 psi and dried at 200° F. on a drum dryer. The target basis weight for handsheets made in accordance with this example was 60 g/m$^2$. The handsheets were conditioned according to TAPPI T222 and tested in the same environment. Tensile testing was performed according to TAPPI method T494 on a 7.1' strip with a crosshead speed of 1 inch/min. ISO brightness was measured on a Technibrite Micro TB-1C and opacity with a Thwing-Albert Model 323 opacimeter. Stretch and TEA were not corrected to basis weight.

TABLE 5

| | | Basis | | Breaking Length | | | |
|---|---|---|---|---|---|---|---|
| Set | Attempt. Conds. | Wt. g/m$^2$ | Ash % | km | Std. Dev. km | Stretch % | TEA N · m/m$^2$ |
| C-12 | Control - applied 11.9% PCC, Percol and cationic starch; no $Na_2SiO_3$. | 61.10 | 8.6 | 3.10 | 0.11 | 2.05 | 26.3 |
| T18 | Applied CaO for 40.4% PCC, & 12.1% $Na_2SiO_3$, but no fiber during $CO_2$. | 59.68 | 37.7 | 1.36 | 0.10 | 1.51 | 8.4 |
| T19 | Applied CaO for 20.2% PCC, & 12.1% $Na_2SiO_3$, but no fiber during $CO_2$; then 20.2% PCC. | 60.50 | 38.1 | 1.35 | 0.06 | 1.58 | 8.6 |
| T20 | Applied CaO for 40.4% PCC & 12.1% $Na_2SiO_3$ to fiber during $CO_2$. | 60.24 | 27.6 | 1.88 | 0.12 | 1.13 | 8.8 |
| T21 | Applied CaO for 21.6% PCC, & 6.5% $Na_2SiO_3$ to fiber during $CO_2$. | 60.21 | 15.4 | 2.64 | 0.13 | 1.63 | 18.4 |
| T22 | Applied 21.5% PCC, CaO for 21.5% PCC, & 6.4% $Na_2SiO_3$, but no fiber during $CO_2$. | 61.76 | 35.7 | 1.48 | 0.06 | 1.49 | 9.3 |
| T23 | Applied 20.2% PCC, CaO for 20.2% PCC, & 12.1% $Na_2SiO_3$, but no fiber during $CO_2$. | 60.43 | 37.6 | 1.24 | 0.06 | 1.40 | 7.3 |
| T24 | Applied 10.8% PCC, CaO for 10.8% PCC, & 6.5% $Na_2SiO_3$, but no fiber during $CO_2$. | 60.30 | 20.6 | 2.34 | 0.16 | 1.63 | 15.8 |

Figure 18:
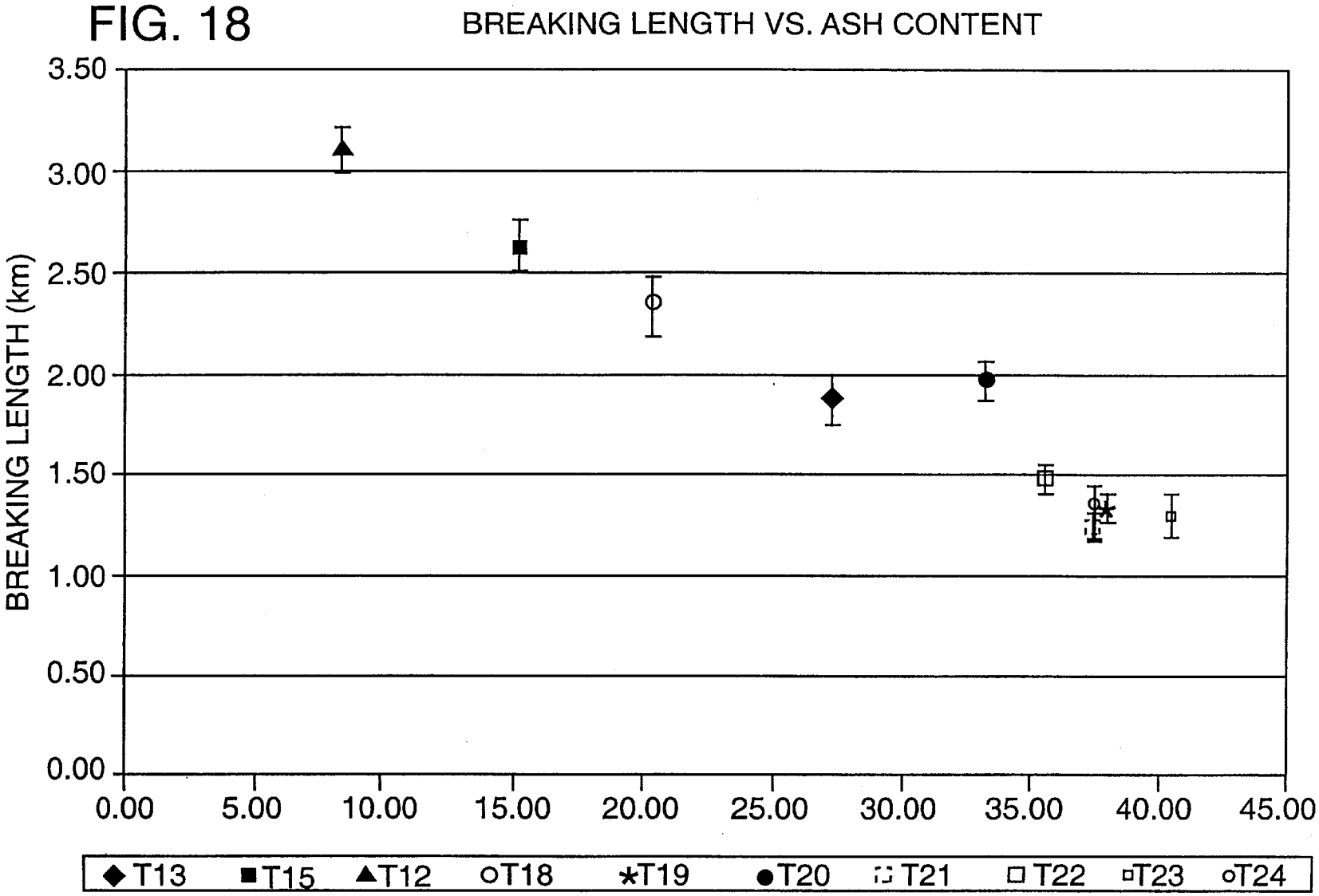
FIG. 18 is a graph of the ash content versus breaking length for controls and composite products made in accordance with the present invention.

The results for this Example 4 and as illustrated in Table 5 demonstrate that all of the trial samples had increased strength (i.e., breaking length) compared to the control handsheets. FIG. 18, a graph of ash content versus breaking length, also demonstrates this result. However, it also should be noted that the preferred approach appears to be forming the mineral network in the presence of the fiber. For example, a comparison of T18 and T20 illustrates an increase in breaking length from 1.36 km for T18, no fiber present during the carbonation step, to about 1.88 km for T20, where fiber was present during the carbonation step.

The trial T20 was an attempt to duplicate the results of T13. Interestingly, handsheets of T20 had both a lower ash content (27.6% versus 33.5%) and a lower tensile strength (1.88 km versus 1.98 km) compared to T13. One primary difference between trial T13 and T20 is the cure time, i.e., the amount of time allowed for the formation of the mineral network. The cure time for T13 was about 20 hours as compared to only about 1 hour for T20. Thus, it appears that greater strength enhancement results by increasing the cure time, at least until the formation of the mineral network is substantially complete.

The results of this Example 4 further demonstrate that commercially available PCC does not have to be present during the formation of the mineral network, and hence does not need to be present during the carbonation (or acidification) process of calcium oxide and sodium silicate.

Example 5

This example further considers the formation of composite products, and further investigates the effects of cure time, cure temperature, the percent of fiber present (0, 10 and 100%) during the carbonation step, and the amount of commercially obtained PCC added (0 and 50%). The sodium silicate concentration was held constant at 12.1%, starch at 2% and Percol retention aid at 0.035%. Handsheets made according to this example, and the components thereof, are summarized below in Table 5.

Approximately 30 grams (oven dried basis) of a fiber slurry [80% refined aspen (hardwood) & 20% refined jack pine (softwood)] at 2.99% consistency were measured into a 2000 ml plastic container. The conditions stated in Table 5 were then used to make the handsheets. The materials used to make the composites products of Table 5 included precipitated calcium carbonate (HB PCC from St. Helens mill), calcium oxide (CaO—E.M. Science GR powder CX0265-3 lot #35222539), sodium silicate N solution (from The PQ Corp., Valley Forge, Pa.; 42.06% oven dried basis), cationic potato starch (Hi-Cat 168 from Roquette Corp., Batch #E2845), and Percol 175 (cationic retention aid from Allied Colloids Inc., Batch #2266A).

In trials T-25, T-26, T-27 and T-28, calcium oxide and sodium silicate were carbonated in the presence of 100% of the fiber used to form the composite product until the pH decreased from about 12 to about 7. The carbonation was carried out with stirring and with a low delivery $CO_2$ pressure of about 1 psi using a gas diffusion tube. The carbonated samples were stored at 39° F. for about 20 hours (T-25 and T-27) to about 42 hours (T-26) prior to making handsheets. The carbonated sample of T-28 was stored at about 70° F. for about 20 hours before making handsheets.

In trials T-25 and T-26, all of the PCC was formed by the carbonation of the sodium silicate/CaO mixture. In trials T-27 through T-32, one half of the final PCC amount was added using commercially available PCC.

In trials T-29 and T-30, only 10% of the fiber used to make the composite product was present during the carbonation of the CaO and sodium silicate mixture. The carbonated sample of T-29 was mixed with the remainder (90%) of the fiber and then stored in a refrigerator for about 20 hours prior to forming handsheets. The carbonated sample of T-30 was stored in the refrigerator for about 20 hours before being combined with the remainder (90%) of the fiber.

In trials T-31 and T-32, calcium oxide and sodium silicate were carbonated together without fiber. The carbonated sample of T-31 was used to make handsheets about 0.5 hour after carbonation. The carbonated sample of T-32 was mixed with the fiber and then stored in the refrigerator for about 20 hours prior to making handsheets.

All handsheets for this Example 5 were formed on a Noble & Wood square handsheet mold, wet felt pressed at 20 psi and dried at 200° F. on a drum dryer. The target basis weight for handsheets made in accordance with this example was 60 g/m$^2$. The handsheets were conditioned according to TAPPI T222 and tested in the same environment. Tensile testing was performed according to TAPPI method T494 on a 7.1' strip with a crosshead speed of 1 inch/min. Tensile strength was reported as breaking length in km. ISO brightness was measured on a Technibrite Micro TB-1C and opacity with a Thwing-Albert Model 323 opacimeter. Stretch and TEA were not corrected to basis weight.

TABLE 6

| | | Basis | | Breaking Length | | | |
|---|---|---|---|---|---|---|---|
| Set | Attempt. Conds. | Wt. g/m$^2$ | Ash % | km | Std. Dev. km | Stretch % | TEA N · m/m$^2$ |
| C13 | Control - applied 45.9% PCC, Percol and cationic starch; no $Na_2SiO_3$. | 58.4 | 35.6 | 1.14 | 0.09 | 1.25 | 5.6 |
| T-25 | Applied CaO for 40.4% PCC, & 12.1% $Na_2SiO_3$ to fiber during $CO_2$; cure time was 20 hours at 39° F. | 57.7 | 32.2 | 1.75 | 0.06 | 0.88 | 5.6 |
| T-26 | Applied CaO for 40.4% PCC, & 12.1% $Na_2SiO_3$, to fiber during $CO_2$; cure time was 42 hours at 39° F. | 58.0 | 34.8 | 1.95 | 0.09 | 1.02 | 7.4 |
| T-27 | Applied CaO for 20.2% PCC, & 12.1% $Na_2SiO_3$ to fiber during $CO_2$; cure time was 21 | 58.4 | 33.6 | 1.65 | 0.09 | 0.91 | 5.8 |

TABLE 6-continued

| Set | Attempt. Conds. | Basis Wt. g/m² | Ash % | Breaking Length km | Std. Dev. km | Stretch % | TEA N · m/m² |
|---|---|---|---|---|---|---|---|
| | hours at 39° F.; then 20.2% PCC. | | | | | | |
| T-28 | Applied CaO for 20.2% PCC, & 12.1% $Na_2SiO_3$ to fiber during $CO_2$; cure time was 21 hours at 70° F., then 20.2% PCC. | 59.3 | 31.6 | 1.87 | 0.12 | 1.02 | 7.6 |
| T-29 | Applied CaO for 20.2% PCC, & 12.1% $Na_2SiO_3$ to 10% of fiber during $CO_2$; cure time was 19 hours at 39° F., then 20.2% PCC. | 59.9 | 39.2 | 1.29 | 0.06 | 1.18 | 6.2 |
| 9999999 T-30 | Applied CaO for 20.2% PCC, & 12.1% $Na_2SiO_3$ to 10% of fiber during $CO_2$; cure time was 22 hours at 39° F., then 20.2% PCC. | 59.4 | 38.6 | 1.15 | 0.06 | 1.08 | 5.1 |
| T-31 | Applied CaO for 20.2% PCC, & 12.1% $Na_2SiO_3$, but no fiber during $CO_2$; cure time was 0.5 hour at 70° F., then 20.2% PCC. | 57.4 | 38.4 | 1.25 | 0.06 | 1.38 | 6.5 |
| T-32 | Applied CaO for 20.2% PCC & 12.1% $Na_2SiO_3$, but no fiber during $CO_2$; cure time was 21 hours at 39° F., then 20.2% PCC. | 61.1 | 38.6 | 1.32 | 0.09 | 1.15 | 6.1 |

Figure 19:
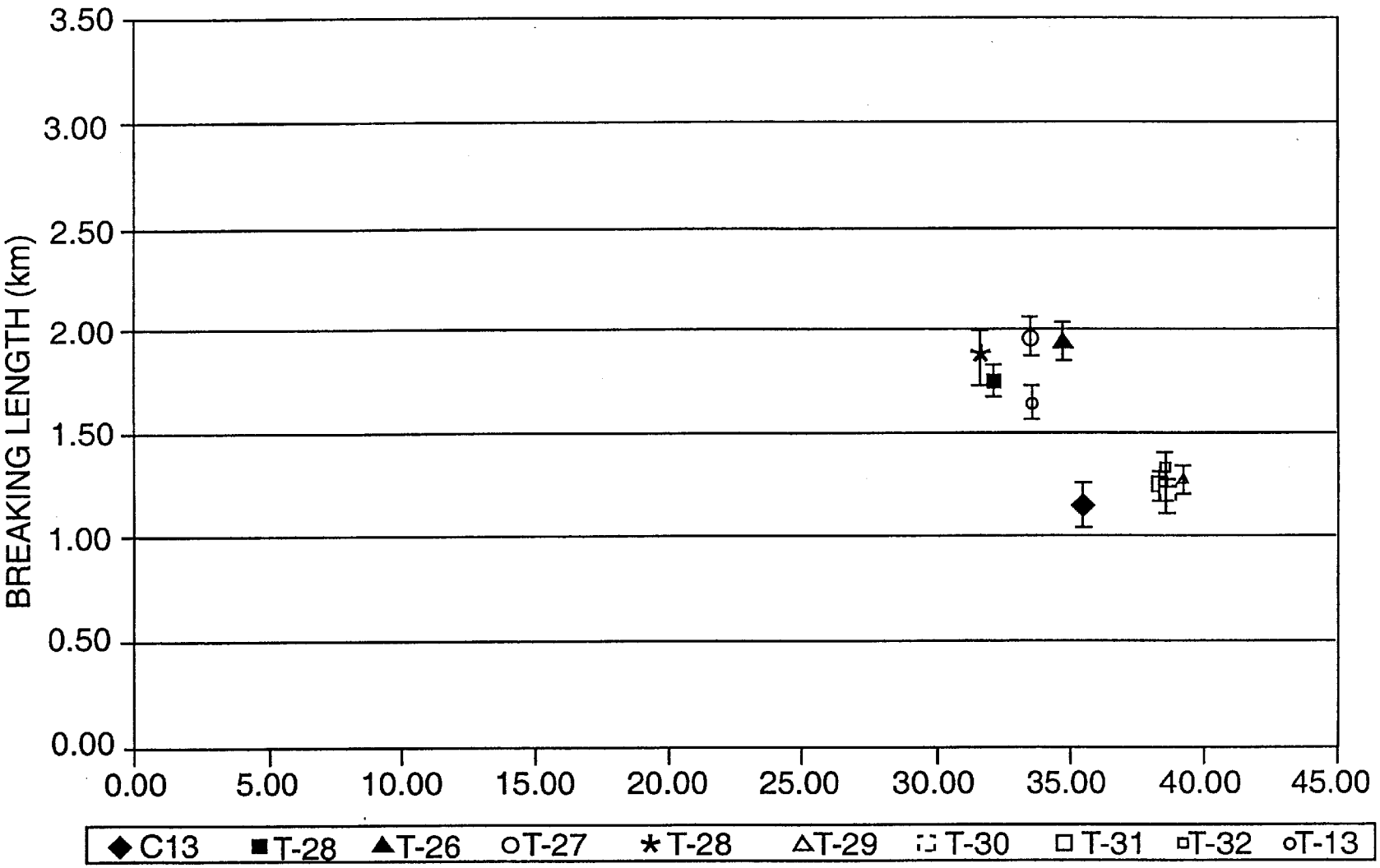
FIG. 19 is a graph of the ash content versus breaking length for controls and composite products made in accordance with the present invention.
Figure 20:
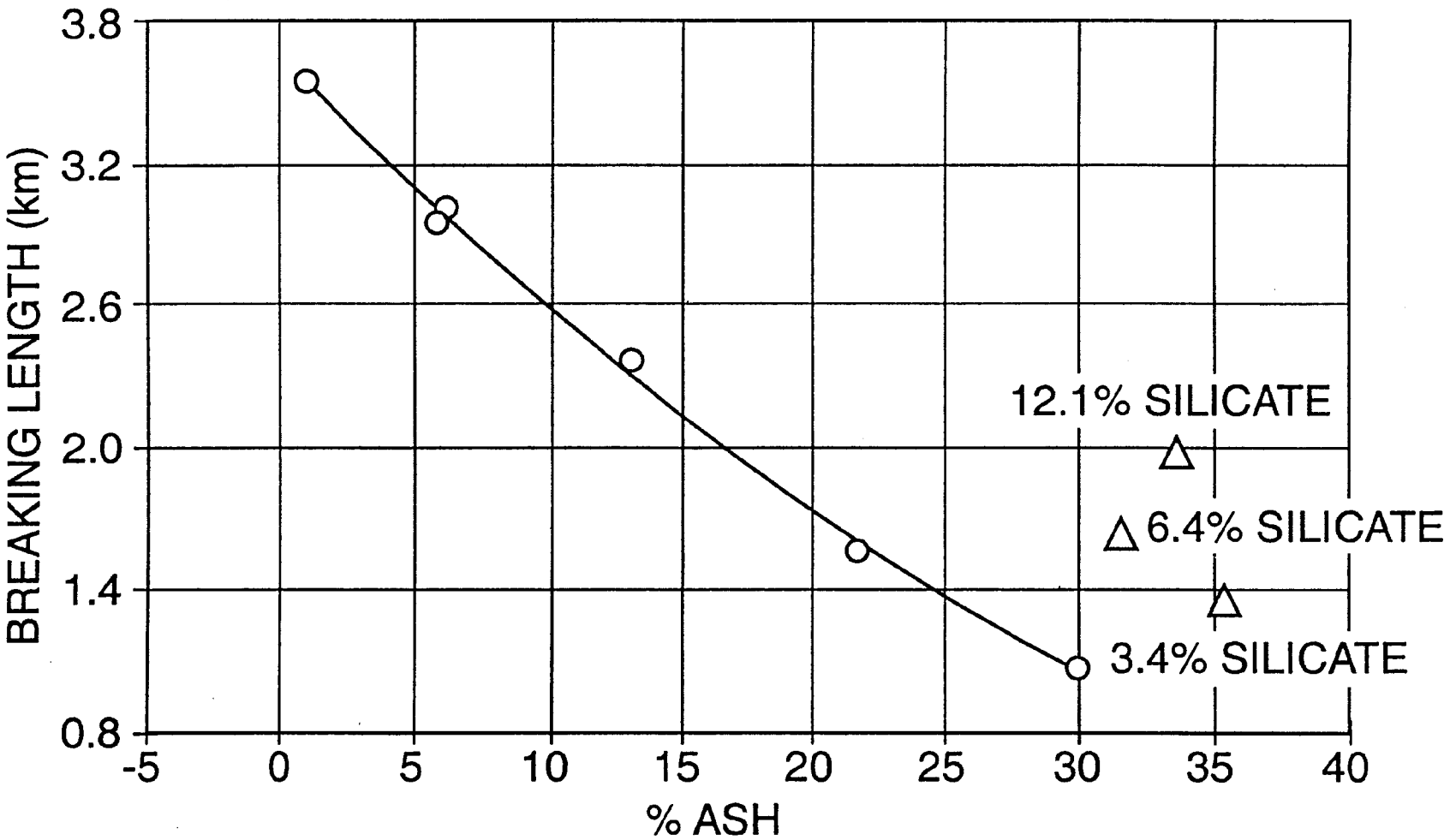
FIG. 20 is a graph of the ash content versus breaking length for controls and composite products made in accordance with the present invention.

FIG. 19, a graph of ash content versus breaking length, illustrates that the composite products typically have longer breaking lengths, at equivalent ash contents, than do control handsheets made using prior methods. FIG. 20 is a graph of ash content versus breaking length representing the data obtained according to Example 2. This graph clearly illustrates that the composite products made according to the present invention, having silicate percents of from about 3% to about 12%, had ash contents of greater than 30% and still maintained breaking lengths of at least 1.4 km. The control curve does not even extend to ash contents of this high; however, by extrapolation it appears that the breaking length of paper sheets made by prior methods would be on the order of only about 0.8 km.

Example 5 also illustrates that cure time may have an effect upon the strength and ash content of cellulosic products made according to the present invention. For example, the cure time was increased from 22 hours for trial T-25 to 42 hours for trial T-26. This resulted in an increase in strength, as indicated by the increase in breaking length of from 1.75 km for T-25 to 1.95 km for T-26, as well as an increase in the ash content of from 32.2% for T-25 to 34.8% for T-26.

It appears that forming the mineral network in the presence of the cellulosic material is an important factor to consider concerning the formation of composite products according to the present invention. Trial T-29 produced products by forming the mineral network in the presence of only about 10% of the fiber. The breaking length for T-29 was about 1.29 km. When the mineral network was formed in the presence of 100% of the fiber, as with T-27, then the breaking length of the handsheet increased, relative to T-29, up to 1.65 km.

Finally, PCC can be added to the composite product either by formation during carbonation of PCC in situ or by the addition of commercially available PCC. Either method works, and little difference is seen in strength by comparing T-25 (no added PCC; breaking length=1.75 km) to T-27 (PCC added; breaking length=1.65 km).

The following examples examine the wet tensile strength of paper made by the method of the present invention compared to a control. Wet tensile strength is an important parameter considered for the production of paper products. An increase in wet tensile strength can provide significant economic advantages. The following examples clearly demonstrate that paper products made by the process of the present invention have significantly improved wet tensile strengths relative to the control.

Example 6

Paper products can be made as described above where the mineral network is formed in the presence of the cellulosic material. Mg-FLOCC paper and Si-FLOCC paper also can be made by forming, at least partially, the mineral network prior to the time this material is added to the cellulose. One advantage of this is that it allows for the continuous formation of paper products.

This example describes how to make mineral-network-forming compositions for producing Mg-FLOCC papers. An aqueous composition was made comprising 345 grams of sodium silicate (formed using 76.3% $SiO_2$, 23.7% $Na_2O$), 27.1 grams of magnesium oxide, and 10 liters of water. An aqueous aluminum sulfate mixture was made comprising 72 grams of aluminum sulfate [$Al_2(SO_4)_3.14–18H_2O$] or 39 grams of $Al_2(SO_4)_3$ and 1 liter of water. The aluminum-sulfate mixture was added to the aqueous mixture of sodium silicate and magnesium oxide. The combined mixture was carbonated using carbon dioxide to obtain a pH of from about 7 to about 7.5.

Example 7

This example describes a composition and method for making Si-FLOCC paper products. An aqueous composition was made comprising 265 grams of sodium silicate (formed using 76.3% $SiO_2$, 23.7% $Na_2O$) and 10 liters of water. The mixture was carbonated using carbon dioxide to obtain a pH of from about 7 to about 7.5.

Example 8

This example compares the wet tensile strengths of Ca-FLOCC, Mg-FLOCC, and Si-FLOCC handsheets. This example also evaluates the use of PCC to form Ca-FLOCC, Mg-FLOCC, and Si-FLOCC hansheeets. The wet tensile strengths of these handsheets were then compared to control handsheets made in conventional manners using 12% PCC filler and 24% PCC filler.

An Organopol retention system was used to make the control handsheets. The retention system comprised 0.035 weight percent Organopol 21, a nonionic Polymer, and 0.4% by weight Bentonite (Hydrocol O).

Ca-FLOCC, Mg-FLOCC and Si-FLOCC handsheets were made as follows. The pulp furnish comprised 75% hardwood and 25% softwood (standard pulp consists of Southern market hardwoods and softwoods refined to 450 CSF). This pulp was then combined with the Mg-FLOCC and Si-FLOCC compositions made as described above in Examples 6 and 7. Filler was then added to the pulp/Ca-FLOCC, Mg-FLOCC, and Si-FLOCC compositions as shown below in Table 6. Standard PCC (Albacar LO) was used for PCC-only control sheets. The Organopol retention system was added to the mixture, and handsheets were then formed.

TABLE 7

| Filler Type | Press psi | % Filler | Basis Wt (AD, gsm) | % Solids | Peak Load |
|---|---|---|---|---|---|
| PCC | 30 | 22.2 | 75.2 | 37.6 | 133 |
| Control | 50 | 22.0 | 75.1 | 42.2 | 180 |
| | 70 | 21.6 | 76.3 | 45.7 | 228 |
| Mg-FLOCC | 30 | 25.9 | 77.8 | 36.2 | 181 |
| (30% Mg- | 50 | 24.8 | 78.0 | 41.3 | 245 |
| FLOCC & | 70 | 24.4 | 79.3 | 45.6 | 316 |
| 70% PCC) | | | | | |
| Mg-FLOCC | 30 | 25.1 | 78.4 | 35.7 | 232 |
| (12% Bulkite, | 50 | 26.2 | 81.7 | 40.9 | 257 |
| 12% PCC) | 70 | 25.3 | 79.5 | 44.2 | 361 |
| Ca-FLOCC | 30 | 23.7 | 77.0 | 37.8 | 187 |
| (30% Ca- | 50 | 23.5 | 76.4 | 41.9 | 250 |
| FLOCC & | 70 | 25.6 | 78.6 | 45.4 | 323 |
| 70% PCC) | | | | | |
| Ca-FLOCC | 30 | 23.3 | 77.6 | 34.8 | 202 |
| (12% Bulkite, | 50 | 24.2 | 77.5 | 39.3 | 287 |
| 12% PCC) | 70 | 24.0 | 78.0 | 42.1 | 349 |
| Si-FLOCC | 30 | 25.7 | 77.8 | 36.8 | 205 |
| (30% Si- | 50 | 25.1 | 75.8 | 41.3 | 266 |
| FLOCC & | 70 | 25.0 | 77.7 | 44.0 | 308 |
| 70% PCC) | | | | | |
| Si-FLOCC | 30 | 24.8 | 77.2 | 34.5 | 219 |
| (12% Bulkite, | 50 | 24.9 | 77.6 | 38.9 | 287 |
| 12% PCC) | 70 | 24.9 | 77.4 | 41.7 | 324 |

A statistical comparison of FLOCC and PCC-only handsheets is provided below in able 7.

TABLE 8

| Filler Type | Press Solids, Absolute Change | Peak Load, % Change |
|---|---|---|
| 30% Mg-FLOCC (70% PCC) | not sig. (−0.8) | 15% |
| 30% Mg-FLOCC | | |

TABLE 8-continued

| Filler Type | Press Solids, Absolute Change | Peak Load, % Change |
|---|---|---|
| (35% Bulkite, 35% PCC) | −1.5 | 34% |
| 30% Ca-FLOCC (70% PCC) | not sig. (−0.1) | 18% |
| 30% Ca-FLOCC | | |
| (35% Bulkite, 35% PCC) | −3.1 | 30% |
| 30% Si-FLOCC (70% PCC) | −0.9 | 23% |
| 30% Si-FLOCC | | |
| (35% Bulkite, 35% PCC) | −3.45 | 31% |

1) Changes in press solids are expressed as absolute values; a "−" indicates a decrease in solids from PCC-only controls.
2) Changes in peak load are expressed as relative percents; a "+" indicates an increase over PCC-only controls.
3) The same retention system was used for FLOCC and PCC-only handsheets.

Standard testing methods were used for the measurement of wet tensile strength and percent solids. A 75 g/$m^2$ handsheet is formed on a Noble and Wood handsheet mould with a mould placed on the forming wire to produce three 6 ¼" by 1" strips during sheet formation. After sheet formation, the strip mould is removed and the sheet and wire are pressed between felts running through a roll press with pressure appliced to the nip. The strips are carefully removed and placed in an airtight container and weighted. Tensile measurements are performed on an OPCo wet web tensile tester (Thwing-Albert Instrument Co.) With a testing span of 4" and a speed of 0.05 in./min. The strips are dried to determine moisture content and the remainder of the sheet formed is dried, weighted and ashed for basis weight and ash content.

The Ca-FLOCC, Mg-FLOCC, and Si-FLOCC/PCC handsheets and the PCC-only handsheets were nearly equivalent in percent solids. The FLOCC-PCC handsheets had a peak load 15 to 23% higher than PCC-only handsheets in wet-tensile strength tests. Solely within the context and parameters of this example, the best combination of components for handsheet formation appear to be the Ca-FLOCC/PCC handsheet pressed at 70 psi, which had a 45.4% solids compared to 45.7% solids in the PCC-only control pressed at 70 psi and a peak load of 349 units compared to a peak load of 228 units in the PCC-only control pressed at 70 psi.

Figure 21:
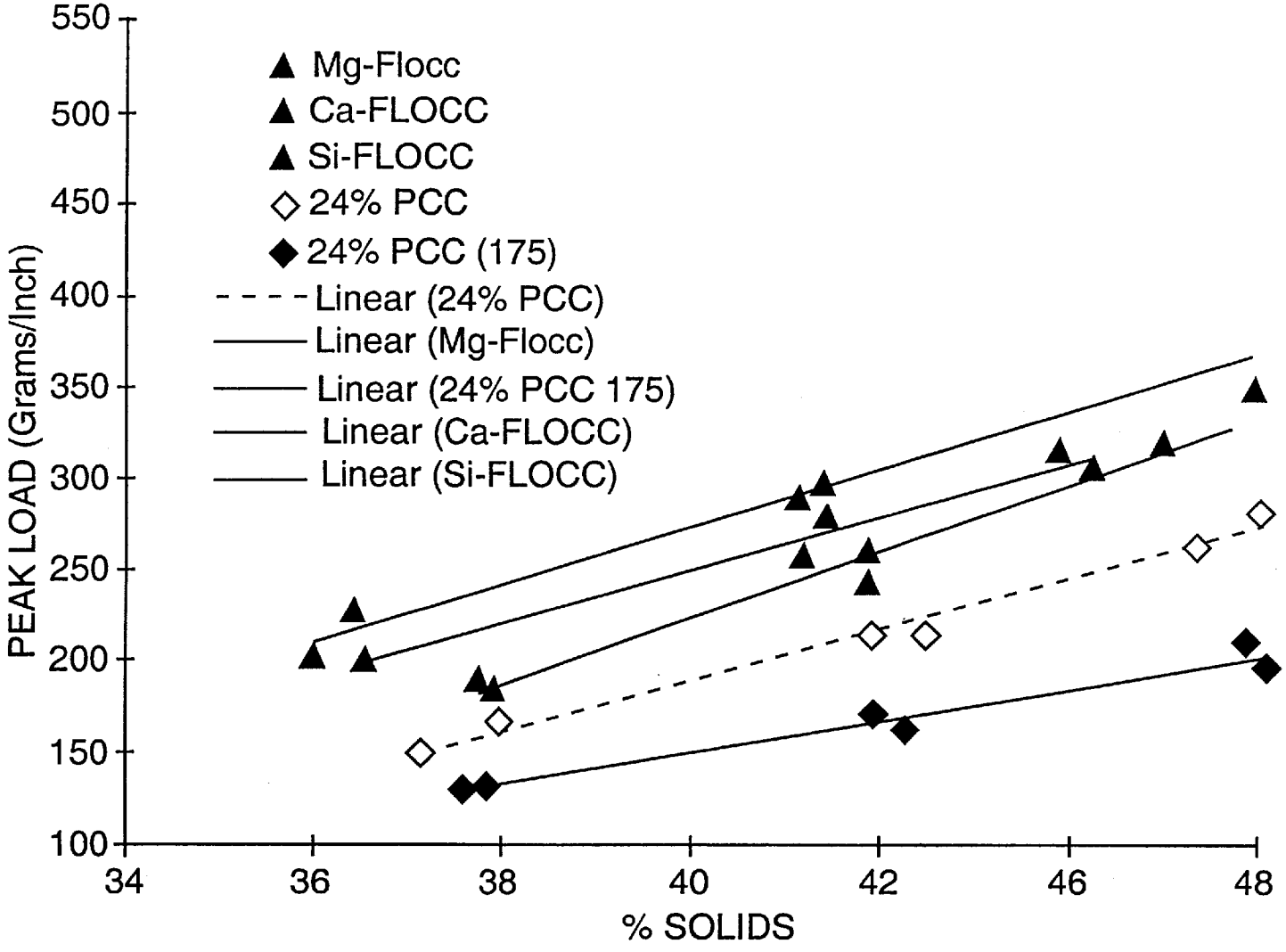
FIG. 21 is a graph of the percent solids versus peak load illustrating wet-tensile results.
Figure 22:
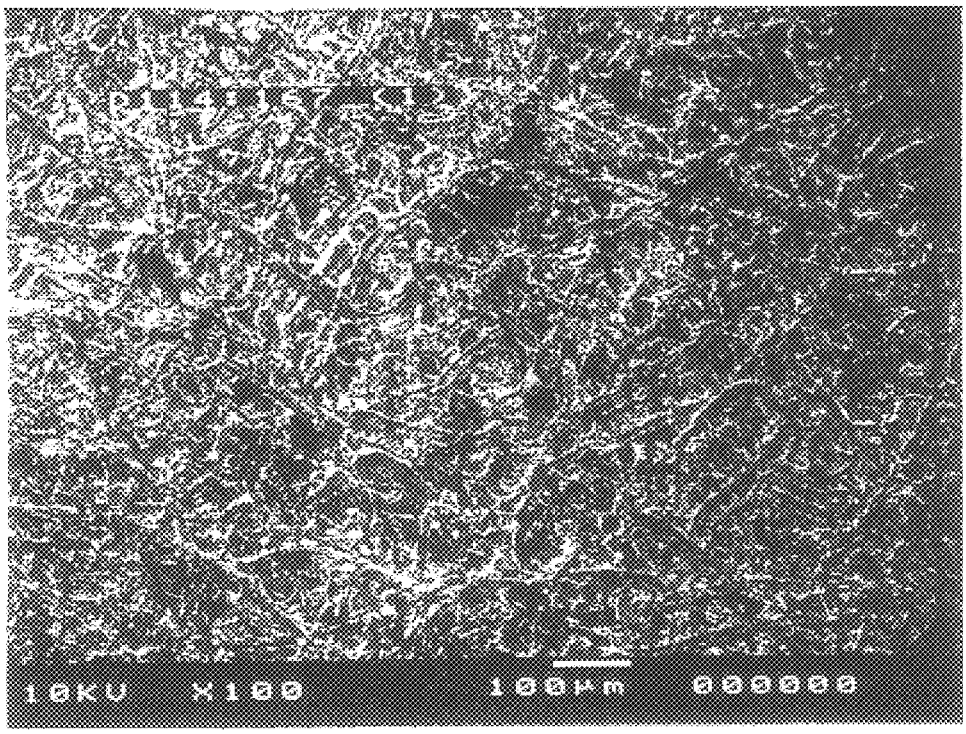
FIG. 22 is an SEM image (×100) of a Ca-FLOCC pilot-scale paper machine paper.
Figure 23:
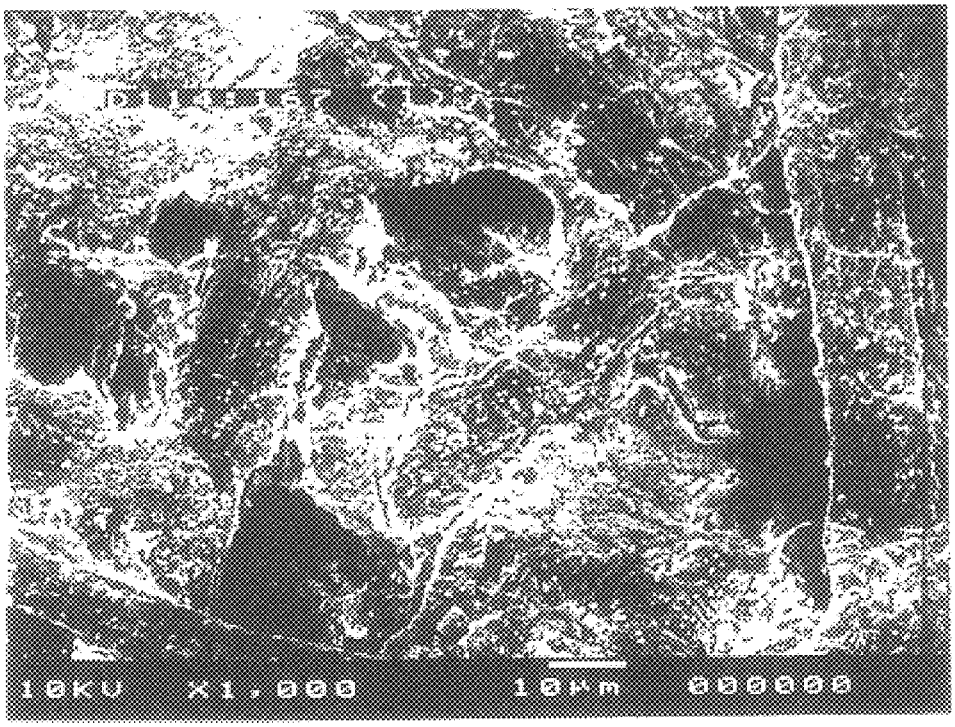
FIG. 23 is an SEM image (×1000) of a Ca-FLOCC pilot-scale paper machine paper.
Figure 24:
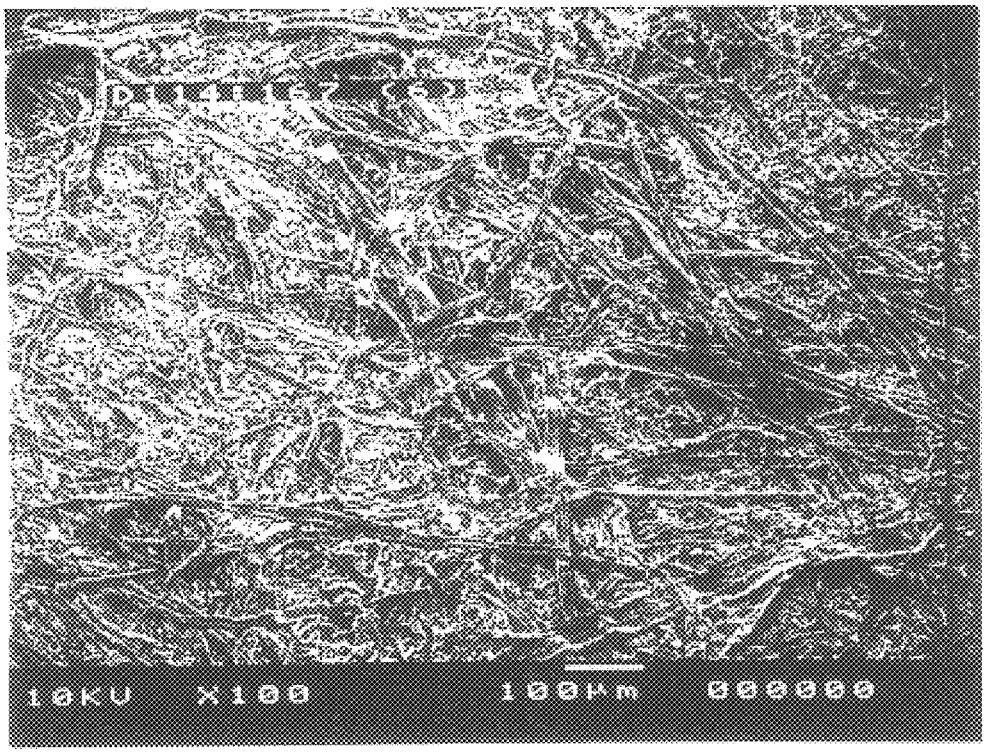
FIG. 24 is an SEM image (×100) of a Mg-FLOCC pilot-scale paper machine paper.
Figure 25:
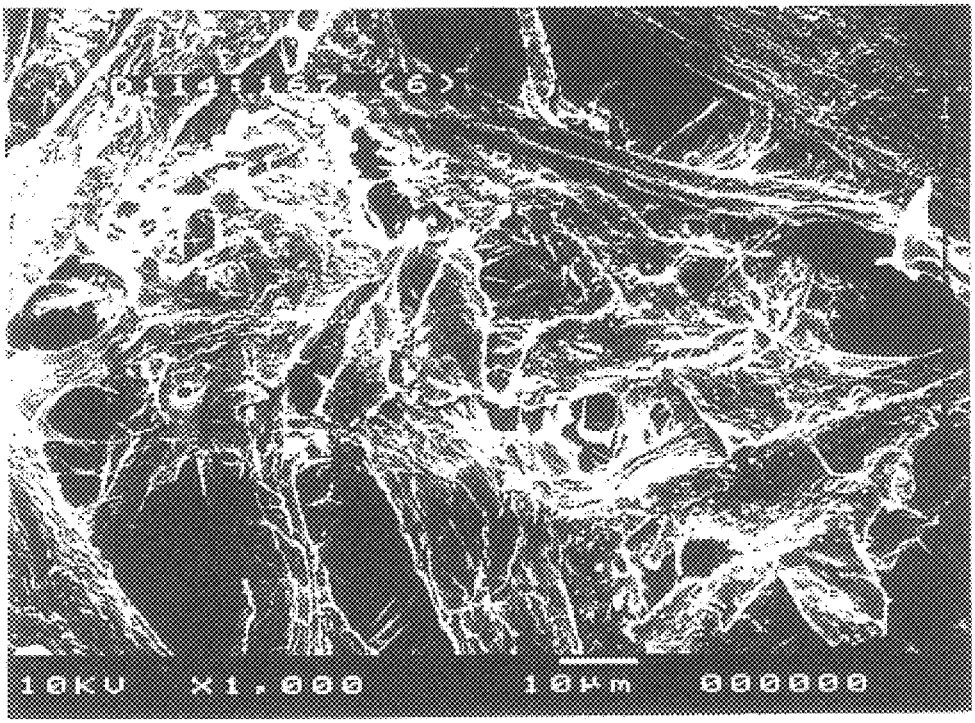
FIG. 25 is an SEM image (×1000) of a Mg-FLOCC pilot-scale paper machine paper.
Figure 26:
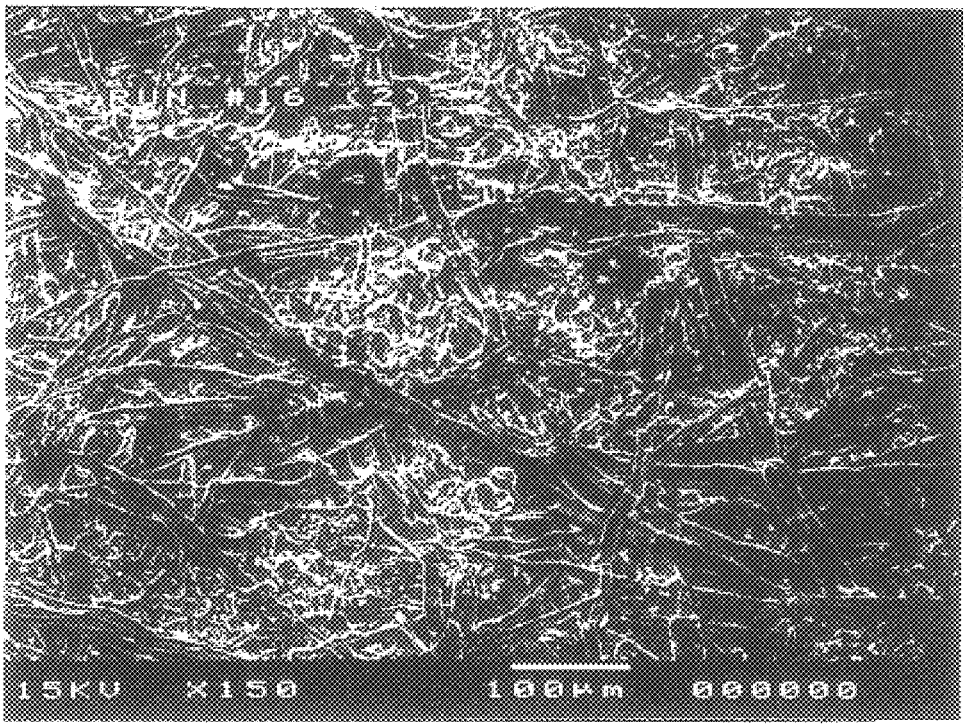
FIG. 26 is an SEM image (×150) of a Si-FLOCC pilot-scale paper machine paper.
Figure 27:
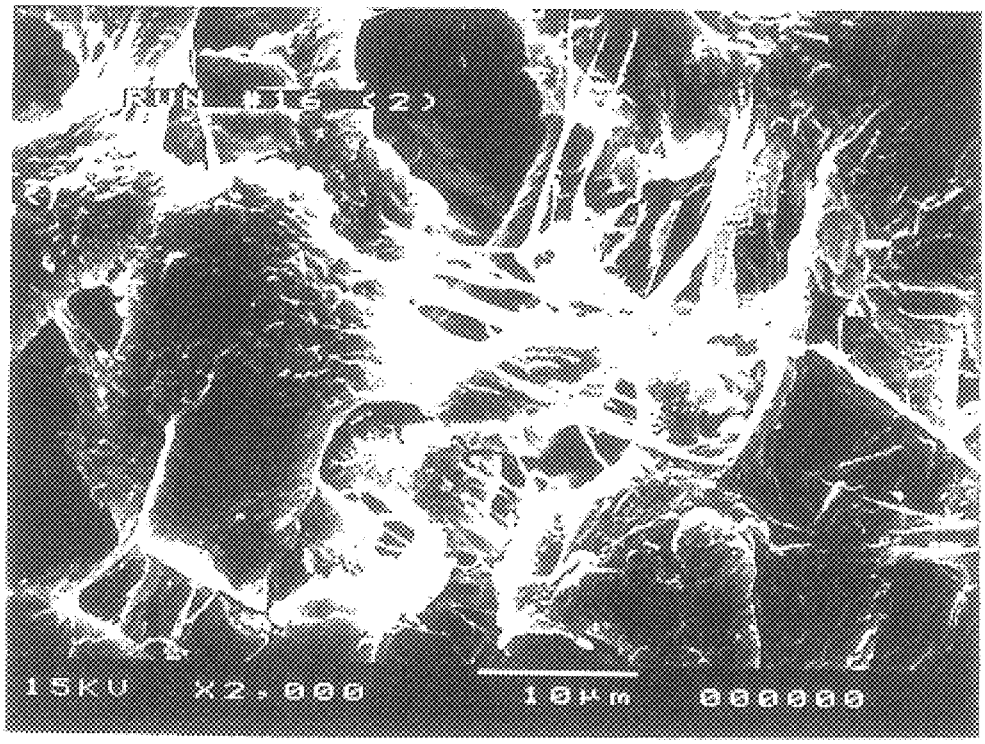
FIG. 27 is an SEM image (×2000) of a Si-FLOCC pilot-scale paper machine paper.

FIG. 21 illustrates how the wet-tensile strength of handsheets made as desribed above vary as the percent solids increases. Ca-FLOCC, Mg-FLOCC, and Si-FLOCC handsheets had significantly higher wet tensile strengths than the controls.

Paper products have been made by the methods described above using the pilot-scale paper machine at Western Michigan University. The following examples describe how these papers were produced.

Example 9

This example describes the formation of Ca-FLOCC paper. The hydropulper at Western Michigan University was used as a vessel to carbonate the chemicals in the presence of fiber and as a holding tank to cure the slurry for about 24 hours. 480 gallons of water were added to the hydropulper and thereafter 100 lbs. of hydrated lime $\{Ca(OH)_2\}$ were carefully added. In previous trials this sequence of addition for water and $Ca(OH)_2$ was reversed, which caused significantly more dusting. After 8 minutes of mixing at about 320 rpm, 100 lbs. (O.D.) of Northern softwood pulp and 300 lbs. (O.D.) of Northern hardwood pulp were added. The pulp and calcium hydroxide mixture was mixed for about 30 minutes at 420 rpm. 310 pounds of sodium silicate solution (38.7% weight percent aqueous sodium silicate; 120 lbs. OD solids) were then pumped into the pulp slurry and resulting mixture was mixed for about 30 minutes.

Carbonation of this mixture was initiated using carbon dioxide gas and solid carbon dioxide (dry ice). The delivery side of the gas regulator was about 1 psi and the tank side was about 20 psi. Dry ice was added at the rate of about 2 pounds/minute to the pulp and reaction-mixture slurry. The slurry had the appearance and properties of bread dough. The initial pH was about 13. After about 2.5 hours and about 175 pounds of dry ice, the pH was at 8.85. After four more hours of gas addition and about 25 lb. of dry ice, the slurry pH was about 8.05, whereas the target pH was 8. The mixture was then allowed to cure overnight. The pH was 7.55 after this curing stage.

The Ca-FLOCC-pulp mixture was then pumped to a mix chest of the pilot-scale paper machine and refined for the same time and energy used to reach 400 CSF on an untreated pulp blend. Ca-FLOCC paper was made from this pulp mixture using PCC as filler, ASA as a sizing agent and a retention system comprising 0.4 pounds/ton Percol 175 (used as a 0.1% aqueous solution).

Example 10

This example describes the batchwise formation of an aluminum-containing Mg-FLOCC and the use of such material for the production of paper on a pilot-scale paper machine. The hydropulper at Western Michigan University was used as a vessel to combine the chemicals used in the Mg-FLOCC process. 500 gallons of water was combined with 10.4 pounds of magnesium oxide (MgO) in the hydropulper and mixed with the hydropulper screw at 225 rpm for about 30 minutes. At that time, 344 pounds of sodium silicate (38.7% weight percent aqueous sodium silicate; about 133 pounds O.D.) solution was pumped into the MgO & water mixture. This combined mixture was mixed for 25 minutes. Then, 54 pounds of aluminum sulfate hydrate {which provided 29.3 pounds of $Al_2(SO_4)_3$} was dissolved in 40 gallons of water (0.22g aluminum sulfate/gram silicate). This aqueous aluminum sulfate solution was filtered and added to the mixture in the hydropulper.

After mixing for about 7 minutes, carbonation of the mixture was begun using carbon dioxide gas and solid carbon dioxide (dry ice). The initial pH of the mixture was 10.44. Dry ice was added to the mixture at a rate of 1–2 pounds/minute. The pH was 7.17 after 60 minutes and the dry ice addition was stopped, but carbon dioxide gas addition continued. 35 pounds of dry ice were added to the reaction mixture. The carbon dioxide gas addition was discontinued after 80 minutes when the pH was 7.08. The target pH was 7.

This reaction mixture was pumped onto 400 pounds (O.D.) of refined 25/75 SW/HW Northern pulp blend in the mix chest. The Mg-FLOCC-pulp mixture was then pumped to the blend chest which feeds forward to the machine chest. Mg-FLOCC paper was made from this pulp mixture using PCC as filler, ASA as a sizing agent and a retention system comprising 0.4 pounds/ton Organopol 21 (0.1% aqueous solution) and 8 pounds/ton Bentonite (Hydrocol 0, added as an 0.5% aqueous suspension). Very good retention of fillers was observed in these runs.

Example 11

This example describes the continuous formation of a Mg-FLOCC paper and the use of such material for the production of paper on a pilot-scale paper machine. 450 gallons of water were combined with 10.4 pounds of magnesium oxide (MgO) in the hydropulper and mixed with the hydropulper screw at 150 rpm for about 20 minutes. 338 pounds of sodium silicate (about 131 pounds O.D.) solution were pumped into the MgO and water mixture, and thereafter mixed for about 50 minutes. The 54 pounds of aluminum sulfate hydrate [which provides 29.3 pounds of $Al_2(SO_4)_3$] were dissolved in about 40 gallons of water, filtered, and added to the reaction mixture in the hydropulper.

After mixing for 5 minutes, carbonation was started with carbon dioxide gas (similar to Example 10) and solid carbon dioxide (dry ice). The initial pH of the slurry was about 10.24. Dry ice was added to the slurry at a rate of about 1–2 pounds/minute. The pH was 7.23 after 65 minutes, and the dry ice addition was stopped but the carbon dioxide gas addition continued. About 35 pounds of dry ice were added to the reaction mixture. Carbon dioxide gas addition was discontinued after 90 minutes when the pH was 7.00, which was the target pH. The gel formation was thicker than the batch-wise Mg-FLOCC, and was more equivalent to the gels observed in laboratory reactions.

This reaction mixture was pumped into a stirred, conical metal vessel that contained a bottom withdrawal hose. This hose was connected to a centrifugal pump. The flow rate from the pump was roughly controlled with a gate valve to be about 23.2 pounds/minute or about 2.7 gallons of slurry/minute. This flow rate was lower than the calculated 3.1 gallons/minute which would be equivalent to the batch process for making Mg-FLOCC paper. With this system, the Mg-FLOCC composition was pumped continuously into the drop leg to the fax pump. Excellent retention of fillers also was observed in these runs. As the runs proceeded the reaction mixture continued to gel and thicken, and stirring had to be maintained. After completion of the runs about 150 gallons of the 520 gallons Mg-FLOCC reaction mixture remained.

Table(s) 8–13 below summarize the results that were obtained for the paper machine trials discussed above. The paper analyses listed were all done according to TAPPI procedures. Carbonate content was determined on 500° C. ash on a CO2 coulometer to determine the PCC content of the ash and it was within expected levels. Metal analyses were done on acidified samples (hydrochloric acid) with an inductively coupled plasma spectrometer. The sodium content of the Ca-FLOCC, Mg-FLOCC and Si-FLOCC paper was 5 to 10 times the level of the control, which increased conductivity of the paper. This avoids the use of salt in the size press for the purpose of increasing conductivity. The increased sodium content of the Ca-FLOCC, Mg-FLOCC and Si-FLOCC paper also is evidence that the FLOCC components are incorporated into the paper. SEM photomicrographs of papers made as described above were taken (SEE, FIGS. 22–27)

The following Table 8 provides information for the paper machine trials for each of the Ca-FLOCC, Mg-FLOCC and Si-FLOCC papers discussed above in Examples 9–11.

TABLE 9

| Run No. | % PCC Filler | Targeted Total % Filler | Mineral | Retention System[1] | ASA Emulsion #/ton | Time minutes | Process |
|---|---|---|---|---|---|---|---|
| 1 | 0 | 20 | Ca-Flo.[2] In Pulp | P | 4 | 40 | |
| 2 | 5 | 25 | Ca-Flo. In Pulp | P | 4 | 40 | |
| 3 | 10 | 30 | Ca-Flo. In Pulp | P | 4 | 40 | |
| 4 | 10 | 30 | Ca-Flo. In Pulp | P | 4 | 40 | SP[3] Cal Sm-150 |
| 5 | 5 | 25 | Ca-Flo. In Pulp | P | 4 | 20 | SP Cal Sm-150 |
| 6 | 0 | 8 | Mg-Flo.[4] In Pulp | RO | 4 | 40 | |
| 7 | 12 | 20 | Mg-Flo. In Pulp | HO | 4 | 40 | |
| 8 | 17 | 25 | Mg.Flo. In Pulp | HO | 4 | 40 | |
| 9 | 17 | 25 | Mg-Flo In Pulp | HO | 4 | 40 | SP Cal Sm-150 |
| 10 | 12 | 20 | Mg-Flo. In Pulp | HO | 4 | 20 | SP Cal. Sm-150 |
| 11 | 0 | 8 | CA[5] Mg-Flo. | HO | 4 | 40 | |
| 12 | 12 | 20 | CA Mg-Flo. | HO | 4 | 40 | |
| 13 | 12 | 25 | CA Mg-Flo. | HO | 4 | 40 | |
| 14 | 17 | 25 | CA Mg-Flo. | HO | 4 | 40 | SP Cal. Sm-150 |
| 15 | 12 | 20 | CA Mg-Flo. | HO | 4 | 20 | SP Cal. Sm-150 |
| 16 | 0 | 8 | Si-Flo.[6] | HO | 4 | 40 | |
| 17 | 12 | 20 | Si-Flo. | HO | 4 | 40 | |
| 18 | 17 | 25 | Si-Flo | HO | 4 | 40 | |
| 19 | 17 | 25 | Si-Flo. | HO | 4 | 40 | SP Cal. Sm-150 |
| 20 | 12 | 20 | Si-Flo. | HO | 4 | 20 | SP Cal. Sm-150 |
| 21 | 0 | 0 | PCC Control | P | 4 | 30 | |
| 22 | 15 | 15 | PCC Control | P | 4 | 30 | |
| 23 | 20 | 20 | PCC Control | P | 4 | 30 | |
| 24 | 25 | 25 | PCC Control | P | 4 | 30 | |
| 25 | 30 | 30 | PCC Control | P | 4 | 30 | |
| 26 | 0 | 0 | PCC Control | P | 4 | 30 | SP Cal. Sm-150 |
| 27 | 15 | 15 | PCC Control | P | 4 | 30 | SP Cal. Sm-150 |
| 28 | 20 | 20 | PCC Control | P | 4 | 30 | SP Cal. Sm-150 |
| 29 | 25 | 25 | PCC Control | P | 4 | 30 | SP Cal. Sm-150 |

TABLE 9-continued

| Run No. | % PCC Filler | Targeted Total % Filler | Mineral | Retention System[1] | ASA Emulsion #/ton | Time minutes | Process |
|---|---|---|---|---|---|---|---|
| 30 | 30 | 30 | PCC Control | P | 4 | 30 | SP Cal. Sm-150 |

[1]The retention system used for these trials was 8 lbs/tons Hydrocol O and 0.4 lbs/tons Organopol 21, indicated as HO, or 0.4 pounds/ton Percol 175, indicated as P.
[2]CA refers to continuous addition of the mineral using, for example, the addition apparatus discussed above.
[3]SP Cal-150 refers to size pressing and calendaring the papers made by these paper machine runs.

Table 9 provides data concerning the physical properties of papers made on paper machines as described above in Examples 9–11 relative to control paper.

TABLE 10

| Sample ID | Basis Weight g/m$^2$ | Caliper mil | Bulk cm$^3$/g | Tensile lb/in MD | Tensile lb/in CD | Breaking Length m MD | Breaking Length m CD | Stretch % MD | Stretch % CD | TEA ft lb/ft$^2$ MD | TEA ft lb/ft$^2$ CD | Ash % | Gurley Stiffness milligrams MD | Gurley Stiffness milligrams CD | Rewetted Wet Tensile lb/in MD | Rewetted Breaking Length m MD | Wet/Dry Ratio % MD |
|---|---|---|---|---|---|---|---|---|---|---|---|---|---|---|---|---|---|
| 1-20 | 74.8 | 5.25 | 1.783 | 9.7 | 4.1 | 2316 | 979 | 0.91 | 2.06 | 0.71 | 0.80 | 31.5 | 95 | 24 | 1.40 | 335 | 14.44 |
| 1-40 | 77.2 | 5.31 | 1.747 | 11.6 | 4.2 | 2684 | 972 | 1.11 | 2.35 | 1.07 | 0.96 | 30.3 | 104 | 30 | 1.48 | 342 | 12.73 |
| 2 | 76.7 | 4.93 | 1.633 | 10.2 | 3.7 | 2375 | 862 | 1.09 | 2.44 | 0.91 | 0.87 | 35.0 | 88 | 25 | 1.42 | 330 | 13.89 |
| 3 | 69.2 | 5.22 | 1.916 | 8.2 | 3.2 | 2117 | 826 | 1.02 | 2.25 | 0.69 | 0.68 | 41.0 | 52 | 28 | 1.20 | 309 | 14.61 |
| 4 | 68.9 | 3.63 | 1.338 | 7.3 | 3.4 | 1892 | 881 | 0.74 | 3.05 | 0.41 | 1.01 | 37.9 | 46 | 23 | 1.25 | 323 | 17.07 |
| 5 | 72.0 | 4.07 | 1.436 | 11.4 | 4.1 | 2828 | 1017 | 1.36 | 3.34 | 1.32 | 1.33 | 32.7 | 67 | 29 | 1.23 | 304 | 10.76 |
| 6-0 | 77.4 | 5.4 | 1.772 | 18.0 | 7.2 | 4154 | 1662 | 1.50 | 3.62 | 2.24 | 2.59 | 19.4 | 176 | 67 | 1.37 | 315 | 7.59 |
| 6-20 | 80.1 | 5.53 | 1.754 | 11.4 | 4.0 | 2542 | 892 | 1.00 | 1.93 | 0.9 | 0.8 | 28.6 | 159 | 48 | 1.02 | 227 | 8.93 |
| 7 | 75.6 | 5.55 | 1.865 | 11.6 | 5.0 | 2741 | 1181 | 0.90 | 2.02 | 0.82 | 1.03 | 25.4 | 144 | 56 | 0.91 | 216 | 7.88 |
| 8 | 75.3 | 5.63 | 1.899 | 9.5 | 3.9 | 2253 | 925 | 0.81 | 2.40 | 0.63 | 0.89 | 32.2 | 116 | 40 | 0.86 | 204 | 9.03 |
| 9 | 82.8 | 4.17 | 1.279 | 14.1 | 5.8 | 3042 | 1251 | 1.23 | 3.29 | 1.36 | 1.73 | 30.7 | 113 | 50 | 0.35 | 75 | 2.47 |
| 10 | 73.6 | 3.90 | 1.346 | 14.7 | 5.8 | 3567 | 1408 | 1.31 | 3.23 | 1.54 | 1.74 | 26.2 | 94 | 38 | 0.70 | 170 | 4.78 |
| 11-S | 75.3 | 5.13 | 1.730 | 21.6 | 8.7 | 5124 | 2064 | 1.88 | 4.58 | 3.45 | 3.82 | 16.0 | 145 | 67 | 1.20 | 285 | 5.56 |
| 11-E | 69.0 | 4.81 | 1.771 | 20.1 | 8.8 | 5203 | 2278 | 1.80 | 4.58 | 3.05 | 3.96 | 15.8 | 114 | 60 | 1.25 | 324 | 6.24 |
| 12 | 75.8 | 5.32 | 1.783 | 10.7 | 5.3 | 2521 | 1249 | 1.29 | 2.67 | 1.12 | 1.35 | 26.5 | 129 | 46 | 0.86 | 203 | 8.06 |
| 13 | 71.6 | 5.25 | 1.862 | 10.0 | 5.0 | 2495 | 1247 | 1.00 | 2.69 | 0.8 | 1.29 | 30.7 | 108 | 56 | 0.81 | 201 | 8.06 |
| 14 | 76.6 | 4.08 | 1.353 | 11.3 | 5.2 | 2635 | 1213 | 1.41 | 3.29 | 1.3 | 1.58 | 32.1 | 118 | 39 | 0.74 | 173 | 6.56 |
| 15 | 74.7 | 4.25 | 1.445 | 14.6 | 7.0 | 3491 | 1674 | 1.19 | 3.65 | 1.4 | 2.31 | 25.7 | 123 | 49 | 0.80 | 190 | 5.45 |
| 16-S | 76.4 | 5.12 | 1.702 | 17.4 | 7.2 | 4068 | 1683 | 1.79 | 5.39 | 2.69 | 3.92 | 19.5 | 139 | 54 | 1.07 | 250 | 6.14 |
| 16-E | 80.1 | 5.34 | 1.693 | 18.3 | 7.4 | 4081 | 1650 | 3.20 | 5.24 | 3.2 | 3.96 | 19.2 | 181 | 65 | 1.17 | 260 | 6.38 |
| 17 | 81.3 | 5.57 | 1.740 | 11.8 | 4.9 | 2592 | 1077 | 1.19 | 3.42 | 1.2 | 1.64 | 30.1 | 154 | 53 | 0.84 | 185 | 7.14 |
| 18 | 75.8 | 5.66 | 1.879 | 8.9 | 3.7 | 2097 | 872 | 0.99 | 2.30 | 0.75 | 0.85 | 35.0 | 125 | 43 | 0.68 | 160 | 7.62 |
| 19 | 77.7 | 4.04 | 1.321 | 11.8 | 4.6 | 2713 | 1057 | 1.04 | 3.01 | 0.97 | 1.32 | 34.9 | 103 | 33 | 0.59 | 136 | 5.03 |
| 21-S | 75.8 | 5.18 | 1.736 | 27.5 | 13.6 | 6480 | 3205 | 1.71 | 3.49 | 3.84 | 4.31 | 1.5 | 231 | 111 | 1.33 | 314 | 4.84 |
| 21-E | 77.3 | 5.32 | 1.747 | 26.4 | 14.2 | 6098 | 3280 | 1.77 | 3.43 | 3.81 | 4.43 | 1.1 | 216 | 113 | 1.46 | 338 | 5.54 |
| 22 | 76.2 | 5.47 | 1.823 | 15.7 | 7.5 | 3680 | 1758 | 1.27 | 2.38 | 1.6 | 1.62 | 17.7 | 166 | 74 | 0.77 | 180 | 4.89 |
| 23 | 75.9 | 5.97 | 1.998 | 11.5 | 6.0 | 2706 | 1412 | 0.87 | 1.69 | 0.79 | 0.91 | 22.8 | 142 | 66 | 0.71 | 168 | 6.22 |
| 24 | 75.1 | 5.85 | 1.979 | 7.2 | 3.4 | 1712 | 809 | 0.68 | 1.02 | 0.39 | 0.25 | 29.1 | 120 | 46 | 0.48 | 115 | 6.70 |
| 25 | 74.9 | 6.17 | 2.092 | 5.7 | 3.5 | 1359 | 835 | 0.47 | 1.10 | 0.21 | 0.33 | 35.0 | 86 | 37 | 0.53 | 127 | 9.31 |
| 26-S | 78.3 | 4.58 | 1.486 | 30.7 | 16.4 | 7003 | 3741 | 1.97 | 4.29 | 4.94 | 6.25 | 0.3 | 220 | 91 | 1.15 | 261 | 3.73 |
| 26-E | 76.2 | 4.52 | 1.507 | 30.8 | 16.0 | 7220 | 3750 | 2.08 | 4.67 | 5.22 | 6.63 | 0.5 | 194 | 95 | 1.21 | 284 | 3.94 |
| 27 | 77.7 | 4.2 | 1.373 | 18.5 | 10.0 | 4253 | 2299 | 1.51 | 3.6 | 2.27 | 3.19 | 18.2 | 154 | 67 | 0.67 | 153 | 3.60 |
| 28 | 75.9 | 4.06 | 1.359 | 15.2 | 8.0 | 3577 | 1883 | 1.51 | 3.05 | 1.83 | 2.14 | 25.4 | 119 | 48 | 0.55 | 129 | 3.62 |
| 29 | 76.2 | 4.04 | 1.347 | 11.9 | 6.2 | 2789 | 1453 | 1.31 | 2.82 | 1.25 | 1.52 | 32.3 | 82 | 35 | 0.53 | 123 | 4.42 |
| 30 | 71.4 | 3.77 | 1.341 | 9.1 | 4.1 | 2276 | 1026 | 1.23 | 2.26 | 0.91 | 0.8 | 38.3 | 60 | 25 | 0.42 | 106 | 4.66 |

Table 10 shows that paper products made as stated above had little size, as the paper readily absorbed applied water. This lack of size was addressed in subsequent pilot paper machine trials.

Figure 28:
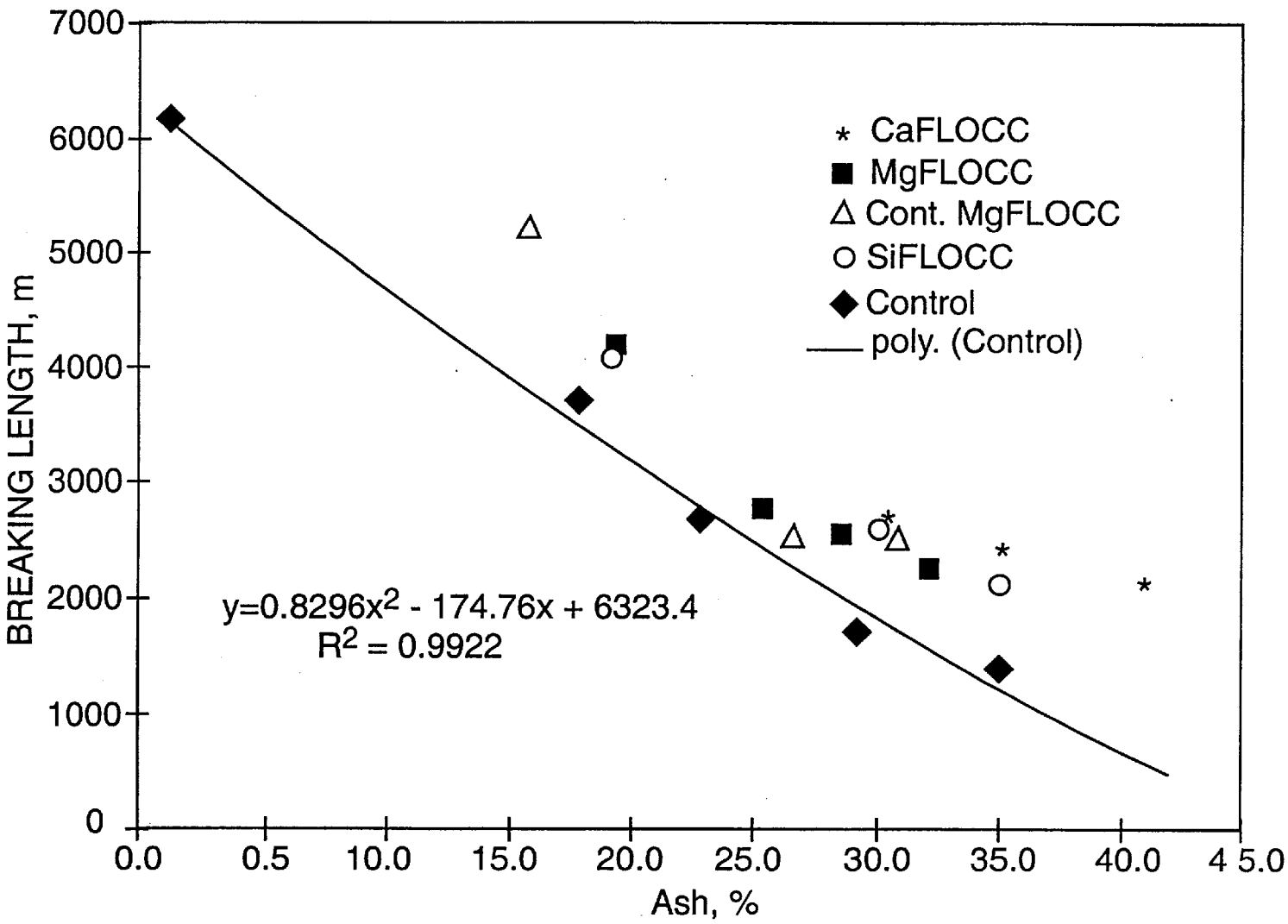
FIG. 28 is a graph of the percent ash content versus machine direction breaking length.

FIGS. 28–31 provide graphical illustrations of the machine direction breaking length, machine direction tensile energy absorption (TEA), the cross direction TEA, and the rewetted breaking length for paper products made according to Examples 9–11 above. FIG. 28 clearly shows that the machine direction breaking length for the FLOCC paper products were significantly improved compared to a control ("poly." refers to the polynomial fit of a line to the control data). For example, at a 40% ash content, the machine breaking length for Ca-FLOCC paper is equivalent to that of the control at an ash content of only about 26% ash. Mg-FLOCC papers at about 32% ash have a machine direction breaking length equivalent to that of the control at about 25% ash. Si-FLOCC paper at 35% ash has a machine direction breaking length equivalent to that of the control at about 28% ash.

Figure 29:
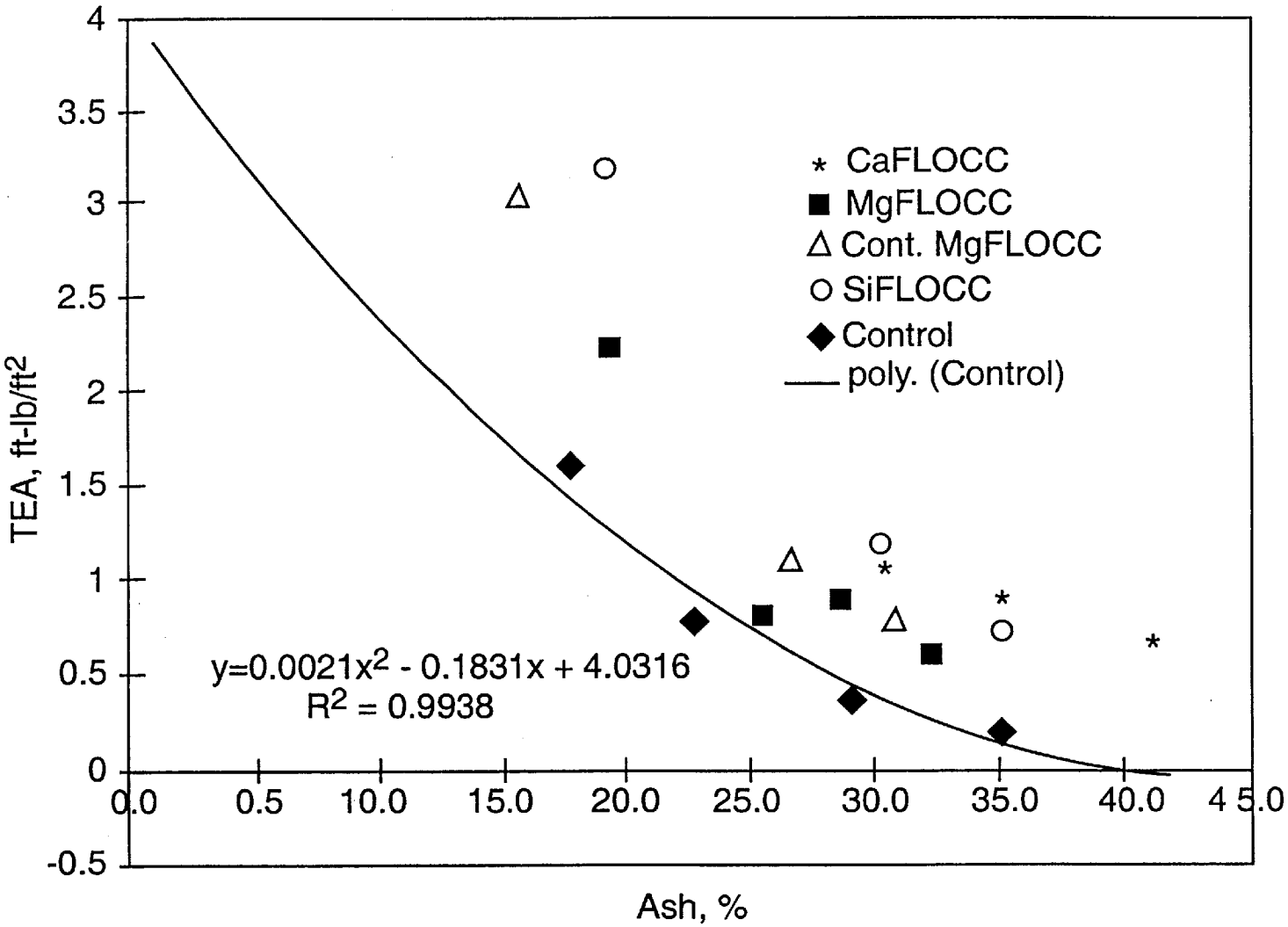
FIG. 29 is a graph of the percent ash content versus machine direction tensile energy absorbance.

FIG. 29 illustrates the machine direction tensile energy absorption of FLOCC products made as described above relative to a control. Again, Ca-FLOCC paper has a significantly improved machine direction TEA. Specifically, Ca-FLOCC at 42% ash has a machine direction TEA equivalent to that of the control at about 24% ash. Mg-FLOCC and Si-FLOCC papers also have significantly improved machine direction TEA values relative to the control. Si-FLOCC paper at 35% ash has a TEA equivalent to that of the control at about 25% ash, whereas Mg-FLOCC at about 32% ash has machine direction TEA value equivalent to that of the control at about 26% ash.

Figure 30:
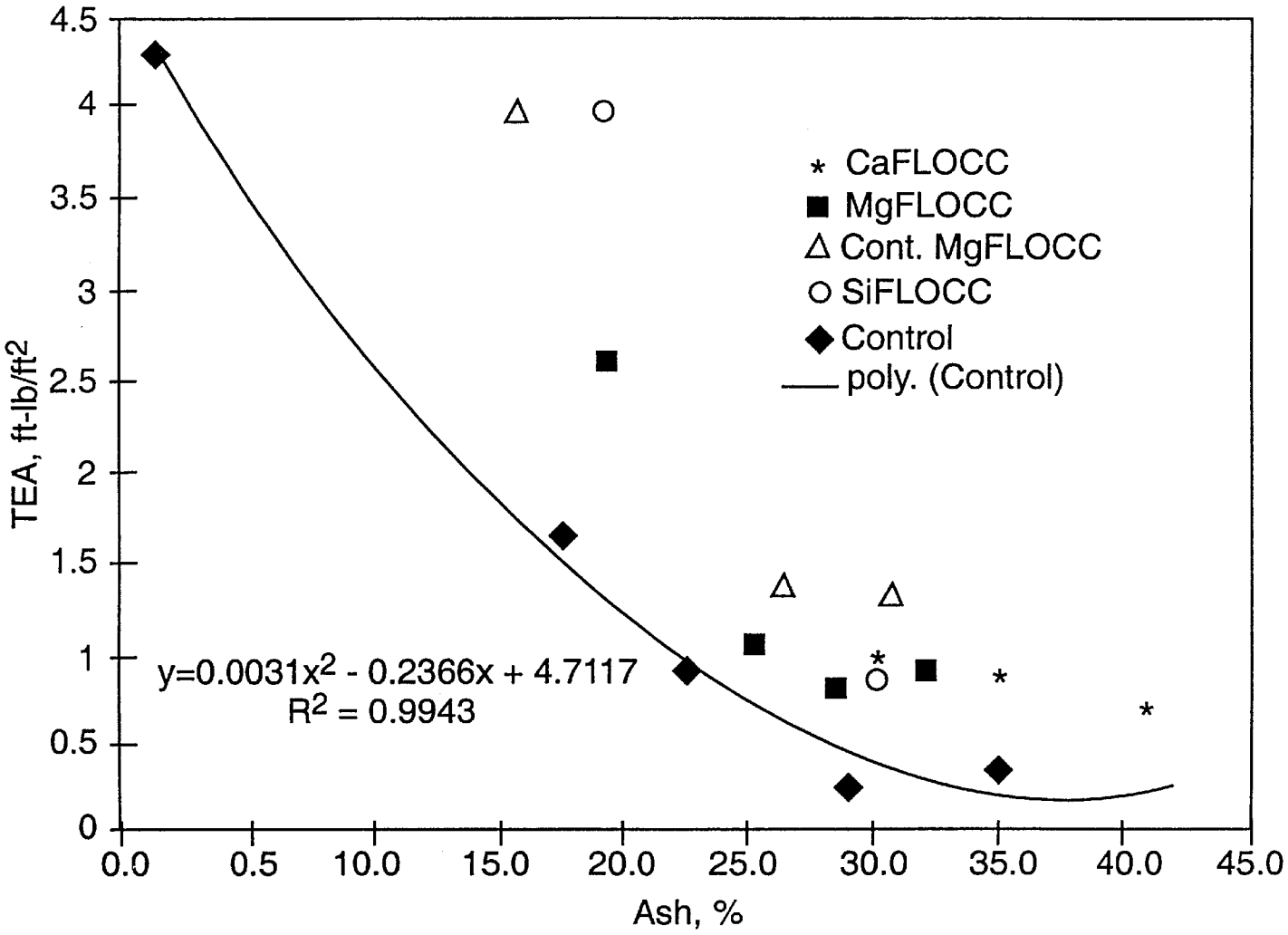
FIG. 30 is a graph of the percent ash content versus cross direction tensile energy absorbance.

FIG. 30 of the FLOCC papers compared to the control further substantiates the data provided with respect to the machine direction TEA. Specifically Ca-FLOCC appears to have the best TEA, and at about 41% ash is equivalent to the CD TEA of the control at about 25% ash. Again, both Mg-FLOCC and Si-FLOCC products also are significantly better than that of the control.

Figure 31:
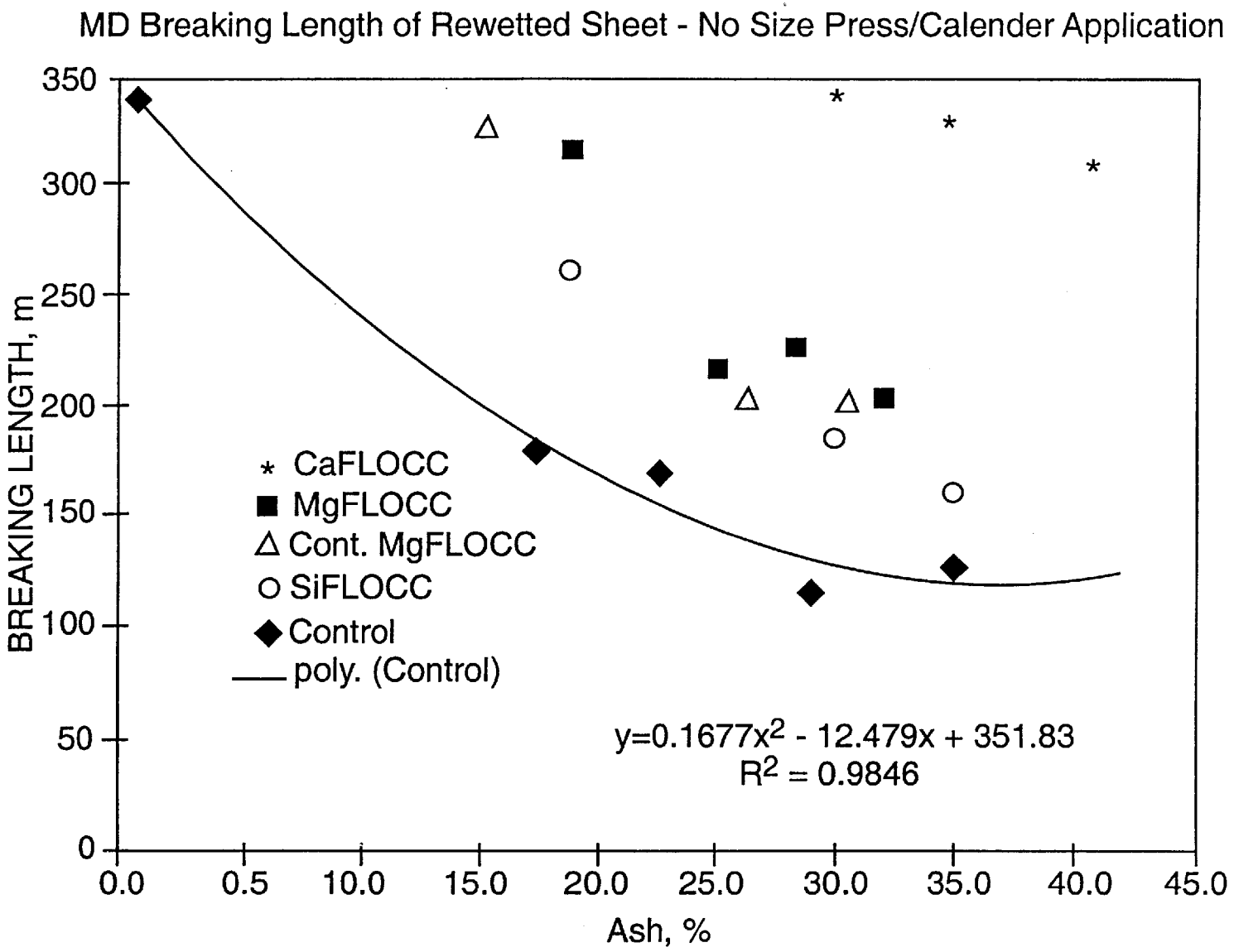
FIG. 31 is a graph of the percent ash content versus machine direction breaking length of a rewetted sheet.

FIG. 31 illustrates the machine direction breaking length of a rewetted sheet for the FLOCC papers relative to the control. This figure dramatically illustrates significantly superior results provided by the FLOCC papers, particularly with respect to the Ca-FLOCC process. The best machine direction breaking length for the rewetted sheet for the control was approximately 340 meters at an ash content of only about 1%. Machine direction breaking length of the rewetted sheet for the control rapidly decreased from about 340 meters to about 175 meters when increasing the filler content, and hence the ash percent, up to about 16% ash. In contrast, at an ash content of 42%, the machine direction breaking length of the rewetted sheet for the Ca-FLOCC paper was approximately 320 meters (i.e., substantially that of the control sheet with a 3% filler or less). Moreover, both the Si-FLOCC and Mg-FLOCC papers also were substantially improved relative to the control. For example, for the Mg-FLOCC paper at an ash percent of about 32% the machine direction breaking length of the rewetted sheet was approximately 210 meters, equivalent to that of the control at an ash content of less than 15% ash. Similarly, the Si-FLOCC paper had a machine direction breaking length of the rewetted sheet of approximately 170 meters at an ash content of 35%, equivalent to that of the control at an ash content of about 20%. The increase in rewetted tensile strength would be expected for a composite product derived strength from a mineral network. Thus this supports the unique properties of these products.

Example 12

This example concerns further pilot paper machine trials conducted on the pilot paper machine at Western Michigan University in Kalamazoo. In these trials, internal sizing was substantially increased for paper products made by the FLOCC process. Moreover, titanium dioxide was added to the cellulosic-mineral mixture to increase brightness and opacity.

The pulp for the this example was Jackson hardwood pulp. The fiber analysis of the bales used in the trial showed it to be a blend of 78–73% hardwood and 22–27% softwood. The blend was refined to a 400 CSF target. The HB PCC (precipitated calcium carbonate at about 20% solids) was obtained from the St. Helens mill in 50-gallon plastic barrels.

The retention system was maintained constant throughout this trials, and comprised Organopol 21 and Hydrocol 0. The retention system chemicals were supplied by Allied Colloids, Inc., of Suffolk, Va.

PCC was added as filler material. The target filler content for all runs was 13% to 28%.

The ASA/starch emulsion and some wet-end additives were varied in an attempt to increase internal size. The ASA emulsion used was a 1:4 ratio of ASA from Cytec and Staley Stalok 400AL. The size press starch was Staley Ethylex 2040 formulated to 6% solids at the size press. The surface size used in the size press was Cypres 310 from Cytec. The titanium dioxide was $TiO_2$ NA A310 from SCM and it was supplied by WMU. The talc was Mistrofil from Luzenac America. The polyaluminum chloride (PAC) was PhAC-SIZE from Raisio Chemical. The Protec ZA7, a zirconium product, was from Magnesium Elecktron Inc.

All the compositions and chemicals used to make the FLOCC papers were the same as stated above. The sodium silicate O solution (assumed to be 38.75% solids) was from Haviland Products Co. The magnesium oxide, was labeled Mag Chem 10, technical from Martin Marietta Specialties, Inc. This powder had hardened into chunks, which were pulverized before being added to the silicate mixture. The alum or aluminum sulfate hydrate $\{Al_2(SO_4)_3.14–18\ H_2O$, Iron free ground, Code 022–1322$\}$ was from General Chemical. It was dissolved in water and used in the continuous FLOCC apparatus and in the wet end.

The carbon dioxide was obtained from the gas takeoff on a liquid Dewar from Air Products. The gas was delivered into the reaction mixture through a gas heater, to a two stage regulator, to flow meter, to ¼" copper tubing, to a gas shutoff valve, and then in parallel to eight bronze gas diffusers (1" diameter & 2" long, Capstan Permaflow) located in the carbonation unit of the continuous apparatus.

Table 11 below provides the conditions for the paper machine runs for this example.

TABLE 11

| Run No | Silicate % | Mineral Type | Cure Container or Conduit | Couch Solids, % | 1st Press Solid, % | 2nd Press Solids, % | ASA lb/ton | Other Wet End Additives |
|---|---|---|---|---|---|---|---|---|
| 1-1 | 0 | None | None | 22.8 | 40.6 | 40.9 | 4 | None |
| 1-2 | 8 | Mg-FLOCC | Container | — | — | — | 4 | None |
| 1-2 | 8 | Mg-FLOCC | Container | — | — | — | 6 | 6#/ton Alum |
| 1-2 | 8 | Mg-FLOCC | Container | 23.8 | 40.1 | 40.7 | 6 | 3#/ton PAC[1] |
| 1-4 | 8 | Mg-FLOCC | Container | 22.7 | 40.2 | 41.6 | 6 | 3#/ton PAC[1], 100#/ton Talc |
| 1-5 | 8 | Mg-FLOCC | Container | — | — | — | 6 | 3#/ton PAC[1] |
| 1-6 | 8 | Mg-FLOCC | Container | — | — | — | 6 | 3#/ton PAC[1] |
| 1-7 | 8 | Mg-FLOCC | Container | — | — | — | 6 | 3#/ton PAC[1] |
| 1-8 | 8 | Mg-FLOCC | Container | — | — | — | 6 | 6#/ton Alum |
| 1-9 | 8 | Mg-FLOCC | Container | — | — | — | 6 | 6#/ton Alum |
| 1-10 | 8 | Mg-FLOCC | Container | — | — | — | 6 | 6#/ton Alum |
| 2-1 | 0 | None | None | 23.2 | 40.5 | 41.2 | 4 | None |

TABLE 11-continued

| Run No | Silicate % | Mineral Type | Cure Container or Conduit | Couch Solids, % | 1st Press Solid, % | 2nd Press Solids, % | ASA lb/ton | Other Wet End Additives |
|---|---|---|---|---|---|---|---|---|
| 2-2 | 5 | Mg-FLOCC | Container | — | — | — | 4 | None |
| 2-2 | 5 | Mg-FLOCC | Container | — | — | — | 6 | None |
| 2-2 | 5 | Mg-FLOCC | Container | — | — | — | 6 | 3#/ton Protec ZA7 |
| 2-2 | 5 | Mg-FLOCC | Container | — | — | — | 6 | 6/ton Protec ZA7 |
| 2-2 | 5 | Mg-FLOCC | Container | 23.1 | 40.6 | 40.7 | 6 | 12#/ton Alum |
| 2-3 | 10 | Mg-FLOCC | Container | 22.1 | 41.0 | 41.1 | 6 | 12#/ton Alum |
| 2-6 | 10 | Mg-FLOCC | Container | — | — | — | 6 | 12#/ton Alum |
| 2-8 | 10 | Mg-FLOCC | 395' Conduit | — | — | — | 6 | 12#/ton Alum |
| 2-9 | 10 | Mg-FLOCC | 595' Conduit | 21.8 | 38.8 | 39.3 | 6 | 12#/ton Alum |
| 3-1 | 0 | None | None | 23.4 | 41.3 | 41.7 | 4 | None |
| 3-2 | 5 | Si-FLOCC | Container | 21.2 | 39.4 | 39.5 | 4 | None |
| 3-3 | 10 | Si-FLOCC | Container | — | — | — | 6 | None |
| 3-3 | 10 | Si-FLOCC | Container | 20.7 | 38.8 | 39.3 | 6 | 6#/ton Alum |
| 3-4 | 15 | Si-FLOCC | Container | 21.1 | 40.6 | 40.8 | 6 | 6#/ton Alum |
| 3-5 | 15 | Si-FLOCC | Container | — | — | — | 6 | 6#/ton Alum |
| 3-6 | 10 | Si-FLOCC | Container | — | — | — | 6 | 6#/ton Alum |
| 3-7 | 5 | Si-FLOCC | Container | — | — | — | 6 | 6#/ton Alum |
| 3-8 | 10 | Si-FLOCC | 795' Conduit | — | — | — | 6 | 6#/ton Alum |
| 3-9 | 7.5 | Si-FLOCC | 795' Conduit | 21.8 | 39.6 | 40.4 | 6 | 6#/ton Alum |
| 3-10 | 10 | Si-FLOCC | 795' Conduit | — | — | — | 6 | 6#/ton Alum |
| 3-11 | 10 | Si-FLOCC | 795' Conduit | — | — | — | 6 | 6#/ton Alum, 100#/ton $TiO_2$ |
| 4-1 | 0 | None | None | 23.0 | 40.4 | 40.7 | 4 | None |
| 4-2 | 8 | Si-FLOCC | Container | 20.9 | 38.3 | 39.5 | 6 | 6#/ton Alum, 100#/ton $TiO_2$ |
| 4-3 | 8 | Si-[2]FLOCC | Container | — | — | — | 6 | 6#/ton Alum |
| 4-4 | 8 | Si-[2]FLOCC | Container | — | — | — | 6 | 6#/ton Alum |
| 4-5 | 0 | None | None | 22.6 | 39.3 | 39.4 | 4 | 6#/ton Alum |
| 4-6 | 0 | None | None | 23.8 | 39.5 | 39.8 | 4 | 6#/ton Alum |
| 4-7 | 0 | None | None | 24.7 | 39.3 | 40.2 | 4 | 6#/ton Alum |
| 4-8 | 0 | None | None | — | — | — | 4 | 6#/ton Alum |
| 4-9 | 0 | None | None | — | — | — | 4 | 6#/ton Alum |
| 4-10 | 0 | None | None | — | — | — | 4 | 6#/ton Alum |

[1]PAC is polyaluminum chloride.
[2]Modified Si-FLOCC by addition of alum

13% PCC for Runs 1-1 through 4-4

18% PCC for Run 4-5

23% PCC for Run 4-6

28% PCC for Run 4-7

28% PCC for Run 4-8

23% PCC for Run 4-9

18% PCC for Run 4-10

The retention system used was 8 pounds/ton Idydrocol 0 and 0.4 pounds/ton Organopol 21 for all the runs.

TABLE 12

| Run No. | Conditions | HST, 70% Reflectance | HST, 85% Reflectance | Target % Filler |
|---|---|---|---|---|
| 1–1 | No Silicate-4# ASA | | 81.0 | 13 |
| 1–2 (end) | Mg-FLOCC, 3 #PAC, 6#ASA | | 1.7 | 21 |
| 1–4 | Mg-FLOCC, 5% talc added to WE, 3# PAC, 6# ASA | | 1.1 | 26 |
| 1–5 | Mg-FLOCC, 6% starch to SP, 3# PAC, 6# ASA | | 1.6 | 21+ |
| 1–6 | Mg-FLOCC, 6% starch & 0.2% Cypres 310 to SP, 3# PAC, 6# ASA | | 3.8 | 21+ |
| 1–7 | Mg- FLOCC, 6% starch, 1.7% FLOCC gel to SP, 3# PAC, 6# ASA | | 1.7 | 21+ |
| 1–8 | Mg-FLOCC, 5% starch & 1% FLOCC gel to SP, 6# alum, 6# ASA | | 1.1 | 21+ |

TABLE 12-continued

| Run No. | Conditions | HST, 70% Reflectance | HST, 85% Reflectance | Target % Filler |
|---|---|---|---|---|
| 1–9 | Mg-FLOCC, 5% starch, 1% FLOCC gel & 0.2% Cypres 310 to SP, 6# alum and ASA | | 8.6 | 21+ |
| 2–1 | Mg-FLOCC, no silicate, 4# ASA, on grade | | 108.0 | 13 |
| 2–1 | Mg-FLOCC, no silicate, 4# ASA, end of run | | 116.0 | 13 |
| 2–2 | Mg-FLOCC, 4# ASA | | 1.3 | 18 |
| 2–2 | Mg-FLOCC, 6# ASA | | 3.5 | 18 |
| 2–2 | Mg-FLOCC, 6# ASA to 2nd pot, 3# ZA7 to 1st pot | | 0.7 | 18 |
| 2–2 | Mg-FLOCC, both ASA and ZA7 to 1st pot | | 1.6 | 18 |
| 2–2 | Mg-FLOCC, same as above, but ZA7 upped to 6# | | 1.7 | 18 |
| 2–2 | Mg-FLOCC, ZA7 out, 12# alum and 6# ASA to 1st pot | | 3.8 | 18 |
| 2–2 (end) | Mg-FLOCC, same as above, end of run. 6# ASA, 12# alum | 12.4* | 4.0 | 18 |
| 2–3 | Mg-FLOCC, 6# ASA, 12# alum | 27.2* | 6.9* | 23 |
| 2–6 | Mg-FLOCC, 6% starch to SP, 6# ASA, 12# alum | | 0.6 | 23 |
| 2–8 | Mg-FLOCC, cured in 395 feet of hose, 6# ASA, 12# alum | | 0.8 | 23 |
| 2–9 | Mg-FLOCC, cured in 595 feet of hose, 6# ASA. 12# alum | | 0.6 | 23 |

TABLE 12-continued

| Run No. | Conditions | HST, 70% Reflectance | HST, 85% Reflectance | Target % Filler |
|---|---|---|---|---|
| 3–1 | No silicate. 4# ASA | | 105.0 | 13 |
| 3–1 (end) | No silicate. 4# ASA | 268.0 | 102.0 | 13 |
| 3–2 | Si-FLOCC, to stirred container, 4# ASA | 0.8 | 0.5 | 18 |
| 3–2 (end) | Si-FLOCC, to stirred container, 4# ASA | 0.6 | 0.4 | 18 |
| 3–3 | SI-FLOCC, to stirred container, 6# ASA | 1.1 | | 23 |
| 3–3 | Si-FLOCC, to stirred container, 6# ASA | 0.5 | | 23 |
| 3–3 (end) | Si-FLOCC, to stirred container, 6# ASA, 6# alum | 0.6 | | 23 |
| 3–4 | SI-FLOCC, to stirred container, 6# ASA, 6# alum | 0.2 | | 28 |
| 3–5 | Si-FLOCC, to srirred container, 6# ASA, 6# alum, SP | 0.4 | | 28 |
| 3–6 | Si-FLOCC, to stirred container, 6# ASA, 6# alum, SP | 0.7 | | 23 |
| 3–7 | Si-FLOCC, to stirred container, 6# ASA, 6# alum, SP | 18.5 | 4.0 | 18 |
| 3–8 | Si-FLOCC, cured in 795 feet of hose, hose to PM, 6# ASA & alum | 0.8 | | 23 |
| 3–9 | Si-FLOCC, cured in 795 feet of hose, hose to PM, 6# ASA & alum | 16.2 | 3.8 | 23 |
| 3–10 | Si-FLOCC, cured in 795 feet of hose, hose to PM, 6# ASA & alum | 0.4 | | 23 |
| 3–11 | Si-FLOCC, cured in 795 feet of hose, hose to PM, 6# ASA & alum, 5% $TiO_2$ in wet end | 0.6 | | 26 |
| 4–1 | No silicate, 4# ASA | 218 | 66.2 | 13 |
| 4–2 | Si-FLOCC, to stirred container, 6# ASA, 5% $TiO_2$ to WE | 0.6 | | 26 |
| 4–2 | Si-FLOCC, to stirred container, 6# ASA, 5% $TiO_2$ to WE, 6# alum | 0.5 | | 26 |
| 4–3 | Si-FLOCC, to stirred container. 6# ASA, 25% Al cure. 6# alum | 0.6 | | |
| 4–3 | Si-FLOCC, to stirred container, 6# ASA, 25% Al cure, 6# alum | 0.3 | | |
| 4–4A | Si-FLOCC, to stirred container, 6# ASA, 50% Al cure, 6# alum | 0.3 | | |
| 4–4B | Si-FLOCC to container, 6# ASA, 50% Al cure, $MgSO_4$-WE, no alum | 0.4 | | |
| 4–5 | No silicate, 4# ASA, 6# alum | 370 | 118 | 18 |
| 4–6 | No silicate, 4# ASA, 6# alum | 139 | | 23 |

TABLE 12-continued

| Run No. | Conditions | HST, 70% Reflectance | HST, 85% Reflectance | Target % Filler |
|---|---|---|---|---|
| 4–7 | No silicate, 4# ASA, 6# alum | 51.8 | | 28 |
| 4–8 | No silicate, 4# ASA, 6# alum, starch to SP | 247 | | 28 |
| 4–9 | No silicate, 4# ASA, 6# alum, starch to SP | 388 | | 23 |
| 4–10 | No silicate, 4# ASA, 6# alum, starch to SP | 248 | | 18 |

[1]PAC is polyaluminum chloride.
*Tested about 20 hours after run was completed.

In an effort to improve the properties of paper made according to this example, additives were added at the size press. These additives, and the size press pickup, are summarized below in Table 13.

TABLE 13

| Run No. | Size Press Pickup | Size Press Additives, #/Ton |
|---|---|---|
| 1–5 | 64 | 6% Ethylex 2040 (starch) |
| 1–6 | 88 | 6% Ethylex 2040 (starch); 0.2% Cypres 310 (size agent) |
| 1–7 | n/a | 6% Ethylex 2040 (starch); 1.68% Mg-FLOCC (gel) |
| 1–8 | n/a | 5% Ethylex 2040 (starch); 1% Mg-FLOCC |
| 1–9 | n/a | 5% Ethylex 2040 (starch); 1% Mg-FLOCC; 0.2% Cypres 310 (surface size) |
| 1–10 | n/a | 6% Ethylex 2040 (starch); 1.68% Mg-FLOCC (no gel) |
| 2–6 | 72 | 6% Ethylex 2040 (starch) |
| 3–5 | n/a | 6% Ethylex 2040 (starch) |
| 3–6 | 73 | 6% Ethylex 2040 (starch) |
| 3–7 | 79 | 6% Ethylex 2040 (starch) |
| 4–8 | 85 | 6% Ethylex 2040 (starch) |
| 4–9 | 61 | 6% Ethylex 2040 (starch) |
| 4–10 | 85 | 6% Ethylex 2040 (starch) |

The following Table 14 summarizes the physical properties of paper products made as described above in Example 13.

TABLE 14

| | | | | | | | Breaking | | Breaking | | |
|---|---|---|---|---|---|---|---|---|---|---|---|
| Run No. | Ash % | Weight g/m$^2$ | Caliper mils | Bulk cc/g | HST sec. | Tensile md lbs/inch | Length md meters | Tensile cd lbs/inch | Length cd meters | TEA md ft-lb/ft$^2$ | TEA cd ft-lb/ft$^2$ |
| 1-1 | 14.48 | 78.40 | 4.79 | 1.55 | 124 | 14.36 | 3272 | 7.80 | 1777 | 1.39 | 1.53 |
| 1-2 | 16.87 | 75.40 | 4.48 | 1.51 | 2 | 14.94 | 3539 | 7.58 | 1796 | 1.36 | 1.66 |
| 1-3 | 21.42 | 75.55 | 4.51 | 1.52 | 0 | 13.78 | 3258 | 6.80 | 1608 | 1.23 | 1.43 |
| 1-4 | 21.28 | 73.00 | 4.26 | 1.48 | 0 | 13.20 | 3230 | 6.72 | 1644 | 1.66 | 1.65 |
| 1-5 | 19.22 | 75.32 | 4.03 | 1.36 | 2 | 18.48 | 4382 | 9.14 | 2167 | 2.52 | 3.06 |
| 1-6 | 19.56 | 73.82 | 3.96 | 1.36 | 7 | 17.78 | 4302 | 8.62 | 2086 | 2.06 | 2.82 |
| 1-7 | 21.15 | 77.58 | 4.09 | 1.34 | 1 | 16.12 | 3711 | 8.00 | 1842 | 1.79 | 2.30 |
| 1-8 | 21.46 | 76.53 | 4.10 | 1.36 | 0 | 16.90 | 3944 | 8.00 | 1867 | 2.05 | 2.40 |
| 1-9 | 22.58 | 77.43 | 4.10 | 1.34 | 10 | 17.30 | 3991 | 7.64 | 1762 | 2.29 | 2.34 |
| 2-1 | 15.28 | 72.42 | 4.71 | 1.65 | 190 | 12.70 | 3132 | 6.50 | 1603 | 1.17 | 1.28 |
| 2-2 | 19.17 | 73.43 | 4.43 | 1.53 | 6 | 15.10 | 3673 | 7.60 | 1849 | 1.55 | 1.92 |
| 2-3 | 22.12 | 75.10 | 4.45 | 1.51 | 15 | 14.70 | 3496 | 7.30 | 1736 | 1.56 | 1.88 |
| 2-6 | 22.35 | 73.56 | 4.06 | 1.40 | 0 | 18.80 | 4565 | 8.80 | 2137 | 2.25 | 2.47 |
| 2-8 | 16.99 | 73.47 | 4.32 | 1.49 | 2 | 16.10 | 3914 | 7.70 | 1872 | 1.74 | 1.78 |
| 2-9 | 21.62 | 80.59 | 4.46 | 1.41 | 0 | 15.00 | 3325 | 7.50 | 1662 | 1.80 | 2.24 |
| 3-1 | 13.87 | 72.55 | 4.88 | 1.71 | 190 | 12.30 | 3028 | 6.60 | 1625 | 0.69 | 1.11 |
| 3-2 | 19.74 | 76.75 | 4.71 | 1.56 | 0 | 14.50 | 3375 | 6.70 | 1559 | 1.20 | 1.45 |

TABLE 14-continued

| | | | | | | | | | | | |
|---|---|---|---|---|---|---|---|---|---|---|---|
| 3-3 | 22.87 | 69.92 | 4.20 | 1.53 | 0 | 12.60 | 3219 | 6.20 | 1584 | 1.23 | 1.61 |
| 3-4 | 24.33 | 70.82 | 4.31 | 1.55 | 0 | 14.00 | 3531 | 6.50 | 1639 | 1.35 | 1.62 |
| 3-5 | 22.81 | 67.96 | 3.92 | 1.47 | 0 | 16.50 | 4337 | 6.80 | 1787 | 1.83 | 1.91 |
| 3-6 | 23.51 | 73.07 | 4.12 | 1.43 | 0 | 18.50 | 4522 | 8.30 | 2029 | 2.22 | 2.84 |
| 3-7 | 20.44 | 74.57 | 4.39 | 1.50 | 6 | 18.50 | 4431 | 9.10 | 2180 | 2.61 | 3.03 |
| 3-8 | 16.57 | 72.32 | 4.60 | 1.62 | 0 | 12.30 | 3038 | 6.90 | 1704 | 1.12 | 1.29 |
| 3-9 | 19.92 | 73.53 | 4.64 | 1.60 | 5 | 12.40 | 3012 | 6.50 | 1579 | 1.28 | 1.00 |
| 3-10 | 17.48 | 73.60 | 4.69 | 1.62 | 0 | 12.90 | 3131 | 7.00 | 1699 | 1.17 | 1.48 |
| 3-11 | 23.92 | 79.05 | 4.58 | 1.47 | 0 | 12.50 | 2824 | 6.40 | 1446 | 0.97 | 1.13 |
| 4-1 | 15.77 | 69.76 | 4.74 | 1.73 | 142 | 12.80 | 3277 | 6.00 | 1536 | 1.14 | 0.96 |
| 4-2 | 29.87 | 74.16 | 4.37 | 1.50 | 0 | 10.80 | 2601 | 5.30 | 1277 | 1.26 | 1.46 |
| 4-3 | 22.74 | 75.46 | 4.48 | 1.51 | 0 | 14.30 | 3385 | 5.90 | 1397 | 1.66 | 1.40 |
| 4-4A | 22.13 | 73.76 | 4.43 | 1.53 | 0 | 14.70 | 3560 | 6.10 | 1477 | 1.79 | 1.74 |
| 4-4B | 23.14 | 75.79 | 4.33 | 1.45 | 0 | 15.20 | 3582 | 6.12 | 1442 | 1.89 | 1.75 |
| 4-5 | 20.28 | 75.82 | 4.77 | 1.60 | 199 | 9.90 | 2332 | 5.18 | 1220 | 0.63 | 0.71 |
| 4-6 | 25.08 | 74.98 | 4.39 | 1.49 | 119 | 8.00 | 1906 | 4.74 | 1129 | 0.62 | 0.78 |
| 4-7 | 29.97 | 68.72 | 4.23 | 1.56 | 54 | 6.90 | 1793 | 3.32 | 863 | 0.45 | 0.38 |
| 4-8 | 29.68 | 68.77 | 3.91 | 1.44 | 158 | 9.56 | 2483 | 4.40 | 1143 | 0.81 | 0.62 |
| 4-9 | 24.41 | 74.18 | 4.18 | 1.43 | 291 | 11.30 | 2721 | 5.90 | 1421 | 1.09 | 1.10 |
| 4-10 | 18.47 | 77.27 | 4.42 | 1.45 | 225 | 16.20 | 3745 | 7.84 | 1812 | 1.57 | 1.73 |

| Run | Rewet Tensile md | Rewet Breaking Length | Gurley Stiffness md | Gurley Stiffness | Gurley Porosity | Opacity | ISO Brightness cd | M/K Formation | Needle Abrasion |
|---|---|---|---|---|---|---|---|---|---|
| No. | grams | meters | mgs. | mgs. | sec. | % | % | index | mcgs. |
| 1-1 | 394 | 197.9 | 154.1 | 74.6 | 4.1 | 89.2 | 88.9 | 14.9 | |
| 1-2 | 690 | 360.4 | 151.4 | 73.0 | 4.1 | 88.7 | 89.0 | 26.5 | 169 |
| 1-3 | 696 | 362.8 | 140.3 | 64.2 | 4.9 | 90.7 | 85.1 | 29.6 | |
| 1-4 | 720 | 388.4 | 123.6 | 60.2 | 5.3 | 89.4 | 88.4 | 20.8 | |
| 1-5 | 764 | 399.4 | 137.0 | 60.2 | 4.4 | 87.7 | 88.7 | 26.6 | |
| 1-6 | 728 | 388.3 | 112.6 | 63.5 | 3.9 | 87.5 | 88.8 | 18.6 | |
| 1-7 | 688 | 349.2 | 132.3 | 64.4 | 3.8 | 88.6 | 89.2 | 13.5 | |
| 1-8 | 702 | 361.2 | 131.0 | 64.8 | 3.7 | 88.4 | 89.1 | 15.1 | |
| 1-9 | 676 | 343.8 | 132.5 | 62.8 | 4.5 | 86.8 | 88.9 | 17.9 | |
| 2-1 | 357 | 194.1 | 141.3 | 60.8 | 3.2 | 88.8 | 89.3 | 16.8 | |
| 2-2 | 613 | 328.7 | 117.2 | 67.0 | 3.7 | 88.3 | 89.2 | 22.9 | |
| 2-3 | 592 | 310.4 | 131.0 | 65.0 | 4.3 | 88.7 | 89.1 | 27.3 | |
| 2-6 | 769 | 411.7 | 144.3 | 72.4 | 4.4 | 87.3 | 88.5 | 27.3 | |
| 2-8 | 762 | 408.4 | 122.8 | 63.5 | 4.4 | 88.1 | 88.7 | 15.6 | |
| 2-9 | 865 | 422.7 | 141.0 | 65.5 | 6.2 | 88.2 | 88.8 | 22.1 | |
| 3-1 | 335 | 181.8 | 152.3 | 71.4 | 3.0 | 88.7 | 88.7 | 8.9 | |
| 3-2 | 484 | 248.3 | 142.8 | 60.7 | 3.0 | 87.9 | 89.0 | 16.7 | |
| 3-3 | 655 | 368.9 | 96.0 | 49.4 | 3.1 | 86.9 | 88.8 | 12.7 | 157 |
| 3-4 | 681 | 378.7 | 119.0 | 57.5 | 3.5 | 87.9 | 89.1 | 14.4 | |
| 3-5 | 592 | 343.0 | 103.8 | 58.8 | 2.1 | 86.3 | 88.7 | 11.2 | |
| 3-6 | 628 | 338.4 | 129.3 | 68.3 | 3.0 | 87.5 | 88.9 | 20.7 | |
| 3-7 | 555 | 293.1 | 150.0 | 70.1 | 3.2 | 88.0 | 89.0 | 15.1 | |
| 3-8 | 678 | 369.2 | 136.2 | 72.0 | 2.4 | 87.9 | 89.1 | 9.4 | |
| 3-9 | 576 | 308.5 | 142.8 | 73.4 | 2.5 | 87.8 | 89.2 | 12.8 | |
| 3-10 | 678 | 362.7 | 118.8 | 61.1 | 2.4 | 88.3 | 89.0 | 9.0 | |
| 3-11 | 667 | 332.3 | 109.0 | 64.0 | 2.8 | 92.0 | 90.4 | 8.9 | 143 |
| 4-1 | 303 | 171.0 | 131.4 | 62.4 | 2.6 | 87.7 | 89.0 | 11.2 | 82 |
| 4-2 | 662 | 351.5 | 101.4 | 37.5 | 4.5 | 91.0 | 90.2 | 14.8 | 200 |
| 4-3 | 680 | 354.8 | 122.8 | 63.5 | 2.8 | 87.6 | 89.1 | 16.0 | |
| 4-4A | 798 | 426.0 | 108.8 | 49.9 | 3.5 | 87.3 | 89.3 | 17.9 | 140 |
| 4-4B | 815 | 423.4 | 107.2 | 56.2 | 3.8 | 87.3 | 89.3 | 17.0 | |
| 4-5 | 316 | 164.1 | 128.5 | 63.5 | 2.4 | 89.8 | 89.8 | 7.7 | |
| 4-6 | 305 | 160.2 | 108.8 | 51.5 | 3.5 | 91.9 | 90.6 | 15.1 | |
| 4-7 | 240 | 137.5 | 73.5 | 34.2 | 4.5 | 92.0 | 90.8 | 15.6 | |
| 4-8 | 231 | 132.3 | 95.0 | 33.5 | 3.9 | 91.4 | 90.5 | 20.7 | |
| 4-9 | 254 | 134.8 | 112.1 | 59.5 | 3.3 | 89.5 | 90.3 | 13.7 | |
| 4-10 | 284 | 144.7 | 134.1 | 63.5 | 3.9 | 89.1 | 89.4 | 17.9 | |

Figure 32:
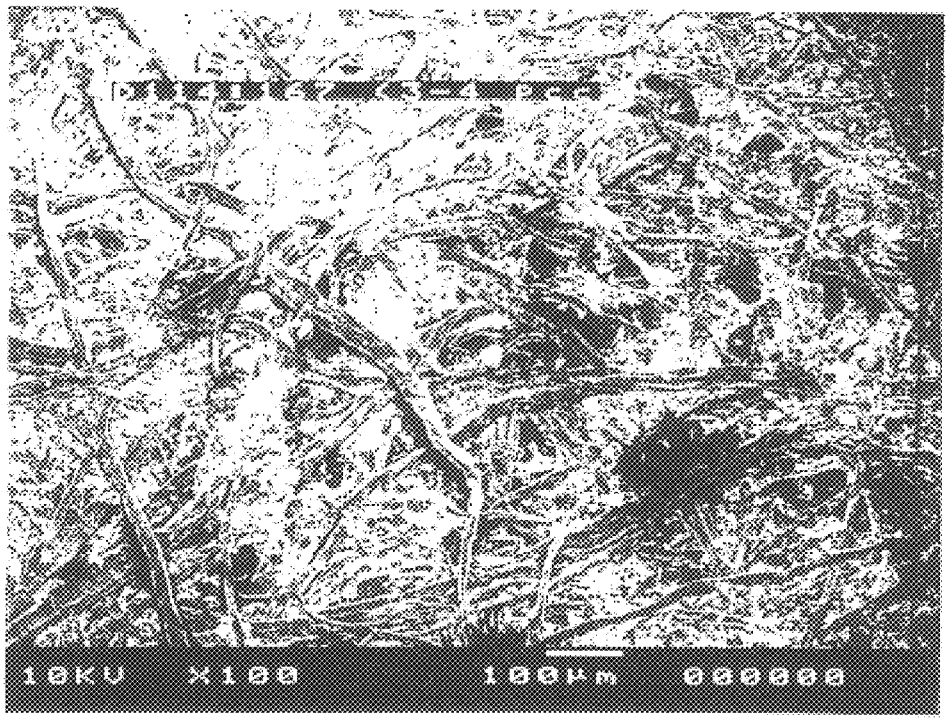
FIG. 32 is an SEM image (×100) of a Si-FLOCC pilot-scale paper machine paper having PCC filler.
Figure 33:
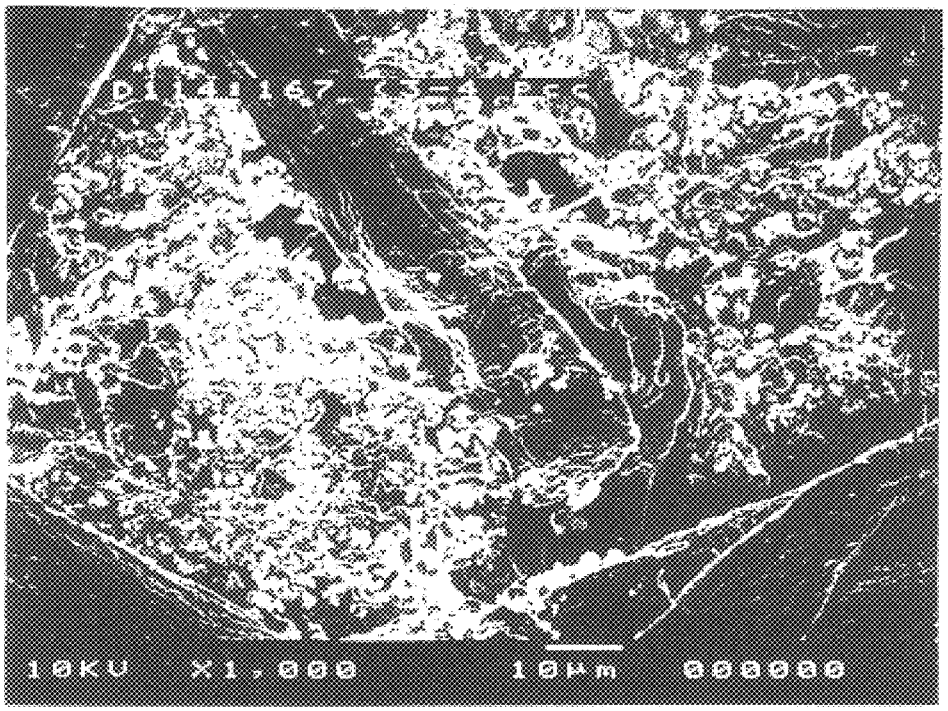
FIG. 33 is an SEM image (×1000) of a Si-FLOCC pilot-scale paper machine paper having PCC filler.

Si-FLOCC, Mg-FLOCC and Ca-FLOCC papers will likely be made with additional filler, such as PCC and the other fillers described above. FIGS. 32 and 33 are SEMS of paper made on paper machines showing Si-FLOCC paper have PCC filler.

Figure 34:
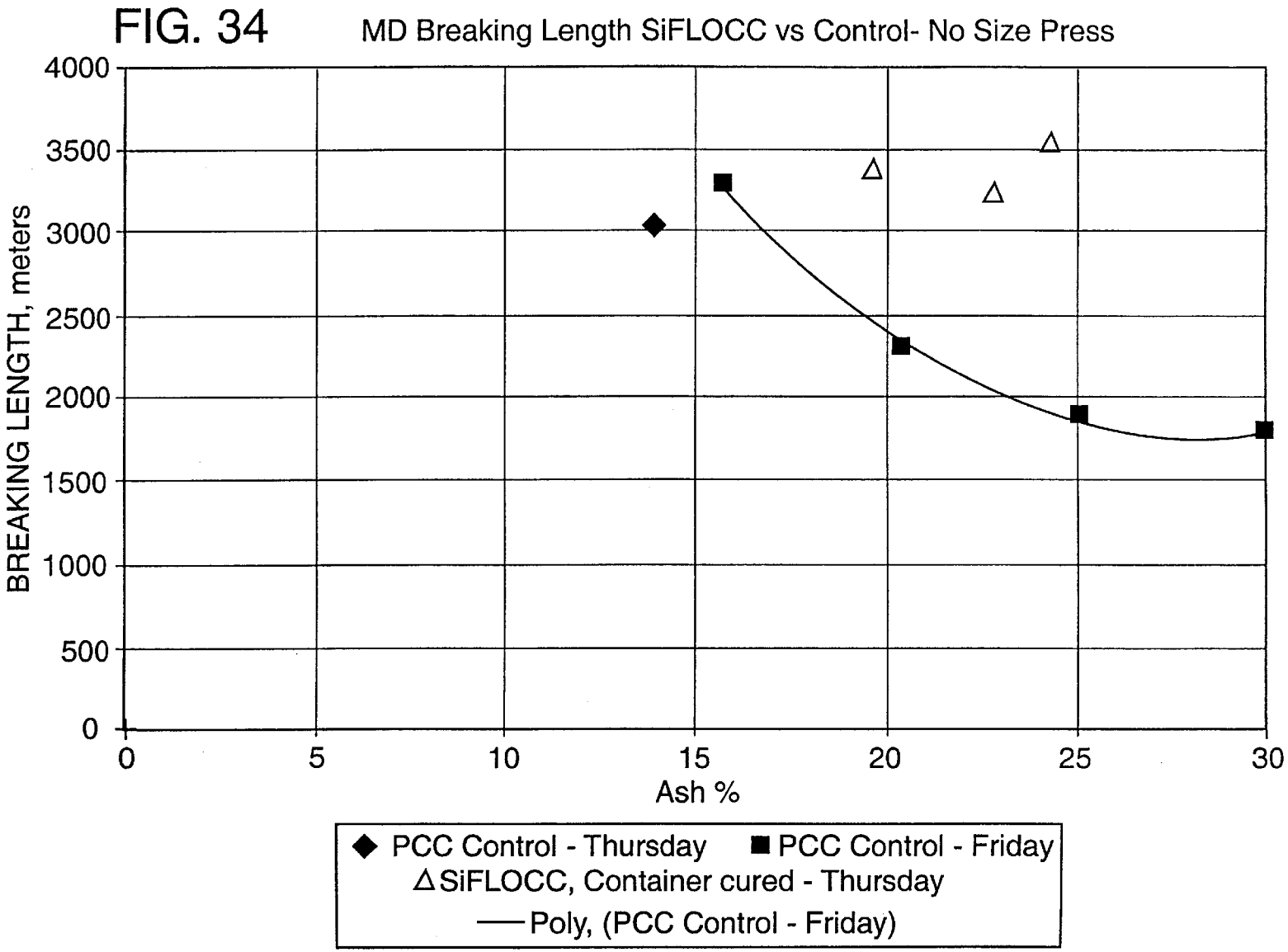
FIG. 34 is a graph of the percent ash content versus machine direction breaking length for S-FLOCC paper.
Figure 35:
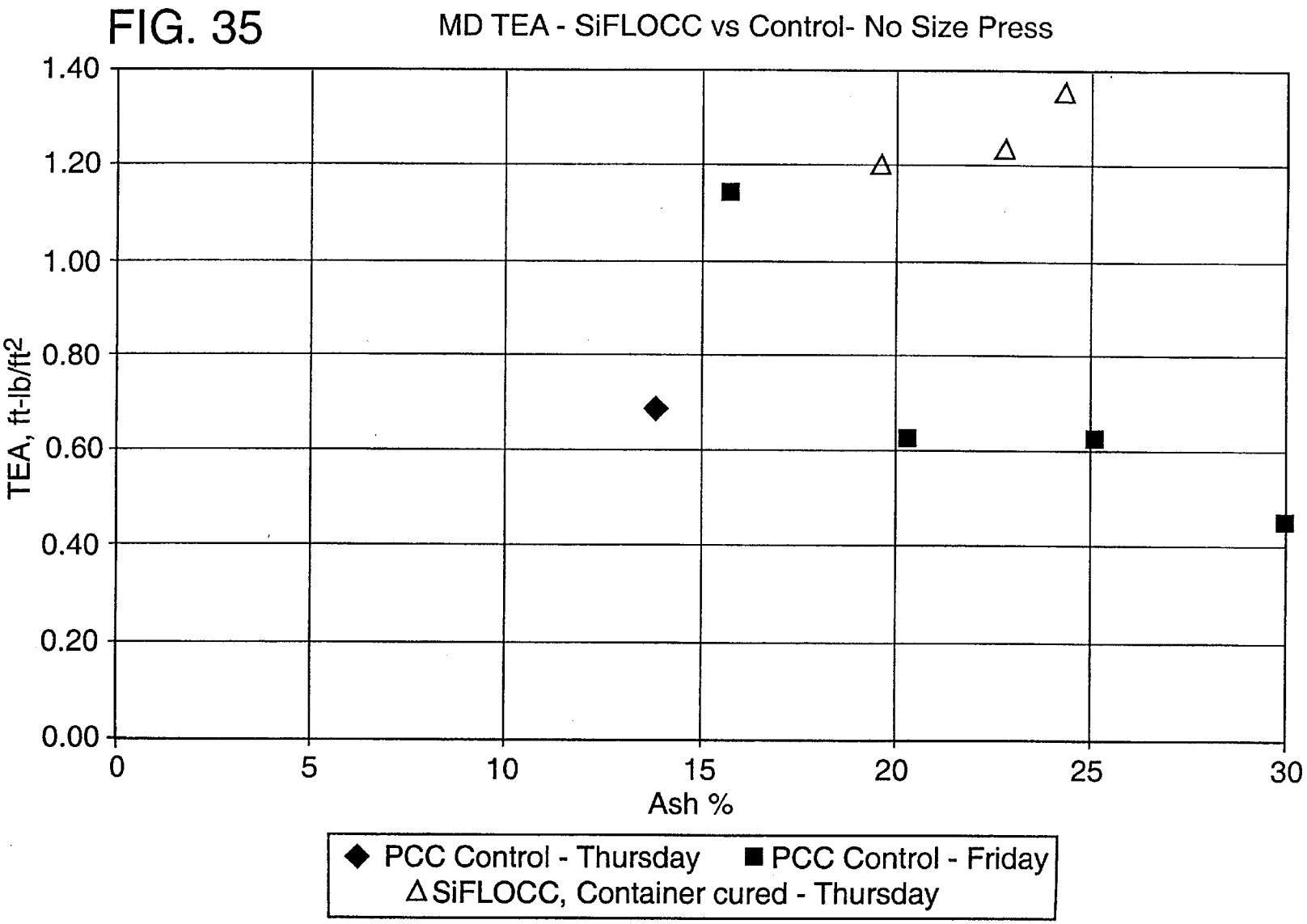
FIG. 35 is a graph of the percent ash content versus machine direction tensile energy absorbance for Si-FLOCC paper.
Figure 36:
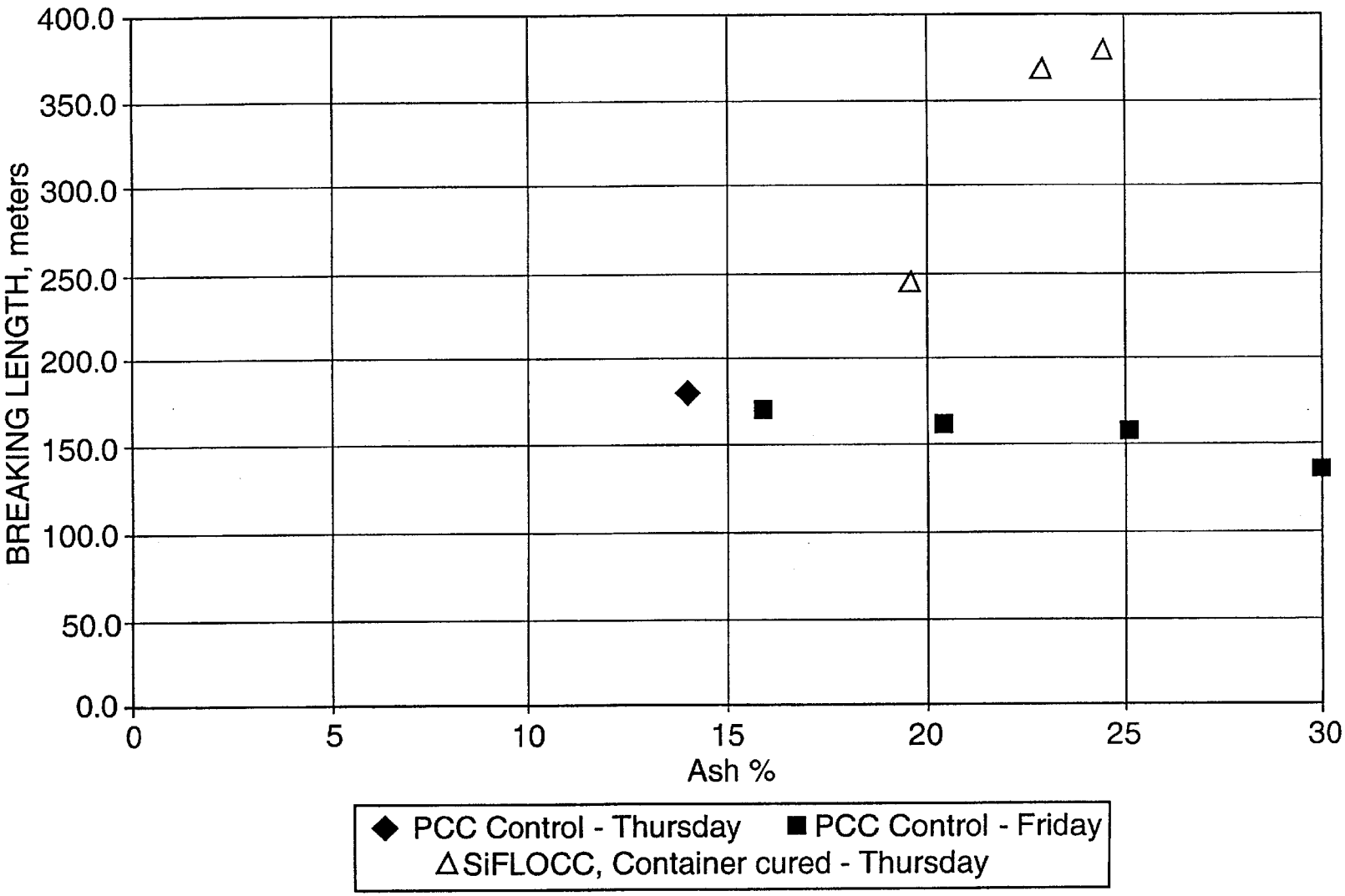
FIG. 36 is a graph of the percent ash content machine direction breaking length of a rewetted sheet.

Papers made with a continues apparatus where equivalent or better than previous trial papers on the piolet skill paper machine. The results of these pilot paper trials are illustrated in FIGS. 34–36.

Figure 37:
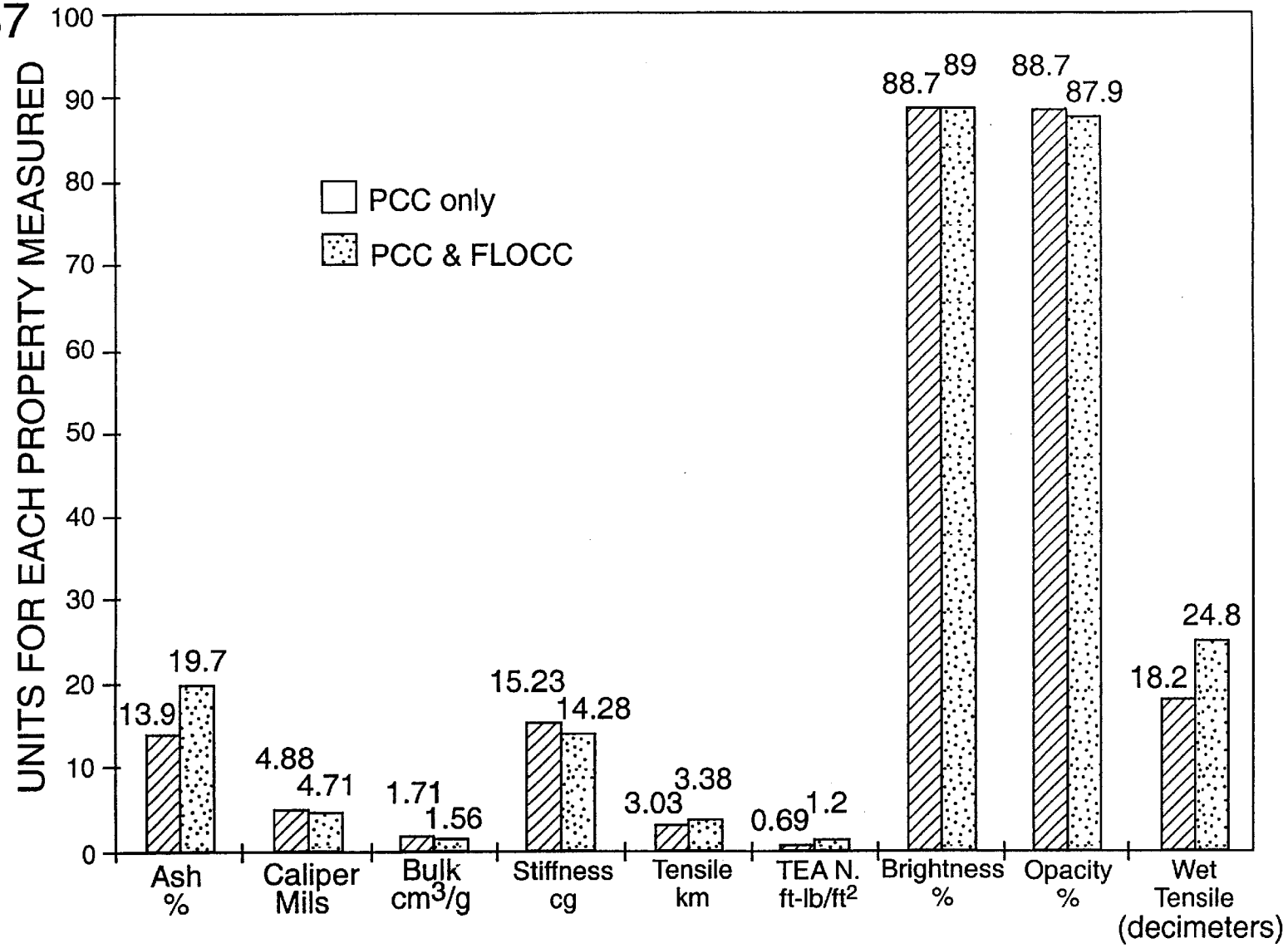
FIG. 37 is a bar graph illustrating paper properties of a PCC pilot-scale paper machine paper versus a Si-FLOCC pilot-scale paper machine paper at different ash content.
Figure 38:
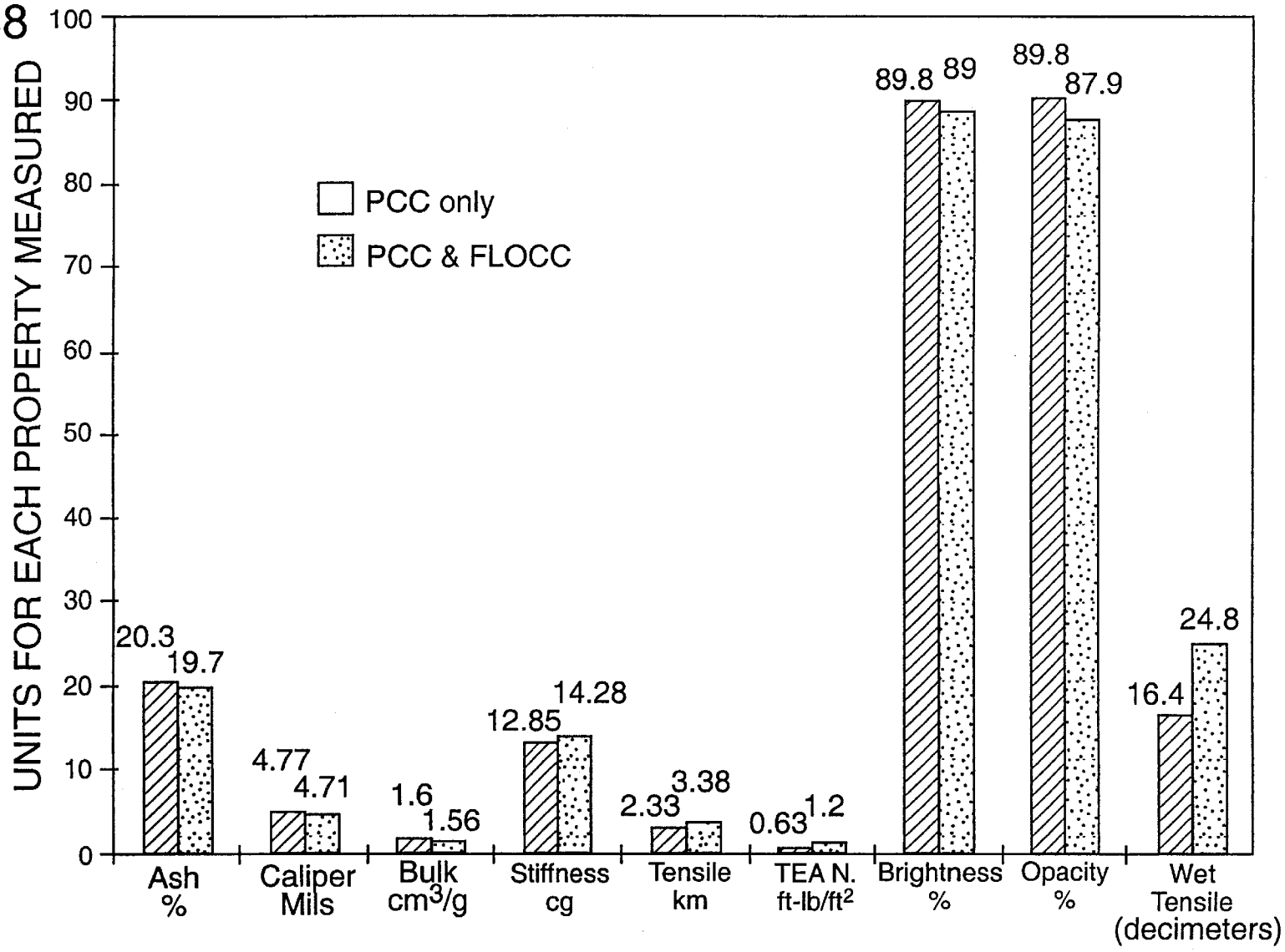
FIG. 38 is a bar graph illustrating paper properties of a PCC pilot-scale paper machine paper versus a Si-FLOCC pilot-scale paper machine paper at equivalent ash content.
Figure 39:
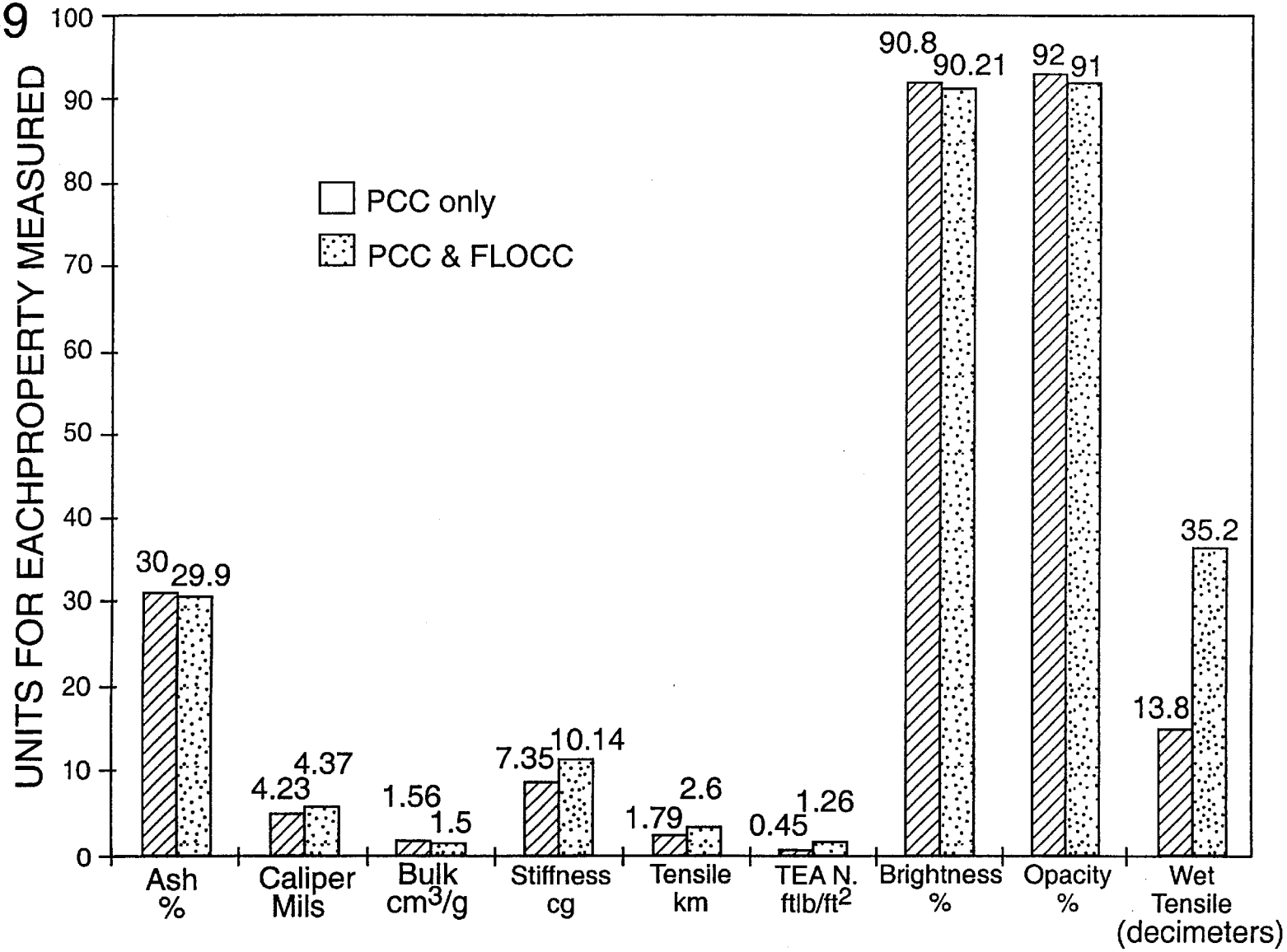
FIG. 39 is a bar graph illustrating paper properties of a PCC pilot-scale paper machine paper versus a Si-FLOCC pilot-scale paper machine paper having PCC and titanium dioxide at equivalent ash content.

Comparison of paper properties of a PCC-only paper to PCC and Si-FLOCC paper is illustrated in FIG. 37. This comparison is from Run 3-1, Table 10 (PCC-only) and the next Run 3-2 is PCC and Si-FLOCC. As shown, the properties of the FLOCC paper is equivalent to or better than the PCC-only paper at lower ash content. A better comparison is illustrated in FIG. 38 where equivalent ash papers are compared from Run 4-5 (PCC-only) to Run 3-2 (PCC and Si-FLOCC). FIG. 39 is a comparison of a PCC-only paper (Run 4-7) to a PCC, titanium dioxide and FLOCC paper (Run 4-2) which also illustrates the improved paper products.

Example 13

This example concerns further pilot paper machine trials conducted on the pilot paper machine at Western Michigan University in Kalamazoo. All the compositions and chemicals used to make the Si-FLOCC paperes were the same as stated above. In this example, the basis weight of the Si-FLOCC and control paper was 36 g/m$^2$, whereas the basis weight of the paper made on the pilot-scale paper machine as described above in the examples had a basis weight of 75 g/m$^2$. An attempt to make control paper using 75% hardwood/25% softwood and having 18% PCC filler, 2% $TiO_2$, 0.4 pounds/ton Organopol 21, 8 pounds/ton Hydrocol 0,) and 4 pounds/ton ASA size, but this material would not run on the paper machine. 5% of the PCC was then replaced with 5% of the Si-FLOCC composition, leaving a total of 13% PCC. This was successfully run on the paper machine. The paper-making process was much more efficient with the Si-FLOCC paper. The Si-FLOCC paper broke less often than the control, and also had better release properties. In the first press roll, control paper stuck to the roll. The Si-FLOCC papers had noticeably better press roll release properties. A significant reducton in material stuck to the roll was evident by the reduction in material doctored from the press roll while making Si-FLOCC paper.

Si-FLOCC paper also was made by increasing the $TiO_2$ to 6.5%. This Si-FLOCC paper had both a TAPPI opacity and an ISO brightness of from 83% to about 85%.

Example 14

Figure 1:
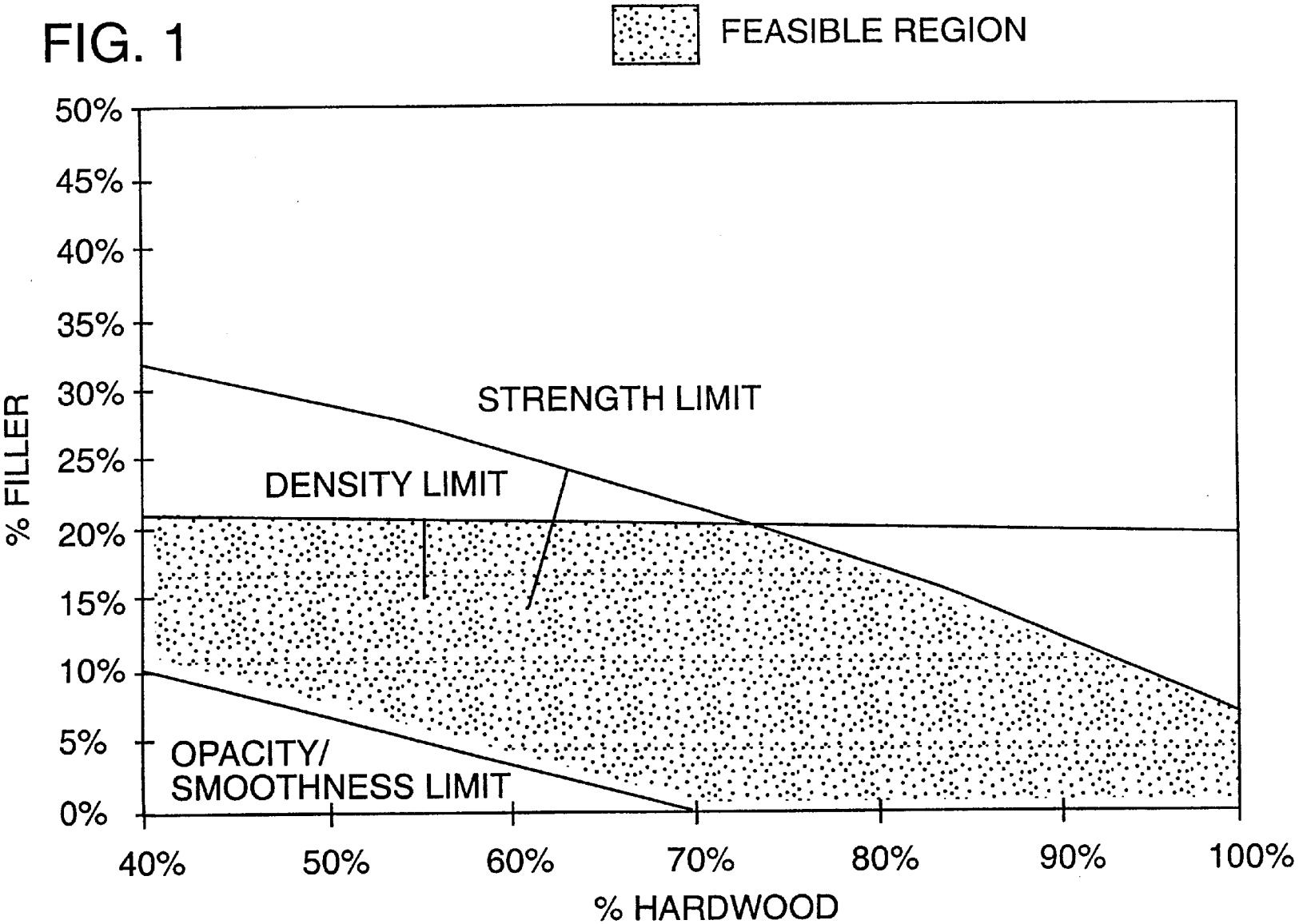
FIG. 1 is a generalized graph of percent hardwood versus filler content which illustrates practical filler amount limits for cellulosic products made using methods developed prior to the present invention.
Figure 2:
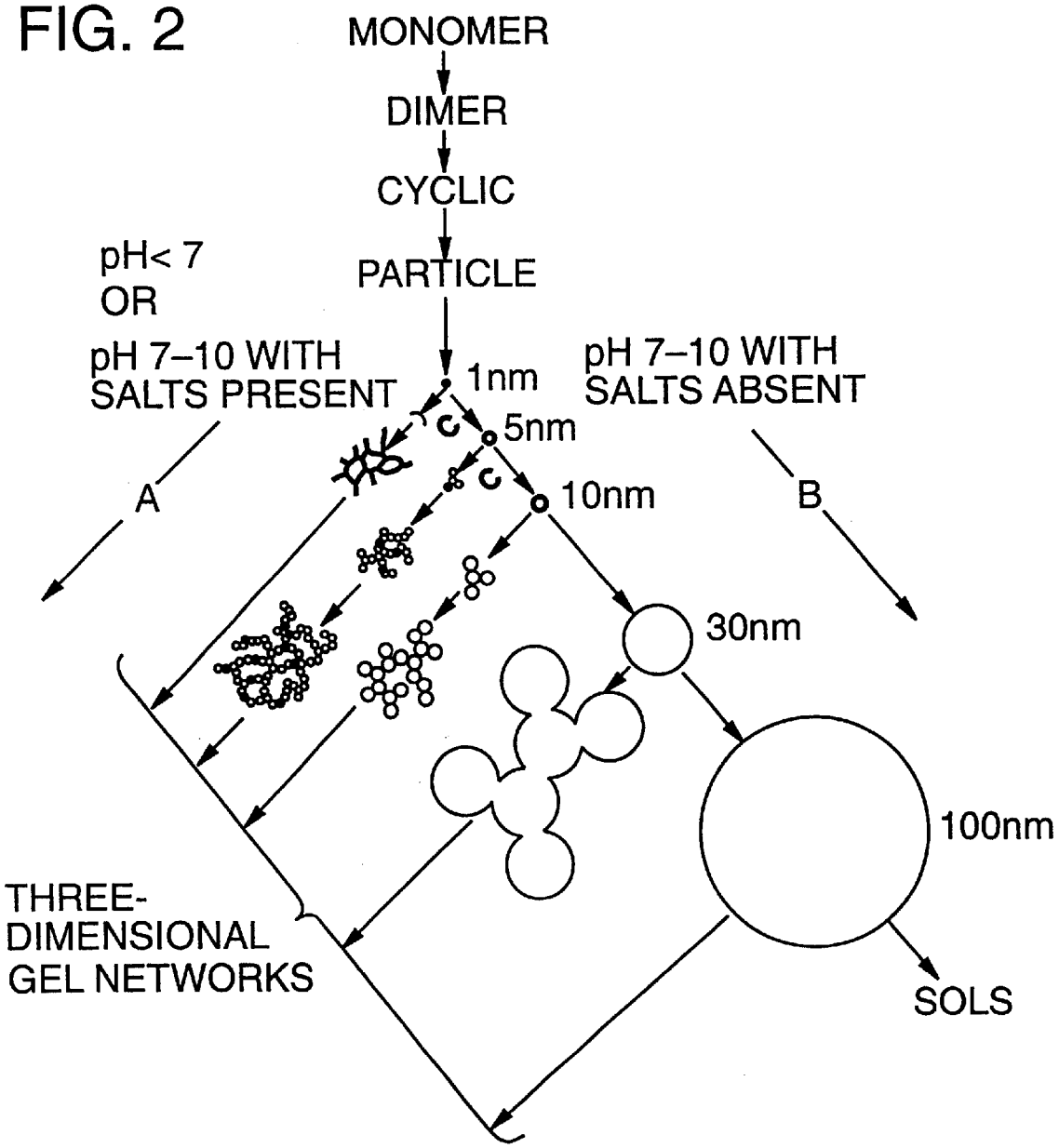
FIG. 2 illustrates process of silica polymerization.
Figure 3:
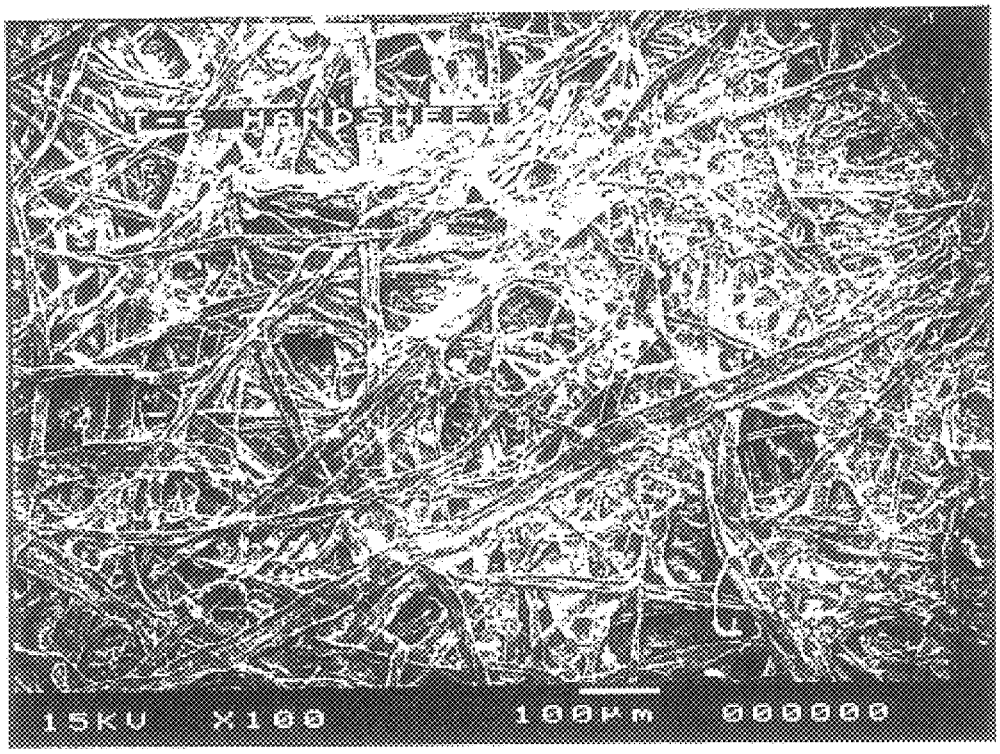
FIG. 3 is an SEM image (×100) of a handsheet made in accordance with Ca-FLOCC method of the present invention.

This example describes a method for processing pea starch to produce starch granules of a suitable size within a particular granule size distribution so that the processed starch is ready for subsequent use in the flocculation of filler particles. A photomicrograph of the pea starch prior to processing is provided by FIG. 2. This should be compared to FIG. 3, which is a photomicrograph of the starch after being processed as described in this example. The processing clearly changes the physical characteristics of the starch to that of discrete readily discernible granules. The size distribution of the granules produced is fairly narrow, although the granules do not have entirely regular shapes.

770 grams of cold water were added to a one-liter jacketed vessel. 55 grams of Parrheim's STARLITE pea starch were added to the water with agitation. The starch-water dispersion was stirred until the starch was substantially dispersed, and the dispersion was then heated to 85–90° C. The dispersion was maintained within this temperature range for 5 minutes. The dispersion was then allowed to cool to 70° C.

Example 15

This example describes a method for processing potato starch to produce starch granules of an average granule size suitable for subsequent use in the flocculation of filler particles.

770 grams of cold water were added to a one-liter jacketed vessel. 55 grams of bud potato starch were added to the water with agitation. The starch-water dispersion was stirred until the starch was substantially dispersed, and the dispersion was then heated to 85–90° C. The dispersion was maintained within this temperature range for 5 minutes. The dispersion was then allowed to cool to 70° C.

Starch granules other than pea and potato granules have been made in manners substantially similar to that described above in Examples 1 and 2.

Example 16

Figure 4:
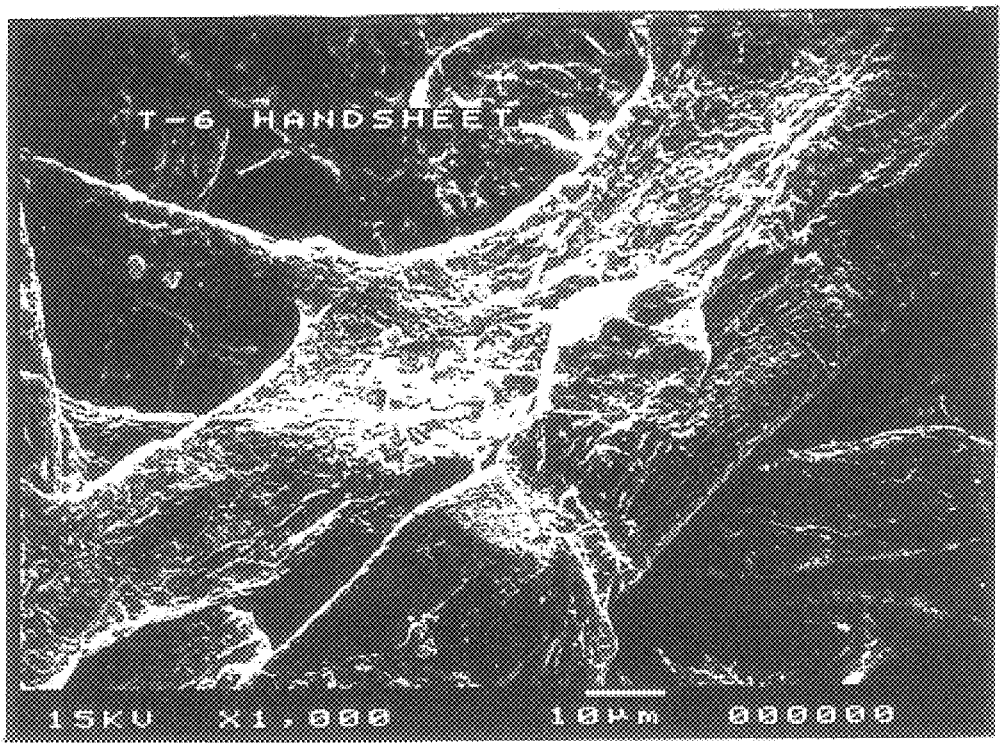
FIG. 4 is an SEM image (×1000) of a Ca-FLOCC handsheet.
Figure 5:
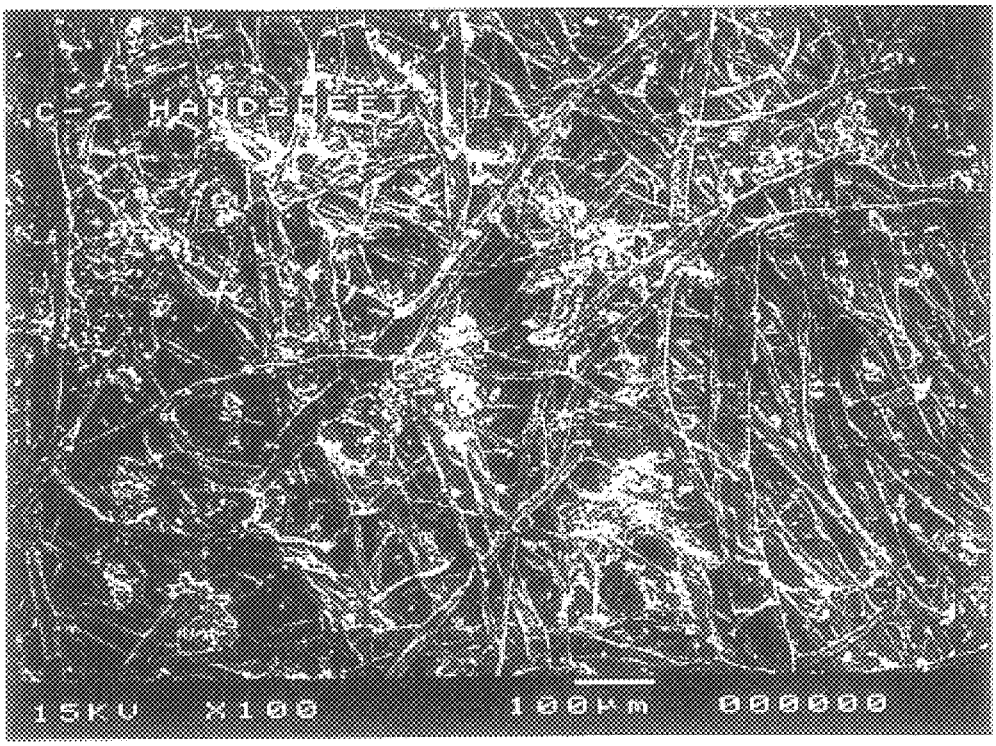
FIG. 5 is an SEM image (×100) of a handsheet having PCC made according to a conventional method developed prior to the present invention.

This example describes a method for flocculating PCC particles using pea starch processed as described in Example 1. The photomicrograph of FIG. 4 illustrates how filler particles flocculate to the pea starch granules when processed as described in this example, and the pea starch granules act as filler particle binders. Further, the size of the flocs is determined by the size of the starch granules, and not by further processing steps, such as subjecting flocs to high shear forces.

The ratio of PCC to pea starch for this example was 18:1. A 6 weight-percent aqueous starch dispersion was produced according to Example 1. 46.2 grams of this cooked pea starch was placed in a 200 milliliter beaker. 46.2 grams of deionized warm (50° C.–70° C.) water were added to the beaker with stirring to form an aqueous dispersion having a weight consistency of 3%. 0.28 gram of polyaluminum chloride, obtained from Rasio Chemical, was then added to the beaker with continued vigorous stirring to cationize the dispersion.

250 grams of a 20% aqueous PCC slurry were added to a 600 milliliter beaker. 83 grams of warm deionized water (50° C.–70° C.) were added to the beaker with stirring using a mechanical stirrer. The stirring rate was then increased. The polyaluminum chloride-starch dispersion was then added to the beaker quickly with vigorous stirring. The vigorous agitation was continued for 10 seconds. This mixing step also has been performed using a blender. After mixing and vigorous agitation, the preflocculated PCC was ready for use in making handsheets.

Example 17

This example describes a method for flocculating PCC particles using potato starch processed as described in Example 2.

The ratio of PCC to potato starch for this example was 18:1. A 6 weight-percent aqueous starch dispersion was produced according to Example 1. 46.2 grams of this cooked pea starch were placed in a 200 milliliter beaker. 46.2 grams of deionized warm (50° C.–70° C.) water were added to the beaker with stirring to form an aqueous dispersion having a weight consistency of 3%. 0.28 gram of polyaluminum chloride, obtained from Rasio Chemical, was then added to the beaker with continued vigorous stirring to cationize the dispersion.

250 grams of a 20% aqueous PCC slurry were added to a 600 milliliter beaker. 83 grams of warm deionized water (50° C.–70° C.) were added to the beaker with stirring using a mechanical stirrer. The stirring rate was then increased. The polyaluminum chloride-starch dispersion was then added to the beaker quickly with vigorous stirring. The vigorous agitation was continued for 10 seconds. This mixing step also has been performed using a blender. After mixing and vigorous agitation, the preflocculated PCC was ready for use in making handsheets.

Example 18

This example describes methods for making handsheets using preflocculated filler granules preflocculated as described above in Examples 3 and 4.

Handsheets were made with furnish containing 50% bleached kraft hardwood pulp, and 50% bleached kraft softwood pulp. The pulps were separately refined to 560 Canadian Standard Freeness (CSF) with a disk refiner. Filler was added in the pulp ranging from 15 to 50% of the total furnish (i.e., total amount of pulp and filler). Additives were applied to the furnish, including 10 lbs/ton of Stalok cationic starch, 0.5 pounds/ton Hydrocol 875 cationic polyacrylamide and 2 pounds/ton of Hydrocol 2D5 anionic Bentonite. The handsheets were targeted for 1.32 g/sheet, which is equivalent to 66 g/m$^2$.

Handsheets were made using a standard circular handsheet apparatus. Stirring, forming and couching were preformed according to TAPPI specifications T 205 OM-88. Pressing and drying were not done according to the TAPPI specifications. Instead, pressing was done in a platen air press with a 1 foot diameter cylinder at 82 psi.

Pre wet and pressed standard blotters stacked five sheets were used on the under side of the handsheet and topped by a polished stainless steel plate for 5 minutes. Pressing transferred the handsheet to the plate which was placed over a 90° C. hot water bath until dry. The dry handsheets were placed in a CTH room over night for physical properties testing. All handsheets were tested according to TAPPI testing procedures T 220 OM-88.

Handsheets were made with 50/50 hardwood/softwood fiber furnish. The furnish was combined with PCC to form sheets having 15%, 20%, 30%, 40% and 50% filler content. Control handsheets were made using a PCC slurry. Cationic and anionic materials were used to make the control handsheets, as is conventional technology. 10 pounds/ton of Stalok 180 cationic starch, 0.5 pounds of Hydrocol 875 (cationic polymer) and 2 pounds/ton of Hydrocol 2D5 (anionic Bentonite) were used to make the control handsheets.

No cationic starch was used to make the handsheets incorporating preflocculated fillers produced according to the method of the present invention. The retention agents were the same however, 0.5 pounds of Hydrocol 875 and 2 pounds/ton of Hydrocol 2D5.

FIG. 6 illustrates how tensile strength in pounds/inch of a control handsheet made using PCC and a handsheet made according to this example vary with increasing ash content. While the tensile strength of both handsheets decreased with increasing ash content, the handsheets made according to this example had overall better tensile strength than the control. Moreover, FIG. 6 shows that the tensile strength of the control had a tensile strength of about 8 at an ash content of about 15%, whereas the handsheet made according to the present example had the same tensile strength at an ash content of between 25–30%.

Figure 7:
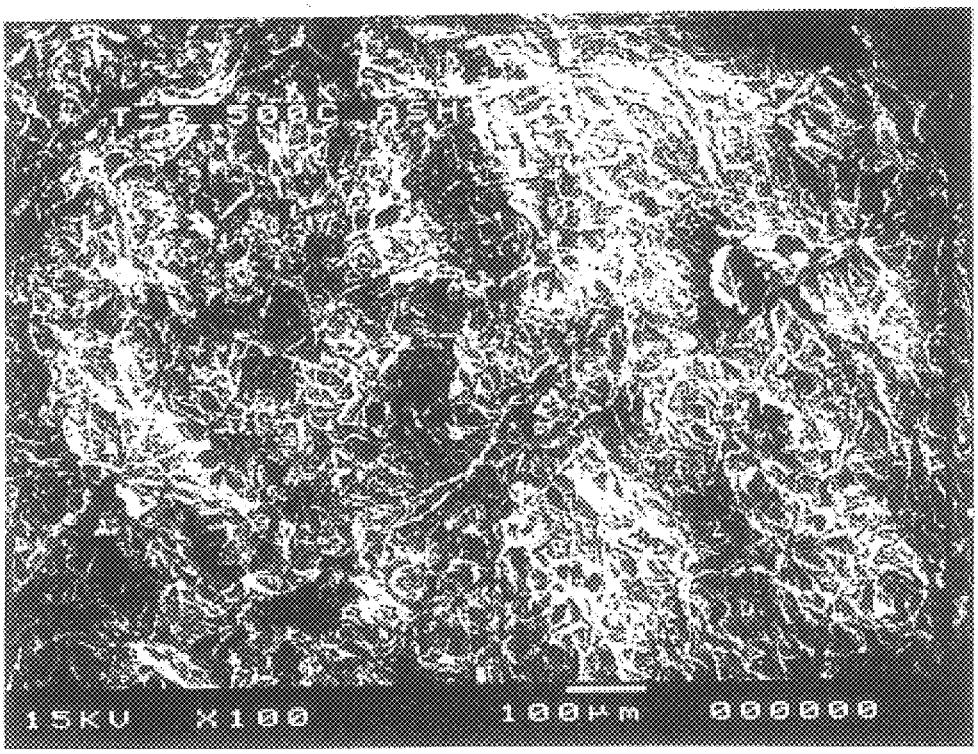
FIG. 7 is an SEM image (×100) of ash from a Ca-FLOCC handsheet.

FIG. 7 illustrates how mullen strength in pounds per square inch (psi) of a control handsheet and a handsheet made according to this example vary with increasing ash content. As with tensile strength, although mullen strength of both handsheets decreased with increasing ash content, the handsheets made according to this example had overall better mullen strength than the control. However, mullen strength even more dramatically exhibits the advantages of paper products made according to the present invention. The slope of the line for the control is greater than that for the handsheets made according to this example, clearly indicating that increasing filler content using the method of the present invention affects the handsheet strength less than simply increasing filler content. Moreover, FIG. 7 shows that the control had a mullen strength of about 11 at an ash content of about 15%, whereas the handsheet made according to the present example had the same mullen strength at an ash content of between 25–30%.

The tensile and mullen strength results for handsheets made according to is example are presented below in Table 15.

TABLE 15

| TRIAL | PCC | % PCC | CAT. STARCH ADDED | (HAND SHEET WT. (g) | % ASH | TEN-SILE | MUL-LEN |
|---|---|---|---|---|---|---|---|
| 1 | SLURRY | 15% | 10#/TON PULP | 1.31 | 12.0 | 9.30 | 12.6 |
| 2 | SLURRY | 30% | SAME | 1.32 | 21.3 | 7.10 | 9.3 |
| 3 | SLURRY | 40% | SAME | 1.32 | 26.5 | 5.60 | 8.1 |
| 4 | SLURRY | 50 | SAME | 1.31 | 31.0 | 3.80 | 6.4 |
| 5 | PREFLOC | 15% | 0 | 1.32 | 11.0 | 11.0 | 13.6 |
| 7 | PREFLOC | 20% | 0 | 1.32 | 13.9 | 10.1 | 14.0 |
| 8 | PREFLOC | 30% | 0 | 1.33 | 23.1 | 8.2 | 11.1 |
| 9 | PREFLOC | 40% | 0 | 1.31 | 30.4 | 6.5 | 8.3 |

Example 19

This example describes methods for making handsheets similar to that described above. But, for this Example a different retention system, namely cationic starch (Stalok 180) and an anionic polymer (Percol 122LE), was used. For control handsheets, a 30% PCC slurry was combined with 10 pounds/ton Stalok 180 and 0.25 pounds/ton high molecular weight anionic polymer, Percol-122LE. The same amounts of additive and retention aid were added to the preflocculated PCC. The results obtained for this example are provided below in Table 16.

TABLE 16

| TRIAL | PCC | % PCC | CAT. STARCH ADDED | (HAND SHEET WT. (g) | % ASH | TEN-SILE | MUL-LEN |
|---|---|---|---|---|---|---|---|
| 10 | SLURRY | 30% | 10#/TON PULP | 1.31 | 22.4 | 6.9 | 10.73 |
| 11 | PREFLOC | 30% | SAME | 1.31 | 25.4 | 7.65 | 12.06 |

Figure 44:
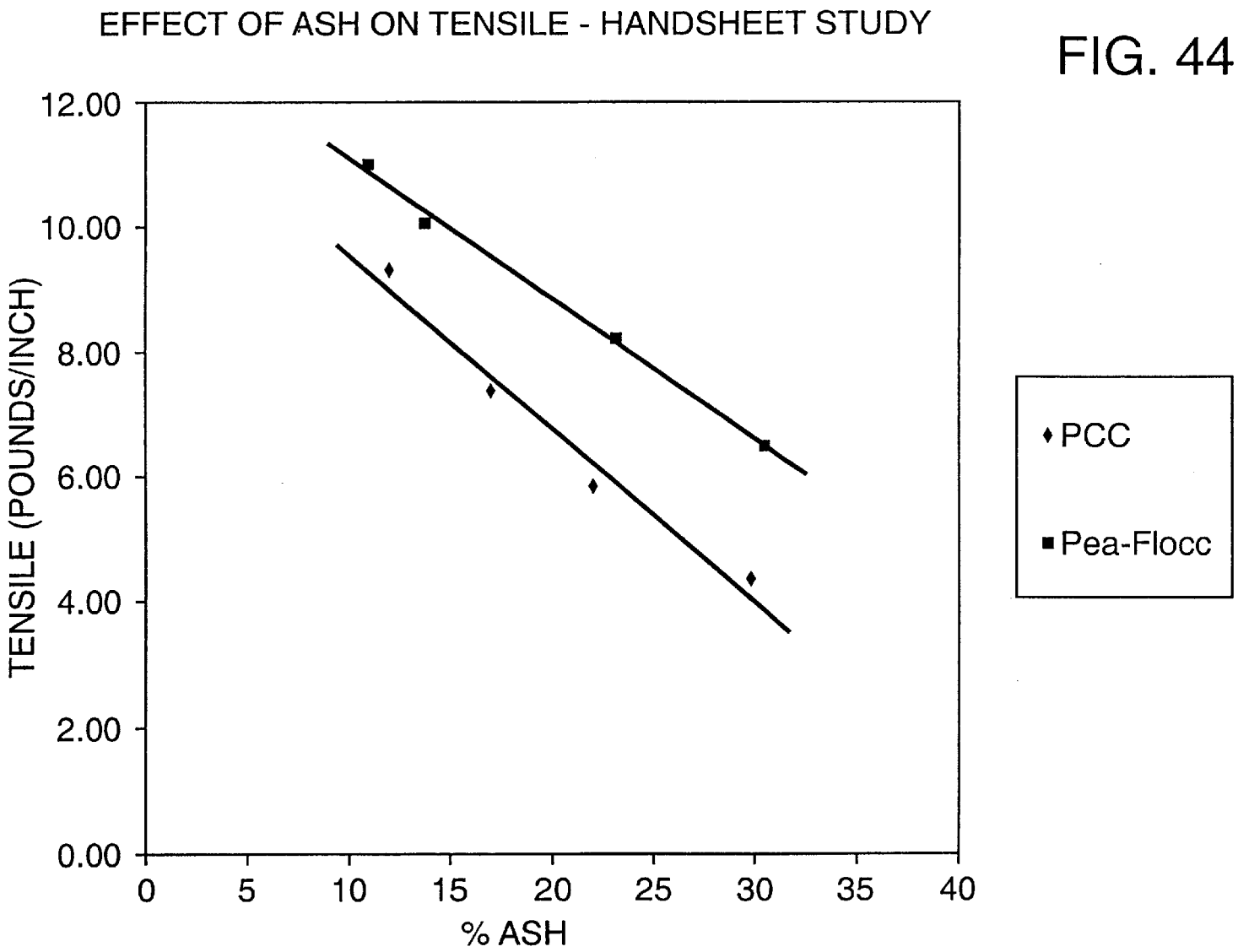
FIG. 44 illustrates how tensile strength of a control handsheet and a handsheet made according to the method of the present invention vary with increasing ash content.
Figure 45:
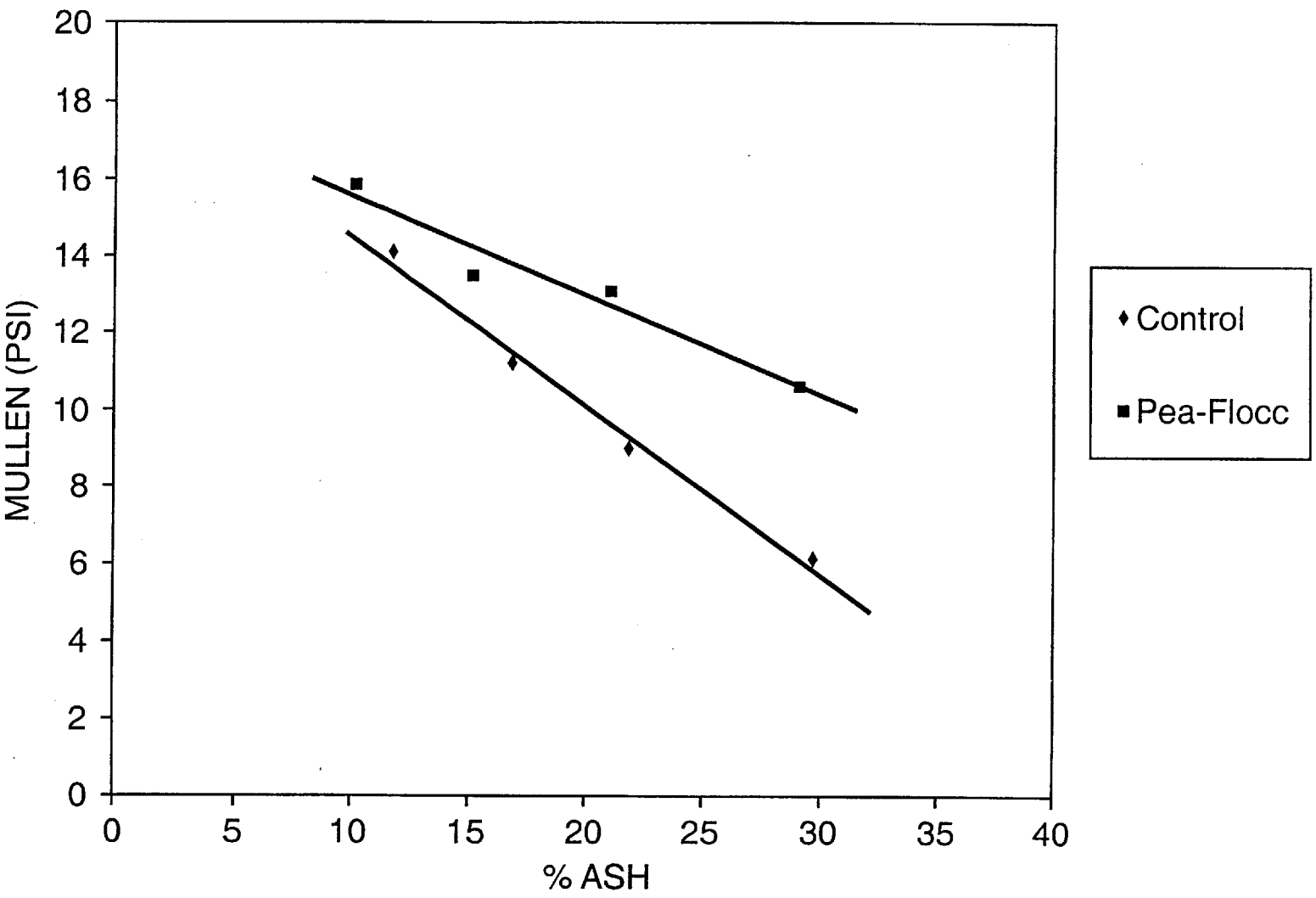
FIG. 45 illustrates how mullen strength of a control handsheet and a handsheet made according to the method of the present invention vary with increasing ash content.

Tables 15 and 16, and FIGS. 44 and 45 demonstrate that paper products made according to the present invention have improved tensile strength and mullen strength.

Example 20

This example describes pilot-scale paper-machine trials at Western Michigan University. The paper machine is 30 inches wide and has a top speed of about 77.8 feet/minute.

Two different starches were used in these trials. STALOK 300 (a cationic starch from Staley) was used as a wet-end starch and for emulsifying ASA sizing agent. Pea starch was used as described above for preflocculating filler particles, and also perhaps as an additive in addition to STALOK 300 starch. Pea starch was cooked in two different ways. The first was jet cooking as described above, and the other was batch cooking at 85° C.–90° C. and 1 atmosphere.

Preflocculation of filler particles was accomplished by a continuous process in which both a PCC slurry and pea starch were pumped from individual tanks through a Y and into a static in-line mixer. Polyaluminum chloride was premixed with cooked pea starch. The PCC was instantaneously flocculated through the static mixer and was collected in a tank ready for combination with fiber furnish for making paper.

Figure 8:
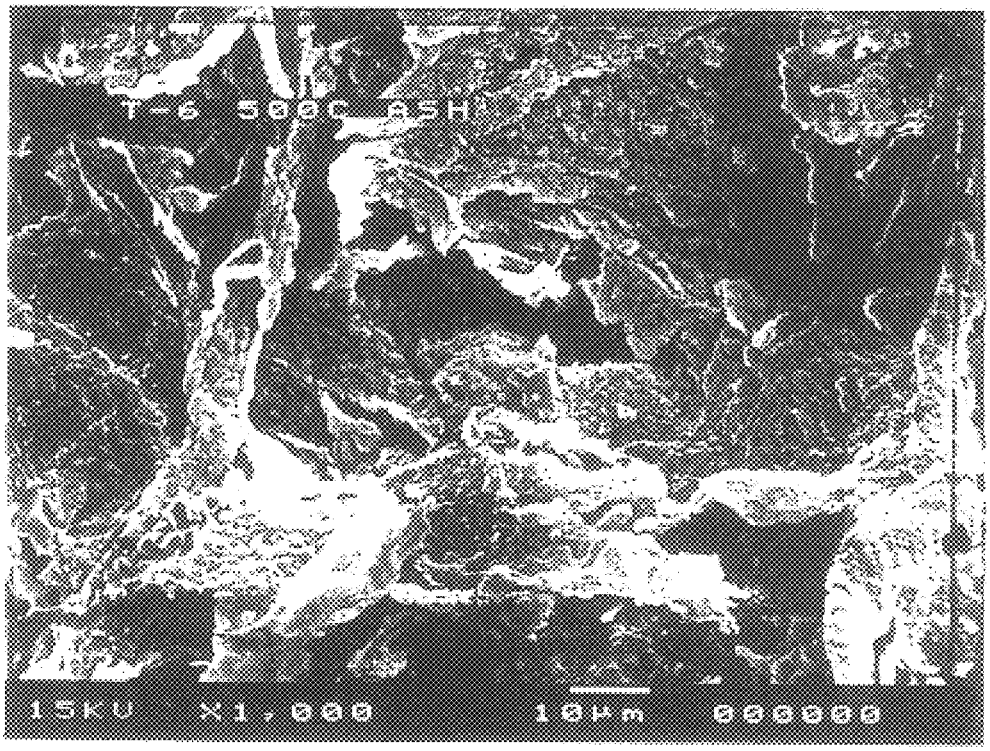
FIG. 8 is an SEM image (×1000) of ash from a Ca-FLOCC handsheet.

The pulp used in the paper machine trials was 27% bleach Kraft softwood and 73% bleach Kraft hardwood. The pulp was refiend 400 CSF. The flocculated filler particles were made with 18 parts PCC and 1 part pea starch with 0.1 part aluminum chloride. STALOK 300 was used as a wet end starch additive and to disperse the ASA sizing agent. The amount of STALOK 300 used in trial number 1 as shown in FIGS. 8 and 9 was 16 pounds/ton, and the ASA size amount was 4 pounds/ton. In trial number 2, with the results shown in FIGS. 10 and 11, only 10 pounds/ton of STALOK were used and no ASA was used. Also, in trial number 2, various amounts of pea starch were added in the wet end that equal the amounts of pea starch used for preflocculating PCC. This is indicated as PCC slurry+pea starch as stated in FIG. 10.

Example 21

This example describes the formation of a Si-FLOCC paper comprising preflocculated PCC filler. 28 grams (O.D.) Of 75% /25% hardwood/softwood from International Falls, Idaho was obtained. A composition useful for making Si-FLOCC paper was made substantially as described above in Example 7. A 12% aqueous sodium silicate composition (based on the weight of the fiber) was formed, and thereafter carbonated with carbon dioxide until the mixture gelled, i.e., about 5 minute. This mixture was stirred for about 1.5 hours before further use. PCC filler was preflocculated with pea starch substantially as described above in Example 14. The pulp was diluted to 0.4% consistency. The flocculated PCC was added to the fiber furnish. Thereafter, the gelled mineral network was added to the PCC/fiber furnish composition. 0.4% bentonite, based on the weight of the PCC/fiber furnish composition, was added. This mixture was stirred for about 1 minute. 0.035% Organopol was then added, followed by stirring for about 30 seconds. A handsheet was made from this mixture substantially as described above in Example 5. Moreover, a control handsheet was made comprising bentonite and Organopol, but no preflocculated PCC.

Certain properties of the handsheets made as described herein are provided below in Table 17.

TABLE 17

| Sample | Conditions | Basis Weight | Ash % | Breaking Length, km | Stretch % | TEA $N \cdot M/m^2$ |
|---|---|---|---|---|---|---|
| Si-NC | Si-FLOCC paper only | 62.35 | 5.9% | 4.29 | 2.25 | 41.0 |
| Si-PCC | Si-FLOCC, and starch-flocculated filler | 61.90 | 14.2% | 2.89 | 1.70 | 20.6 |

The present invention has been described with reference to preferred embodiments. It will be understood by persons of ordinary skill in the art that the invention can vary from that described herein, and still be within the scope of the following claims.

We claim:

1. A cellulosic paper product, comprising:

cellulosic material;

at least one modified starch;

at least one retention material; and a silica/silicate mineral network formed about the cellulosic material.

2. The product according to claim 1 wherein a scanning electron micrograph of ash produced from the product has characteristics displayed by FIG. 8.

3. The product according to claim 1 comprising a Ca-FLOCC paper.

4. The product according to claim 1 comprising a Mg-FLOCC paper.

5. The product according to claim 1 comprising a Sl-FLOCC paper.

6. The product according to claim 1 having a machine direction breaking length of greater than about 2,500 meters at a percent ash content of at least 30%.

7. The product according to claim 1 having a machine direction breaking length of greater than about 2,500 meters at a percent ash content of at least 35%.

8. The product according to claim 1 having a machine direction TEA of greater than 1 ft-lb/$ft^2$ at an ash content of at least 25% ash.

9. The product according to claim 1 having a machine direction TEA of greater than 1 ft-lb/$ft_2$ at an ash content of at least 30% ash.

10. The product according to claim 1 having a machine direction breaking length of rewetted sheet of greater than 175 m at an ash content of at least 25% ash.

11. The product according to claim 1 having a machine direction breaking length of rewetted sheet of greater than 20 m at an ash content of at least 25% ash.

12. The product according to claim 1 having a machine direction breaking length of rewetted sheet of greater than 20 m at an ash content of at least 30% ash.

13. The product according to claim 1 having a machine direction breaking length of rewetted sheet of greater than 2 m at an ash content of at least 35% ash.

14. The product according to claim 1 further comprising filler particles selected from the group consisting of calcium carbonate, chalk, clay, titanium dioxide, talc, dolomite, metal sulphates, kaolin, aluminum hydroxide, satin white, and mixtures thereof.

15. The product according to claim 14 comprising a Ca-FLOCC or a Mg-FLOCC paper product.

* * * * *

UNITED STATES PATENT AND TRADEMARK OFFICE

CERTIFICATE OF CORRECTION

PATENT NO. : 6,494,991 B1
DATED : December 17, 2002
INVENTOR(S) : Palmer et al.

It is certified that error appears in the above-identified patent and that said Letters Patent is hereby corrected as shown below:

Title page,
Item [56], References Cited, U.S. PATENT DOCUMENTS, "Pitt" reference, "3,549,486 A * 12/1970 Pitt" should read -- 3,549,485 A * 12/1970 Eckert --.

Column 5,
Line 12, "in-the" should read -- in the --.

Column 16,
Lines 36 and 39, "z,900" should read -- ▷◁ --.

Column 22,
Line 21, "covenant" should read -- covalently --.

Column 23,
Line 44, "SiO2" should read -- $SiO_2$ --.
Line 56, "CH-" should read -- CH --.

Column 25,
Line 62, "265 Am" should read -- 265 $\mu$m --.

Column 30,
Line 51, "St. Helens 5 Mill" should read -- St. Helens Mill --.

Column 35,
Line 28, "A4RD" should read -- A-4RD --.

Column 36,
Line 4, "C4R and C4RD" should read -- C-4R and C-4RD --.
Line 65, in Table 4, "59.70" should read -- 59.79 --.

Column 38,
Line 34, "7.1˝" should read -- 7.1″ --.

Column 40,
Line 43, "7.1˝" should read -- 7.1″ --.

Column 43,
Line 50, in Table 7, "30 25.7 77.8 36.8 205" should read -- 24.230 77.525.7 39.377.8 28736.8 70205 --.
Line 51, in Table 7, "50 25.1 75.8 41.3 266" should read -- 24.050 78.025.1 42.175.8349 41.3 266 --.

UNITED STATES PATENT AND TRADEMARK OFFICE

CERTIFICATE OF CORRECTION

PATENT NO. : 6,494,991 B1
DATED : December 17, 2002
INVENTOR(S) : Palmer et al.

It is certified that error appears in the above-identified patent and that said Letters Patent is hereby corrected as shown below:

Column 43 (cont'd),
Line 59, "able" should read -- Table --.

Column 46,
Line 50, "CO2" should read -- $CO_2$ --.

Column 47,
Line 15, in Table 9, "RO" should read -- HO --.

Column 49,
Line 44, in Table 10, in the "Sample ID 18," line "1.879" should read -- 1.897 --.

Column 54,
Line 66, in Table 12, "ASA." should read -- ASA, --.

Column 55,
Lines 7 and 8, in Table 12, "No silicate." should read -- No silicate, --.
Line 19, in Table 12, "srirred" should read -- stirred --.
Line 36, in Table 12, "cure." should read -- cure, --.

Column 62,
Line 2, "is" should read -- this --.

Column 64,
Lines 42-43, "2 m" should read -- 20m --.

Signed and Sealed this

Twenty-eighth Day of June, 2005

JON W. DUDAS
*Director of the United States Patent and Trademark Office*